US006546802B2

(12) United States Patent
Shiraishi et al.

(10) Patent No.: US 6,546,802 B2
(45) Date of Patent: Apr. 15, 2003

(54) EVALUATION METHOD OF GOLF CLUB AND GOLF CLUB

(75) Inventors: Takayuki Shiraishi, Hiratsuka (JP); Masayoshi Kogawa, Hiratsuka (JP); Yoh Nishizawa, Hiratsuka (JP); Masaki Akie, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 16 days.

(21) Appl. No.: 09/731,784

(22) Filed: Dec. 8, 2000

(65) Prior Publication Data

US 2001/0006913 A1 Jul. 5, 2001

(51) Int. Cl.[7] ..... A63B 53/00; G01H 13/00

(52) U.S. Cl. ..... 73/579; 73/65.03; 73/12.04; 73/651; 73/783; 73/849

(58) Field of Search ..... 73/783, 651, 579, 73/11.08, 11.09, 65.03, 12.04; 273/77 A, 80 B; 29/407; 473/321, 324

(56) References Cited

U.S. PATENT DOCUMENTS 4,070,022 A * 1/1978 Braly ..... 273/77 A
5,040,279 A * 8/1991 Braly ..... 29/407
5,163,681 A * 11/1992 Hodgetts ..... 273/77 A
5,324,032 A * 6/1994 Minami ..... 273/80 B
5,379,641 A * 1/1995 Paasivaara et al. ..... 73/579
5,703,294 A * 12/1997 McMConnell et al. ..... 73/579
5,759,113 A * 6/1998 Lai et al. ..... 473/321
5,796,005 A * 8/1998 Frowlow ..... 73/651
5,952,580 A * 9/1999 Haas ..... 73/783

FOREIGN PATENT DOCUMENTS

JP 52-126321 10/1977
JP 1-285276 11/1989

* cited by examiner

*Primary Examiner*—Paul T. Sewell
*Assistant Examiner*—Tom Duong
(74) *Attorney, Agent, or Firm*—Finnegan, Henderson, Farabow, Garrett & Dunner, L.L.P.

(57) ABSTRACT

Disclosed is an evaluation method of a golf club, where a rear end portion of a club shaft is vibrated in a state where a tip portion of the club shaft is fastened to measure a frequency per unit time, and a golf club using the club shaft is evaluated based on the frequency.

6 Claims, 38 Drawing Sheets

FIG. 32(a)

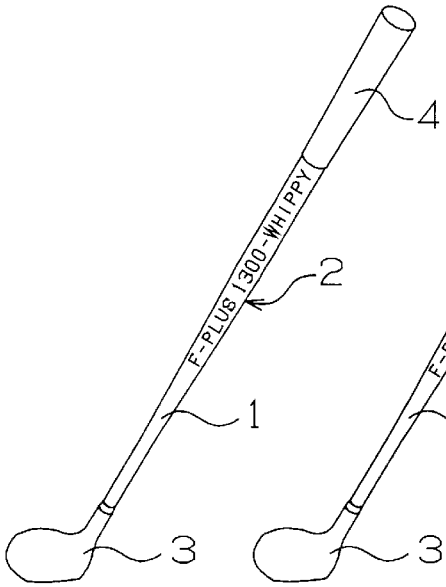

FIG. 32(b)

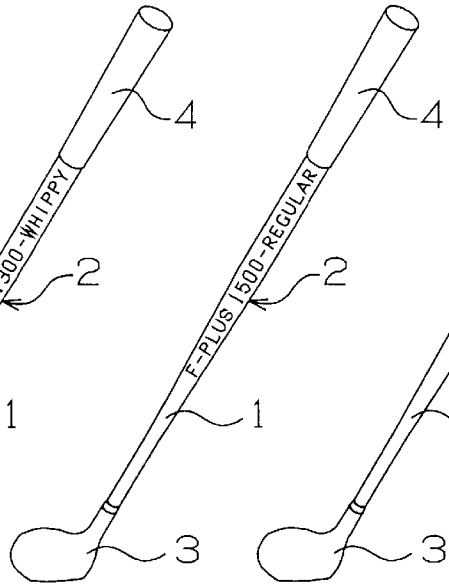

FIG. 32(c)

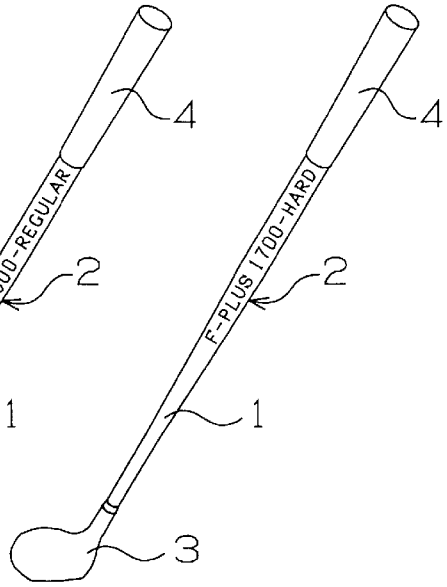

FIG. 33(a)

1000cpm

Indication of the sum of numerical values of frequencies The larger the numerical value, the stiffer the club shaft. 1000 cpm has a flexible feeling

FIG. 33(b)

1300cpm

Indication of the sum of numerical values of frequencies The larger the numerical value, the stiffer the club shaft. 1300 cpm has a regular feeling

FIG. 33(c)

1600cpm

Indication of the sum of numerical values of frequencies The larger the numerical value, the stiffer the club shaft. 1600 cpm has a stiff feeling

FIG. 35 (a)

| | | | |
|---|---|---|---|
| ★380~400 | 1 | Flexible | Indicated in the sum of frequencies (cpm). |
| 400~420 | 2 | Slightly flexible | |
| 420~460 | 3 | Regular | |
| 460~480 | 4 | Slightly stiff | |
| 480~500 | 5 | Stiff | |

FIG. 35 (b)

| | | | |
|---|---|---|---|
| 380~400 | 1 | Flexible | Indicated in the sum of frequencies (cpm). |
| ★400~420 | 2 | Slightly flexible | |
| 420~460 | 3 | Regular | |
| 460~480 | 4 | Slightly stiff | |
| 480~500 | 5 | Stiff | |

FIG. 35 (c)

| | | | |
|---|---|---|---|
| 380~400 | 1 | Flexible | Indicated in the sum of frequencies (cpm). |
| 400~420 | 2 | Slightly flexible | |
| ★420~460 | 3 | Regular | |
| 460~480 | 4 | Slightly stiff | |
| 480~500 | 5 | Stiff | |

FIG. 35 (d)

| | | | |
|---|---|---|---|
| 380~400 | 1 | Flexible | Indicated in the sum of frequencies (cpm). |
| 400~420 | 2 | Slightly flexible | |
| 420~460 | 3 | Regular | |
| ★460~480 | 4 | Slightly stiff | |
| 480~500 | 5 | Stiff | |

FIG. 35 (e)

| | | | |
|---|---|---|---|
| 380~400 | 1 | Flexible | Indicated in the sum of frequencies (cpm). |
| 400~420 | 2 | Slightly flexible | |
| 420~460 | 3 | Regular | |
| 460~480 | 4 | Slightly stiff | |
| ★480~500 | 5 | Stiff | |

FIG. 36 (a)

| Sum of frequencies (cpm) | Indication | Flex |
|---|---|---|
| 1200~1300 | 1 | Super flexible |
| 1300~1400 | 2 | Flexible |
| 1400~1600 | 3 | Regular |
| 1600~1700 | 4 | Stiff |
| 1700~1800 | 5 | Super stiff |

FIG. 36 (b)

| Sum of frequencies (cpm) | Indication | Flex |
|---|---|---|
| 1200~1300 | 1 | Super flexible |
| 1300~1400 | 2 | Flexible |
| 1400~1600 | 3 | Regular |
| 1600~1700 | 4 | Stiff |
| 1700~1800 | 5 | Super stiff |

FIG. 36 (c)

| Sum of frequencies (cpm) | Indication | Flex |
|---|---|---|
| 1200~1300 | 1 | Super flexible |
| 1300~1400 | 2 | Flexible |
| 1400~1600 | 3 | Regular |
| 1600~1700 | 4 | Stiff |
| 1700~1800 | 5 | Super stiff |

FIG. 36 (d)

| Sum of frequencies (cpm) | Indication | Flex |
|---|---|---|
| 1200~1300 | 1 | Super flexible |
| 1300~1400 | 2 | Flexible |
| 1400~1600 | 3 | Regular |
| 1600~1700 | 4 | Stiff |
| 1700~1800 | 5 | Super stiff |

FIG. 36 (e)

| Sum of frequencies (cpm) | Indication | Flex |
|---|---|---|
| 1200~1300 | 1 | Super flexible |
| 1300~1400 | 2 | Flexible |
| 1400~1600 | 3 | Regular |
| 1600~1700 | 4 | Stiff |
| 1700~1800 | 5 | Super stiff |

FIG. 40 m

The ABCD series

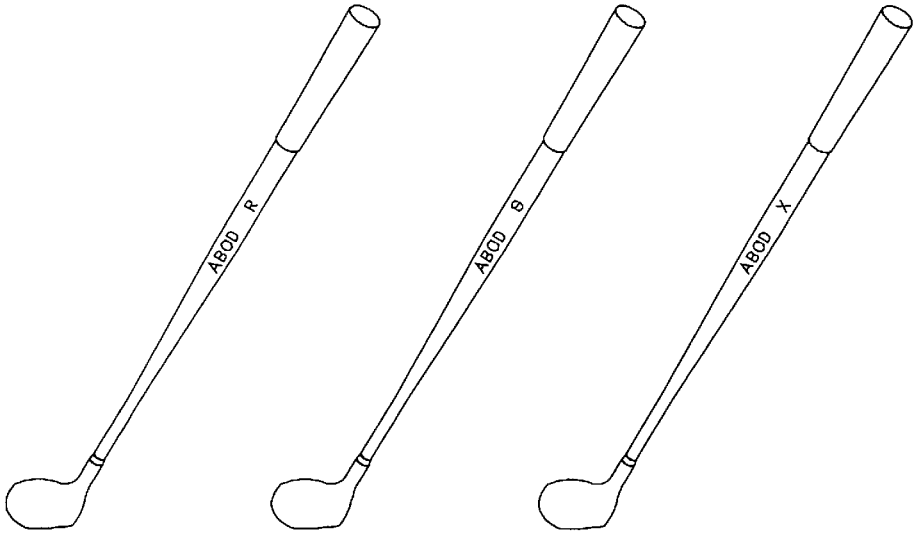

This is not a conventional indication of R, S, X.
The ABCD series is controlled by the total frequency system.
You can find the golf club that fits you.

| Type | Totalfrequency | Shaft mass | Suitable head speed |
|---|---|---|---|
| R | 1300cpm | 60g | 40m/s |
| S | 1500cpm | 70g | 43m/s |
| X | 1700cpm | 80g | 46m/s |

※Total frequency system is:
a system that indicates the flex of a club shaft by the sum of the numerical values (total frequency) of the measured frequencies, which are obtained by fastening a grip portion and a head portion of a shaft.
The larger the numerical value, the stiffer the club shaft.

FIG. 42 m'

The club BCDE

With the design based on the sum of frequency theory that has never existed before, selection of the club that fits the golfer's feeling becomes possible.

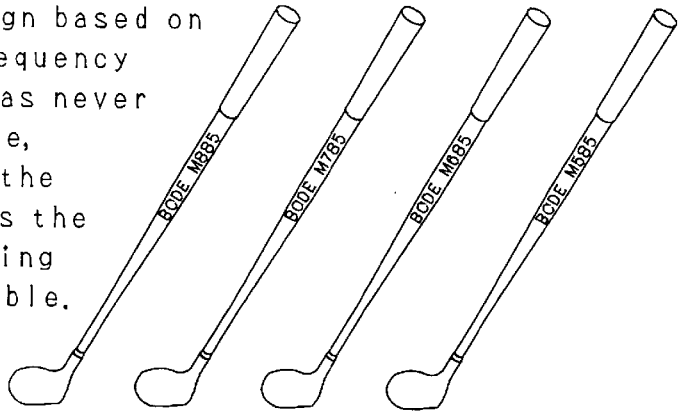

M885 for hard hitters, M785 for average hitters
M685 for seniors, M585 for ladies

The sum of frequency theory is:

A theory to indicate the flex of the shaft by the sum (cpm) of the numerical values that is obtained by measuring the frequency by fastening a grip portion of the shaft as in (A) and the frequency by fastening a head portion of the shaft as in (B) on the right.

Conventionally, the flex has been indicated by the numerical value of measurement in (A), but the flex could not be accurately indicated because the numerical value could not reflect the difference of a vibration shape of every shaft.

For the first time, with the sum of frequency theory, the flex can now be accurately indicated.

The stiffer the shaft, the larger the numerical value.

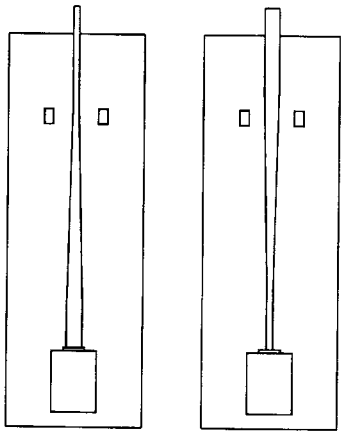

(A) (B)

FIG. 43(a) FIG. 43(b) FIG. 43(c)

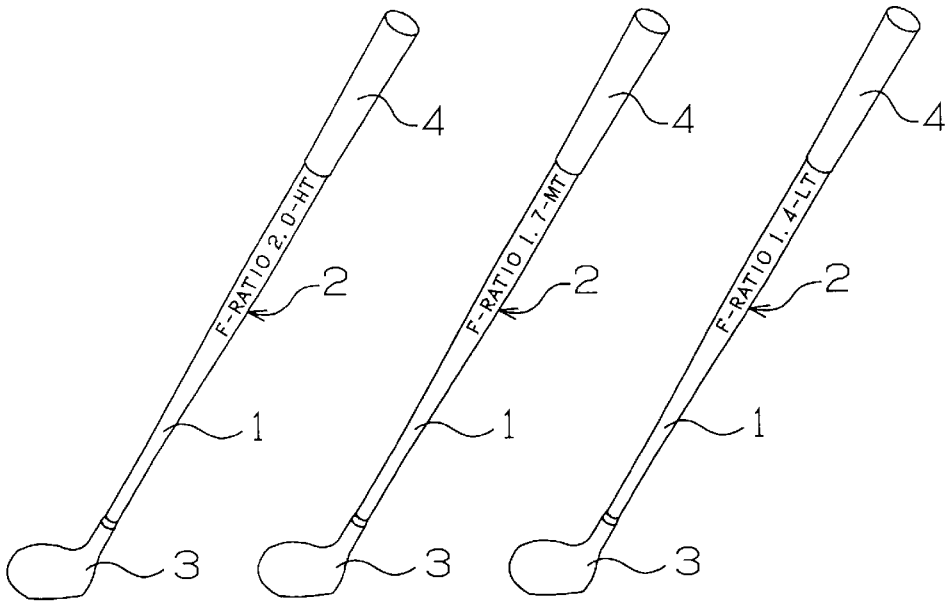

FIG. 44(a) FIG. 44(b) FIG. 44(c)

| 1.4 | 1.7 | 2.0 |
|---|---|---|
| Ratio indication of the numerical values of the frequencies The larger the numerical value, the higher the trajectory. 1.4 indicates a shaft that presents a low trajectory. | Ratio indication of the numerical values of the frequencies The larger the numerical value, the higher the trajectory. 1.7 indicates a shaft that presents a middle trajectory. | Ratio indication of the numerical values of the frequencies The larger the numerical value, the higher the trajectory. 2.0 indicates a shaft that presents a high trajectory. |

FIG. 46 (a)

| | | | |
|---|---|---|---|
| ★1.2~1.4 | 1 | Super low trajectory | |
| 1.4~1.6 | 2 | Low trajectory | Indicated |
| 1.6~1.8 | 3 | Middle trajectory | in the ratio |
| 1.8~2.0 | 4 | High trajectory | of the |
| 2.0~2.2 | 5 | Super high trajectory | frequencies. |

FIG. 46 (b)

| | | | |
|---|---|---|---|
| 1.2~1.4 | 1 | Super low trajectory | |
| ★1.4~1.6 | 2 | Low trajectory | Indicated |
| 1.6~1.8 | 3 | Middle trajectory | in the ratio |
| 1.8~2.0 | 4 | High trajectory | of the |
| 2.0~2.2 | 5 | Super high trajectory | frequencies. |

FIG. 46 (c)

| | | | |
|---|---|---|---|
| 1.2~1.4 | 1 | Super low trajectory | |
| 1.4~1.6 | 2 | Low trajectory | Indicated |
| ★1.6~1.8 | 3 | Middle trajectory | in the ratio |
| 1.8~2.0 | 4 | High trajectory | of the |
| 2.0~2.2 | 5 | Super high trajectory | frequencies. |

FIG. 46 (d)

| | | | |
|---|---|---|---|
| 1.2~1.4 | 1 | Super low trajectory | |
| 1.4~1.6 | 2 | Low trajectory | Indicated |
| 1.6~1.8 | 3 | Middle trajectory | in the ratio |
| ★1.8~2.0 | 4 | High trajectory | of the |
| 2.0~2.2 | 5 | Super high trajectory | frequencies. |

FIG. 46 (e)

| | | | |
|---|---|---|---|
| 1.2~1.4 | 1 | Super low trajectory | |
| 1.4~1.6 | 2 | Low trajectory | Indicated |
| 1.6~1.8 | 3 | Middle trajectory | in the ratio |
| 1.8~2.0 | 4 | High trajectory | of the |
| ★2.0~2.2 | 5 | Super high trajectory | frequencies. |

FIG. 47 (a)

| Ratio of the frequencies | Indication | Trajectory |
|---|---|---|
| 1. 3～1. 5 | 1 | Super low |
| 1. 5～1. 7 | 2 | Low |
| 1. 7～1. 9 | 3 | Middle |
| 1. 9～2. 1 | 4 | High |
| 2. 1～2. 3 | 5 | Super high |

FIG. 47 (b)

| Ratio of the frequencies | Indication | Trajectory |
|---|---|---|
| 1. 3～1. 5 | 1 | Super low |
| 1. 5～1. 7 | 2 | Low |
| 1. 7～1. 9 | 3 | Middle |
| 1. 9～2. 1 | 4 | High |
| 2. 1～2. 3 | 5 | Super high |

FIG. 47 (c)

| Ratio of the frequencies | Indication | Trajectory |
|---|---|---|
| 1. 3～1. 5 | 1 | Super low |
| 1. 5～1. 7 | 2 | Low |
| 1. 7～1. 9 | 3 | Middle |
| 1. 9～2. 1 | 4 | High |
| 2. 1～2. 3 | 5 | Super high |

FIG. 47 (d)

| Ratio of the frequencies | Indication | Trajectory |
|---|---|---|
| 1. 3～1. 5 | 1 | Super low |
| 1. 5～1. 7 | 2 | Low |
| 1. 7～1. 9 | 3 | Middle |
| 1. 9～2. 1 | 4 | High |
| 2. 1～2. 3 | 5 | Super high |

FIG. 47 (e)

| Ratio of the frequencies | Indication | Trajectory |
|---|---|---|
| 1. 3～1. 5 | 1 | Super low |
| 1. 5～1. 7 | 2 | Low |
| 1. 7～1. 9 | 3 | Middle |
| 1. 9～2. 1 | 4 | High |
| 2. 1～2. 3 | 5 | Super high |

FIG. 51

M

The CDEF series

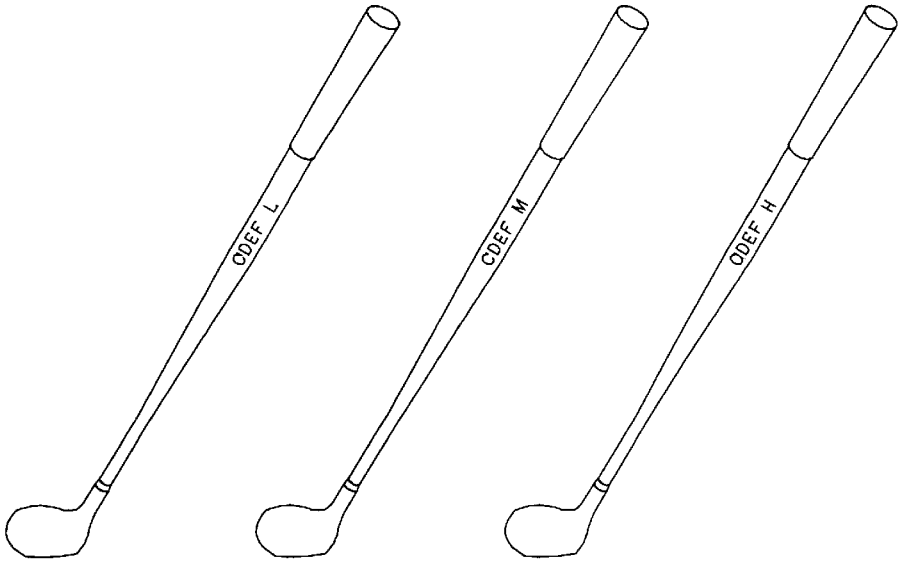

Conventional bendpoint is unsatisfactory.
The CDEF series is controlled by the frequency ratio system.
You can find the golf club that fits you.

| Type | Frequency ratio | Shaft mass | Suitable head speed |
|---|---|---|---|
| L | 1.4 | 70g | 43m/s |
| M | 1.7 | 65g | 40m/s |
| H | 2.0 | 60g | 37m/s |

※ Frequency ratio system is:

A system that indicates the launching angle of a ball by the shaft by the ratio of the numerical values (frequency ratio) of the measured frequencies, which are obtained by fastening a grip portion and a head portion of the shaft.

The larger the numerical value, the higher the ball flies.

FIG. 53

M'

The club DEFG

With the design for the height of the trajectory based on the ratio of frequency theory that has never existed before, selection of the club becomes possible that fits the trajectory which every golfer wants to get.

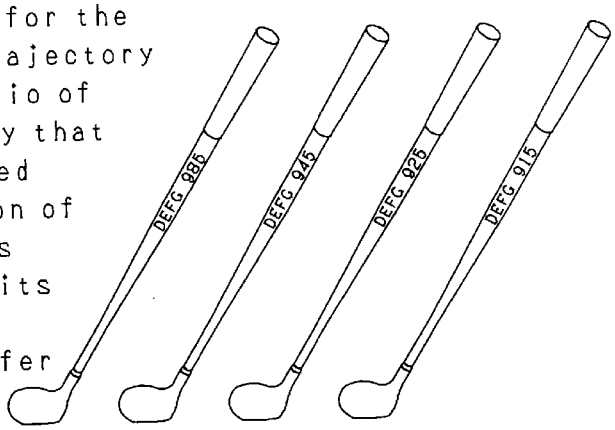

985 with a super high trajectory for attacking by a big carry
945 with a high trajectory for attacking by a constant carry
925 with a low trajectory for attacking by an accurate directionality
915 with a super low trajectory attacking into the wind

The ratio of frequency theory is:

a theory that indicates the launching angle of a ball by a bending of the shaft by the ratio (a/(a+b)) between the measured numerical value a of frequency, which is obtained by fastening a grip portion of a shaft as in (A) and the numerical value b of frequency, which is obtained by fastening a head portion of a shaft as in (B) on the right. The larger the ratio, the higher the trajectory becomes, and the smaller the ratio, the lower the trajectory becomes.

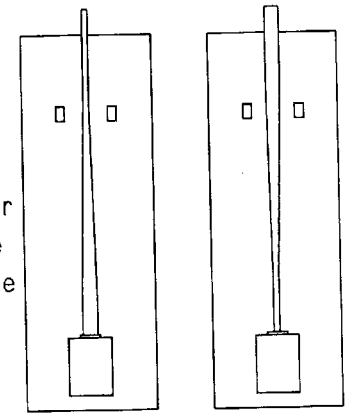

(A) (B)

EVALUATION METHOD OF GOLF CLUB AND GOLF CLUB

BACKGROUND OF THE INVENTION

The present invention relates to a novel evaluation method of the golf club different from a conventional method, and a golf club evaluated by the evaluation method. More particularly, the present invention relates to a evaluation method of the golf club capable of showing flexibility felt by a golfer more accurately than in the conventional case, and a golf club evaluated by this evaluation method. Alternatively, the present invention relates to an evaluation method of the golf club capable of showing a hit ball height presented by a golf club more accurately, and a golf club evaluated by the evaluation method.

The golfer tries to improve his/her skills for better golf playing. However, on the other hand, much depends on golf clubs to be used. Thus, better performance is always required of the golf clubs. To provide better performance golf clubs, especially since bending occurs in a club shaft constituting a golf club during swinging, physical performance such as flexibility felt by the golfer is greatly influenced by the bending.

Therefore, in order to provide a golf club having optimal flexibility to the golfer, the degree of flexibility has been expressed quantitatively, i.e., in numerical values. Various studies have been made, particularly on the frequency of the club shaft from early times.

For example, Japanese patent application Kokai publication No. 52-126321 discloses a technology for establishing harmony in frequency among the shafts of golf clubs in a set. In this case, in the set including a plurality of golf clubs, the harmony is obtained by selecting a proper club shaft in such a way as to set a plot between a shaft frequency and a shaft length at a specified gradient, and combining this club shaft with a specified club head.

Japanese patent application Kokai publication No. 1-285276 discloses a technology for increasing a carry and reducing mistaken shots. These objects are achieved specifically by deciding an optimal frequency intrinsic to a golfer from his/her swinging characteristic, and selecting a golf club having an optimal frequency based on this optimal intrinsic frequency.

In addition to the above technologies in the conventional art, generally, the numerical values of frequencies regarding the club shafts or golf clubs have widely been used. The method of measurement for frequencies was carried out as follows. That is, in the case of the club shaft, a frequency was measured by attaching a weight to the tip portion of the club shaft, i.e., a head portion with a rear end fastened, in other words, a grip portion. On the other hand, a frequency was measured by fastening the rear end portion of the grip.

The frequency measurement of the club shaft has basically been performed mainly by a golf club manufacturer, or a club shaft manufacturer. Performance evaluation was made for a single club shaft, and the result thereof was reflected on a golf club. The frequency measurement of the golf club has been very general, and carried out even at a golf shop or the like. The result thereof has been considered as one of the performance evaluations of the golf clubs.

The performance evaluation of the club shaft or golf club mainly means evaluation on club shaft flexibility. In the case of club shafts, if the lengths are equal, as a numerical value of a frequency is larger, the shaft is evaluated to be stiffer.

The golf club manufacturer or the like has referred to the numerical value of a club shaft frequency, and thereby decided to reduce the frequency of the golf club by attaching a heavy club head to the club shaft, or conversely to increase the frequency of the golf club by attaching a light club head to the club shaft. In other words, the frequency of the club shaft has been used for a part of a development process designed to predict golf club characteristics based on evaluation for each component of the golf club.

If the lengths of the golf clubs are equal, a club having a larger numerical value of frequency is generally suited for a fast head speed golfer, since a stiffer feeling is provided as the numerical value of a frequency is larger. A club having a lower numerical value of frequency is generally suited for a slow head speed golfer, since a more flexible feeling is provided as the numerical value of frequency is smaller. The golf club manufacturer, the golf shop or the like has indicated the frequency numerical value of each golf club as the index of the feeling of flexibility, and the user has purchased a golf club by using such an index as a yardstick.

However, noncoincidence often occurred between the numerical value of a frequency and flexibility actually felt by the golfer. For example, when the golfer who used the golf club having a metallic golf shaft attached thereto changed it to the golf club having a fiber reinforced resin club shaft attached thereto, a change often occurred also in the feeling of flexibility.

Such a phenomenon was not due to a mere difference between the metallic club shaft and the fiber reinforced club shaft, because the phenomenon was observed between the metallic club shafts or between the fiber reinforced club shafts. In addition, even between similar club heads, equal club shaft masses, equal golf club masses and equal golf club lengths, the phenomenon was observed because of a difference between the club shafts.

With regard to noncoincidence between the numerical value of a frequency measured in the conventional art and the flexibility actually felt by the golfer, the inventors paid attention to a longitudinal stiffness distribution among club shafts. More specifically, in the conventional method of measurement, in the case of golf clubs having equal lengths, there is a tendency that the numerical value of a frequency is smaller as the stiffness of a rear end portion is lower, and the numerical value of a frequency is larger as the stiffness of a tip portion is lower.

As described above, in the conventional evaluation method for measuring a frequency by fastening the rear end portion of the club shaft and then evaluating the flexibility of the golf club based on the numerical value of the frequency, depending on a difference in a stiffness distribution among the golf clubs, there has been cases where the frequency was small even in the golf club actually felt stiff by the golfer, and the frequency was large even in the golf club actually felt flexible by the golfer. Thus, the expression of the flexibility actually felt by the golfer based on the numerical value of a frequency used in the conventional evaluation method was not sufficient.

The above tendency has been particularly conspicuous in the fiber reinforced rein club shaft that has been popular in recent years. As a result, an opinion has recently taken precedence that the numerical values of frequencies should be used only for reference without any excessive dependence thereon.

SUMMARY OF THE INVENTION

The object of the present invention is to provide an evaluation method of a golf club, capable of more accurately showing the characteristic of a club shaft. More particularly, the object of the present invention is to provide an evaluation method of a golf club, capable of showing flexibility felt by a golfer more accurately than in the conventional case, and a golf club evaluated by the evaluation method. Alternatively, the present invention provides an evaluation method of a golf club, capable of more accurately showing the height of a hit ball presented by a golfer, and a golf club evaluated by the evaluation method.

In order to achieve the foregoing object, in accordance with a first aspect of the present invention, the evaluation method of a golf club comprises the steps of: measuring a frequency per unit time by vibrating a rear end portion while keeping a tip portion of a club shaft in a fastened state; and evaluating a golf club using the club shaft based on the frequency.

As a result of zealous studies, the inventors discovered that the frequency measured by vibrating the rear end portion while keeping the tip portion of the club shaft in a fastened state is useful for accurately understanding the characteristic of the club shaft, and came up with the present invention.

The frequency measured by vibrating the rear end portion while keeping the tip portion of the club shaft in a fastened state can be singly used for evaluation of the golf club, or can be used for the same purpose in combination with a frequency per unit time measured by vibrating the tip portion while keeping the rear end portion of the club shaft in a fastened state. In other words, while the frequency per unit time is measured by vibrating the tip portion with the rear end portion of the club shaft kept in a fastened state, the frequency per unit time is measured by vibrating the rear end portion with the tip portion of the club shaft kept in a fastened state and, based on the calculated values of these frequencies, the golf club using the club shaft can be evaluated.

In order to achieve the foregoing object, in accordance with a second aspect of the present invention, the evaluation method of a golf club comprises the steps of: measuring a frequency per unit time by vibrating a tip portion while keeping a rear end portion of a club shaft in a fastened state; measuring a frequency per unit time by vibrating the rear end portion while keeping the tip portion of the club shaft in a fastened state; and evaluating a golf club using the club shaft based on the sum of these frequencies.

As a result of zealous studies, the inventors discovered that there is a correlation between the sum of the frequency measured by vibrating the tip portion while keeping the rear end portion of the club shaft in a fastened state and the frequency measured by vibrating the rear end portion while keeping the tip portion of the club shaft in a fastened state and flexibility actually felt by a golfer, and came up with the present invention.

By evaluating the golf club based on the sum of such frequencies, flexibility felt by the golfer can be shown more accurately than in the conventional case.

In order to achieve the foregoing object, in accordance with a third aspect of the present invention, the evaluation method of a golf club comprises the steps of: measuring a frequency of per unit time by vibrating a tip portion while keeping the rear end portion of a club shaft in a fastened state; measuring a frequency per unit time by vibrating the rear end portion while keeping the tip portion of the club shaft in a fastened state; and evaluating a golf club using the club shaft based on the ratio of these frequencies.

As a result of zealous studies, the inventors discovered that there is a correlation between the ratio of the frequencies measured by vibrating the tip portion while keeping the rear end portion of the club shaft in a fastened state and the frequency measured by vibrating the rear end portion while keeping the tip portion of the club shaft in a fastened state and a height of a hit ball actually presented by the golf club, and came up with the present invention.

By evaluating the golf club based on the ratio of such frequencies, the height of the hit ball presented by the golf club can be shown more accurately.

In the above measurement of frequencies, a weight may be attached to the end portion of the club shaft to be vibrated. In other words, a frequency per unit time can be measured by vibrating the tip portion while keeping the rear end portion of the club shaft in a fastened state and the weight attached to the tip portion. In addition, a frequency per unit time can be measured by vibrating the rear end portion while keeping the tip portion of the club shaft in a fastened state and the weight attached to the rear end portion.

On the other hand, the golf club of the present invention includes a club head attached to the tip portion of the club shaft, and a grip or a grip portion provided in the rear end portion. In this case, the golf club is evaluated based on the sum of the frequency per unit time measured by vibrating the tip portion while keeping the rear end portion of the club shaft in a fastened state and the frequency per unit time measured by vibrating the rear end portion while keeping the tip portion of the club shaft in a fastened state.

According to the golf club evaluated based on the sum of such frequencies, flexibility felt by the golfer can be recognized more accurately than in the conventional case.

The golf club of the present invention includes a club head attached to the tip portion of the club shaft, and a grip or a grip portion provided in the rear portion. In this case, the golf club is evaluated based on the ratio of the frequency per unit time measured by vibrating the tip portion while keeping the rear end portion of the club shaft in a fastened state and the frequency per unit time measured by vibrating the rear end portion while keeping the tip portion of the club shaft in a fastened state.

According to the golf club evaluated based on the ratio of such frequencies, the height of a hit ball presented by the golf club can be recognized accurately.

Means for providing evaluation based on the sum or the ratio of the frequencies like that described above for the golf club can be optionally selected. According to first means, a value showing the sum or ratio of the frequencies can be indicated in a part of the golf club. According to second means, reference information for recognizing the value of the sum or ratio of the frequencies can be used. According to third means, the value showing the sum or ratio of the frequencies can be set corresponding to the model of the golf club. In any means, the evaluation of the golf club can be easily understood based on the sum or ratio of the frequencies.

In the present invention, there should be no particular limitation placed on the unit time of a frequency. For example, a frequency (cpm) per minute or a frequency (Hz) per second, can be measured. Generally, since a frequency (cpm) per minute is used in the golf industry, the present invention will be described by using a frequency (cpm) per minute, for facilitating understanding.

BRIEF DESCRIPTION OF THE DRAWINGS

For a more complete understanding of the present invention and the advantages thereof, reference is now made to the following description taken in conjunction with the accompanying drawings.

FIGS. 32 (*a*) to 32 (*c*) are front views, each thereof showing a golf club according to a first embodiment of the present invention.

FIGS. 33 (*a*) to 33 (*c*) are partially expanded plan views, each thereof showing an application example of the golf club according to the first embodiment of the present invention.

FIGS. 35 (*a*) to 35 (*e*) are partially expanded plan views, each thereof showing an application example of the golf club according to the first embodiment of the present invention.

FIGS. 36 (*a*) to 36 (*e*) are partially expanded plan views, each thereof showing an application example of the golf club according to the first embodiment of the present invention.

FIG. 40 is a plan view of a medium on which description is indicated regarding each of the golf clubs of FIGS. 39 (*a*) to 39 (*c*).

FIG. 42 is a plan view of a medium on which description is indicated regarding each of the golf clubs of FIGS. 41 (*a*) to 41 (*d*).

FIGS. 43 (*a*) to 43 (*c*) are front views, each thereof showing a golf club according to a fourth embodiment of the present invention.

FIGS. 44 (*a*) to 44 (*c*) are partially expanded plan views, each thereof showing an application example of the golf club according to the fourth embodiment of the present invention.

FIGS. 46 (*a*) to 46 (*e*) are partially expanded plan views, each thereof showing an application example of the fourth embodiment of the present invention.

FIGS. 47 (*a*) to 47 (*e*) are partially expanded plan views, each thereof showing an application example of the golf club according to the fourth embodiment of the present invention.

FIG. 51 is a plan view of a medium on which description is indicated regarding each of the golf clubs of FIGS. 50 (*a*) to 50 (*c*).

FIG. 53 is a plan view of a medium on which description is indicated regarding each of the golf clubs of FIGS. 52 (*a*) to 52 (*d*).

DETAILED DESCRIPTION OF THE PREFERRED EMBODIMENTS

Figure 1:
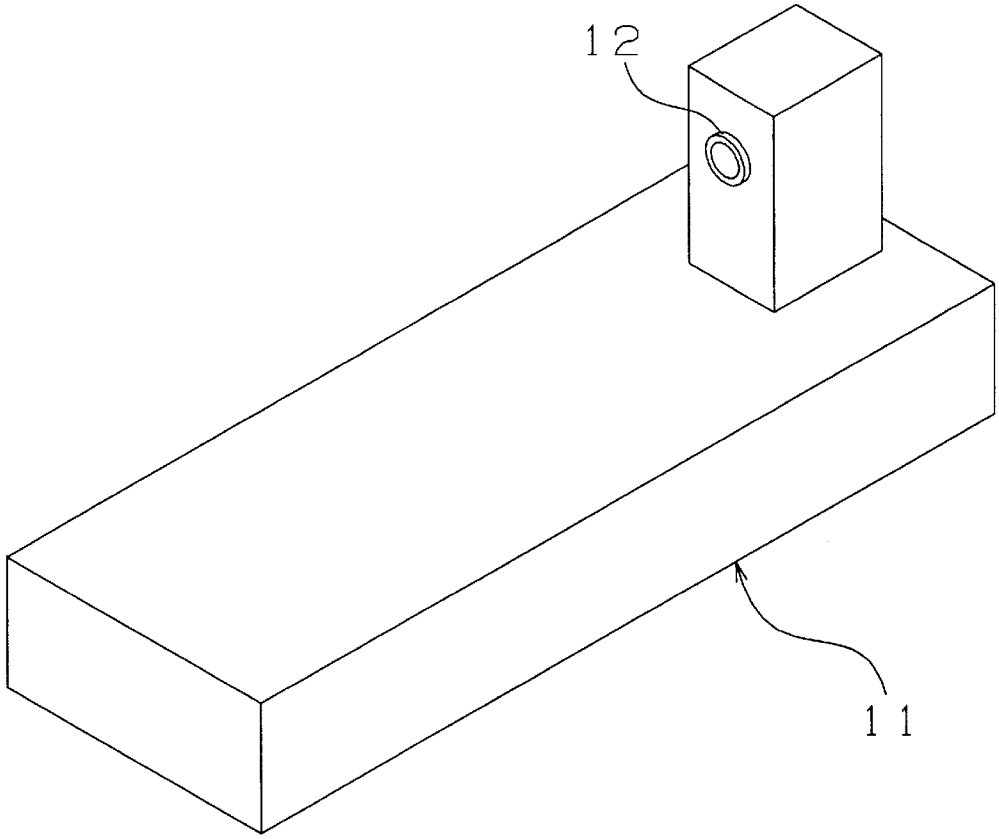
FIG. 1 is a perspective view showing a basic constitution of a frequency measuring device used for an evaluation method of a golf club according to the present invention.
Figure 2:
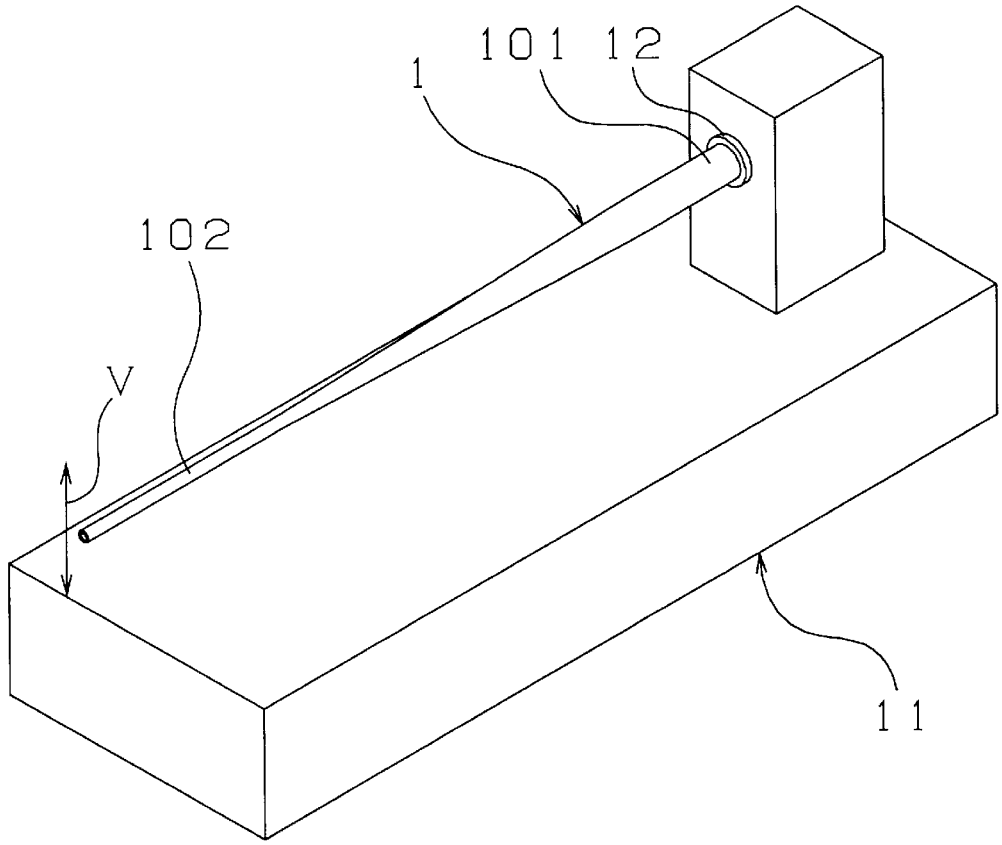
FIG. 2 is a perspective view showing a state of a rear end portion of a club shaft fastened to the frequency measuring device of FIG. 1.

Next, the preferred embodiments of the present invention will be described with reference to the accompanying drawings. FIG. 1 shows a frequency measuring device. The frequency measuring device denoted at (11) includes a chucking unit (12). As shown in FIG. 2, a measuring method includes the steps of: fastening a rear end portion (101) of a club shaft (1) to the chucking unit (12) of the frequency measuring device (11); displacing a tip portion (102) in a vertical direction by picking it with a hand; vibrating the tip portion by releasing the hand; and then measuring a frequency per minute (cpm) of a club shaft.

Figure 3:
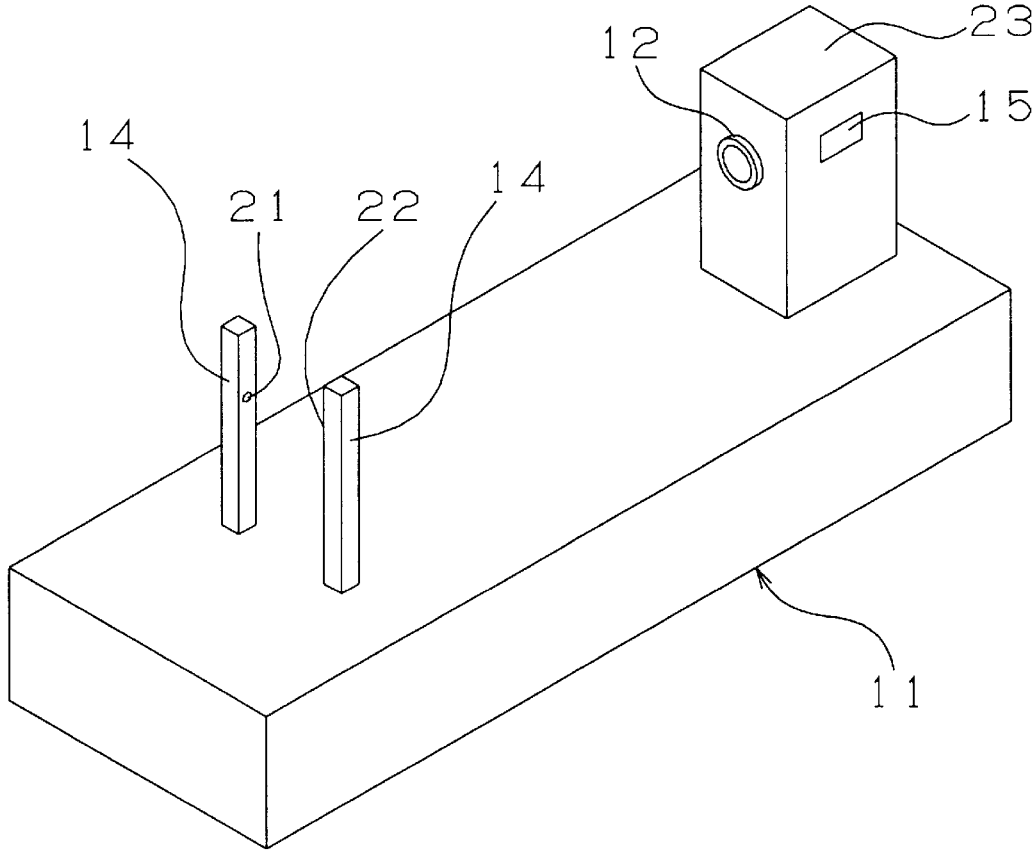
FIG. 3 is a perspective view showing a more specific constitution of the frequency measuring device used for the evaluation method of the golf club according to the present invention.
Figure 4:
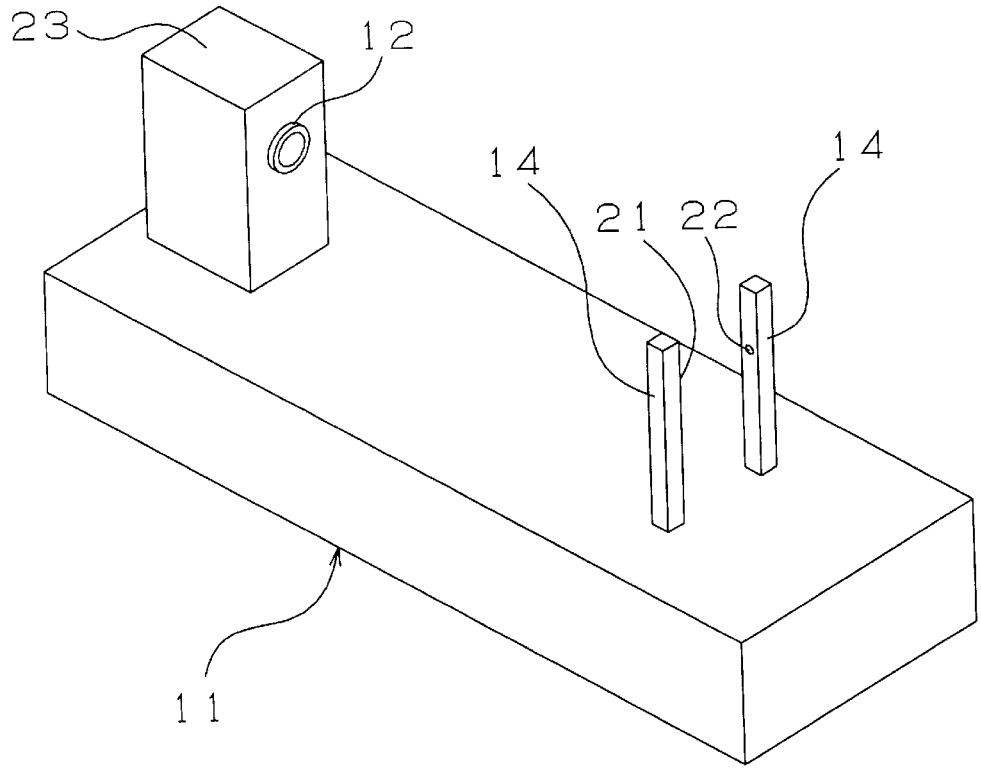
FIG. 4 is a perspective view showing the frequency measuring device of FIG. 3 from a different angle.
Figure 5:
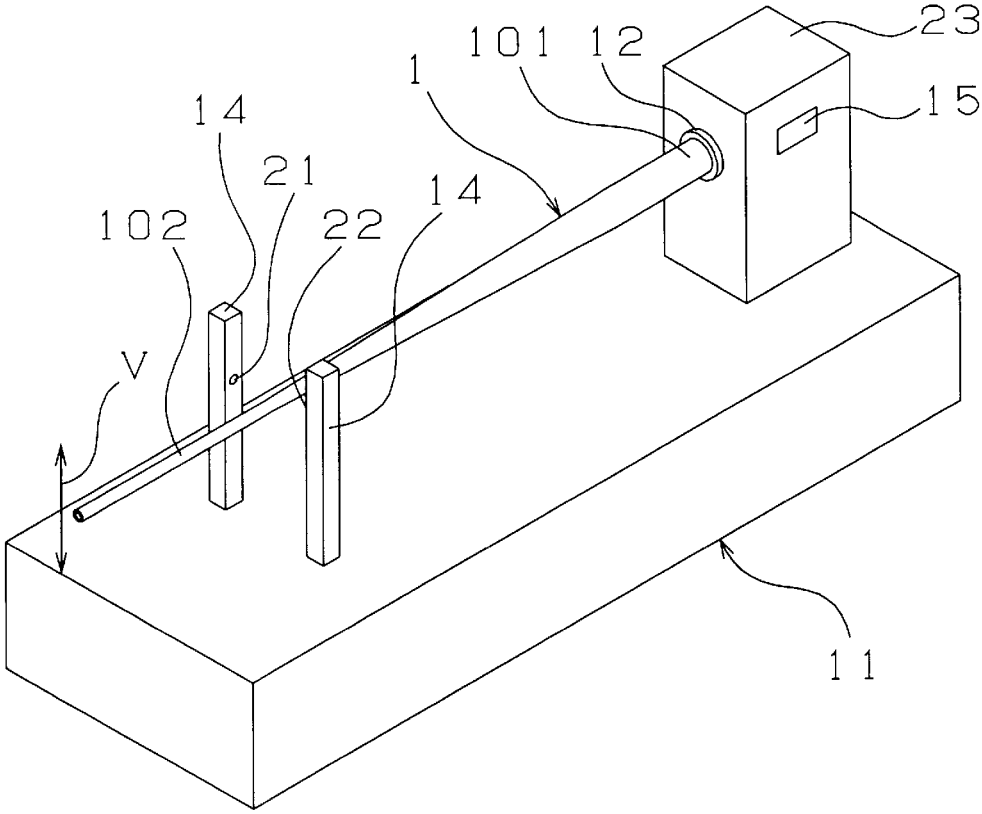
FIG. 5 is a perspective view showing a state of the rear end portion of the club shaft fastened to the frequency measuring device of FIG. 3.

The basic principle has been described. For actual measurement of a frequency, however, electric means or the like should preferably be employed. FIG. 3 shows a frequency measuring device using electric means. The frequency measuring device (11) includes a chucking unit (12), a measuring unit (14), a light source (21), a photoelectric cell (22), an arithmetic unit (23) and a display unit (15). The photoelectric cell (22) is not visible in FIG. 3, while the photoelectric cell (22) is visible in FIG. 4 when it is seen from an opposite direction. As shown in FIG. 5, the measuring method includes the steps of: fastening the rear end portion (101) of the club shaft (1) to the chucking unit (12) of the frequency measuring device (11); displacing the tip portion (102) in a vertical direction by picking it with a hand; vibrating the tip portion (102) by releasing the hand; measuring the number of times of blocking an infrared ray sensor between the light source (21) and the photoelectric cell (22) of the measuring unit (14) by the club shaft (1); converting a measured result into the frequency per minute (cpm) of the club shaft; and the displaying the frequency on the display unit (15).

Figure 6A:
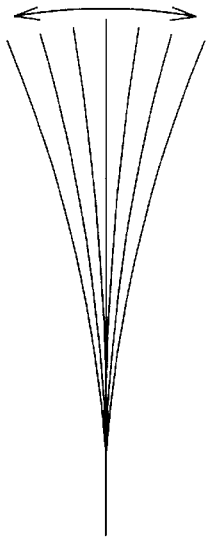
FIGS. 6 (*a*) to 6 (*c*) are schematic views, each thereof showing a vibration shape of a club shaft.
Figure 6B:
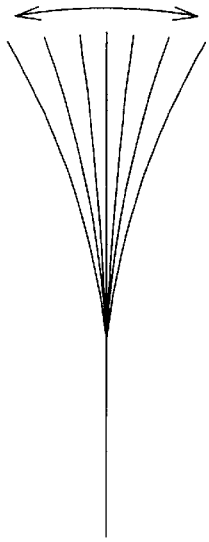
Figure 6C:
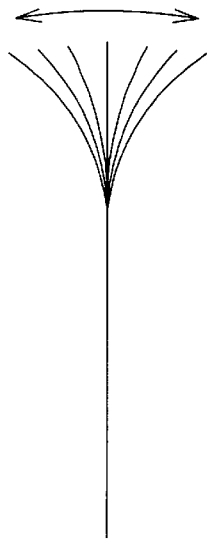

Each of FIGS. 6 (*a*) to 6 (*c*) schematically shows a difference in vibration types caused by a difference in stiffness distribution of the club shaft. As described above, the stiffness distribution varies depending on the kind of a club shaft. FIGS. 6 (*a*) to 6 (*c*) show three main conceivable vibration types. Each of these vibration types occurs with one end bound. FIG. 6 (*a*) shows the example of low stiffness in the bound end portion; FIG. 6 (*b*) the example of no uneven stiffness; and FIG. 6 (*c*) the example of low stiffness in the portion opposite to the bound end. In any of FIGS. 6 (*a*) to 6 (*c*), the occurrence of vibration is shown with a lower end fastened. Needless to say, in the measuring state shown in FIG. 5, the vibration of an arrow direction shown in each of FIGS. 6 (*a*) to 6 (*c*) is made in a vertical direction. As described above, since a numerical value of a frequency tends to be relatively smaller when the stiffness of the bound end portion is lower, in the vibration type of FIG. 6 (*a*), a numerical value of a frequency is measured to be smaller compared with that in the vibration type of FIG. 6 (*b*); and in the vibration type of FIG. 6 (*c*), a numerical value of a frequency larger compared with that in the vibration type of FIG. 6 (*b*).

Figure 9:
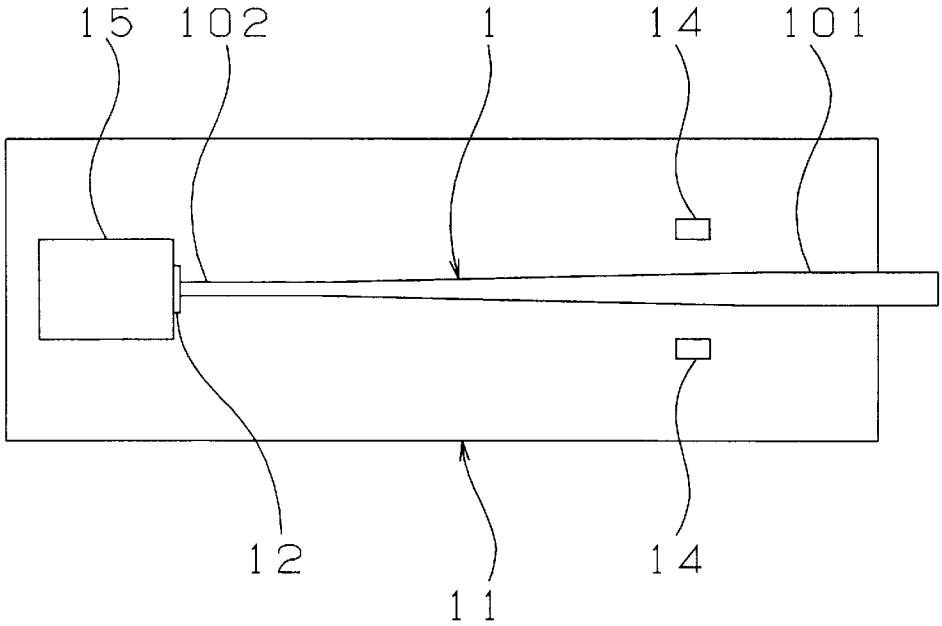
FIG. 9 is a plan view showing a state of a tip portion of the club shaft fastened to the frequency measuring device used for the evaluation method of the golf club according to the present invention.

Now, the evaluation method of a golf club according to a first aspect of the present invention will be described. As shown in FIG. 9, the tip portion (102) of the club shaft (1) is fastened to the chucking unit (12) of the frequency measuring device (11), and the rear end portion (101) is picked by a hand to be displaced in a vertical direction. Then, the rear end portion (101) is vibrated by releasing the hand, and a frequency per minute (f(cpm)) of the club shaft (1) measured by the measuring unit (14) is read from the display unit (15).

As described above with reference to FIGS. 6 (*a*) to 6 (*c*), the frequency of the club shaft varies depending on stiffness distribution. It can otherwise be said that even when the numerical values of frequencies measured with the rear end portion fastened are equal to each other, if there is a difference in stiffness distribution, then the club shafts are ones having different physical properties.

According to the evaluation method of the golf club of the first aspect of the present invention, it is possible to evaluate the physical properties of club shafts equal or substantially equal in the numerical values of frequencies measured with the rear end portion fastened. It is particularly possible to use the evaluation method for a group of club shafts manufactured based on the same product target value of a frequency (frequency measured by fastening the rear end portion in the conventional manner) in determining as to whether the club shafts have identical physical properties or not at a higher level.

In addition, in the typical conventional art, harmony is established for the frequencies (frequencies measured with the rear end portions fastened in the conventional manner) of golf clubs in a golf club set such that a fixed relationship, e.g., a direct relationship, can be set between a club length and a frequency plot. However, it is also possible to establish harmony for frequencies measured with the tip portions fastened such that a fixed relationship, e.g., a direct relationship, can be set between a club length and a frequency plot. For example, among a group of club shafts set in a fixed relationship for the frequencies measured with the rear end portions fastened, a group of club shafts set in a fixed relationship may be selected for the frequencies with the tip portions fastened in order to assemble these groups of club shafts into golf clubs. Accordingly, a golf club set having higher accuracy can be provided.

The evaluation method of the golf club of the first aspect of the present invention is related to the frequency measured with the tip portion of the club shaft fastened. However, a calculated value such as the sum, the difference, the product or the ratio of the frequencies measured with the tip portion fastened and the frequency measured with the rear end portion fastened can also be a preferable index for understanding the characteristic of the club shaft, and it is included within the present invention. In addition, regarding the frequency measured with the tip portion fastened and the frequency measured with the rear end portion fastened, for example, calculation is performed based on 0.6fa and 0.4fb where fa indicates the frequency measured with the tip portion fastened, and fb indicates the frequency measured with the rear end portion fastened. Calculation is performed like this to set fixed contribution rates for respective numerical values, and a calculated value such as the sum, the difference, the product or the ratio can also be a preferable index for understanding the characteristic of the club shaft. Such a calculated value is also included within the present invention.

Figure 8:
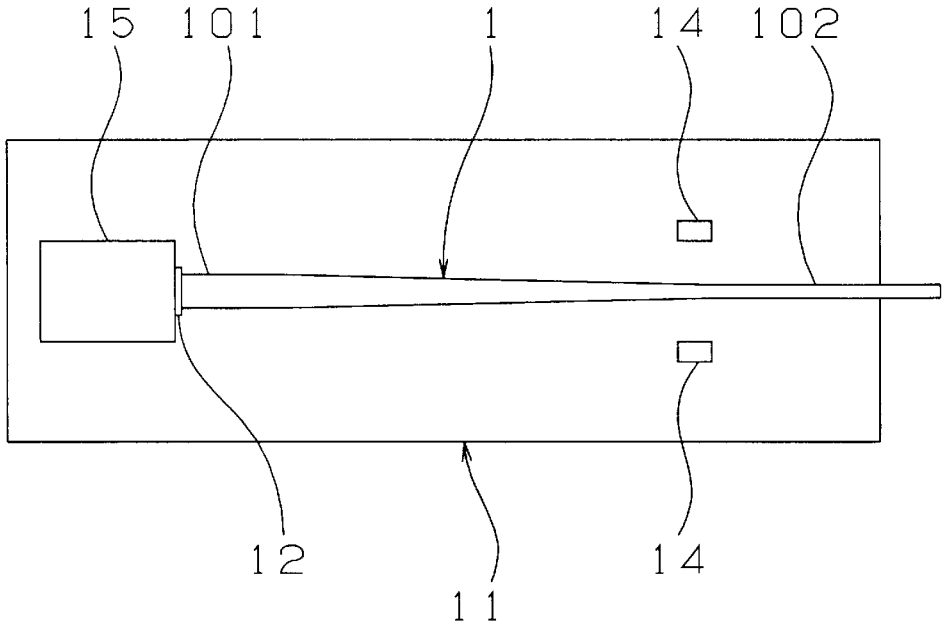
FIG. 8 is a plan view showing a state of the rear end portion of the club shaft fastened to the frequency measuring device used for the evaluation method of the golf club according to the present invention.

Now, the evaluation method of a golf club according to a second aspect of the present invention will be described. First, as shown in FIG. 8, the rear end portion (101) of the club shaft (1) is fastened to the chucking unit (12) of the frequency measuring device (11), and the tip portion (102) is displaced in a vertical direction by picking it with a hand. Then, the tip portion is vibrated by releasing the hand, and the frequency per minute (f1(cpm)) of the club shaft measured by the measuring unit (14) is read from the display unit (15). Then, as shown in FIG. 9, the tip portion (102) of the club shaft (1) is fastened to the chucking unit (12) of the frequency measuring device (11), and the rear end portion (101) is displaced in a vertical direction by picking with a hand. Then, the rear end portion is vibrated by releasing the hand, and the frequency per minute (f2(cpm)) of the club shaft measured by the measuring unit (14) is read from the display unit (15). Then, the sum (f1+f2(cpm)) of the both frequencies is obtained. By obtaining the sum of both these frequencies, a change in the numerical value of a frequency caused by a difference in stiffness distribution is canceled, and flexibility of the club shaft is obtained.

To explain briefly with reference to the drawings, the club shaft showing a vibration type like that shown in FIG. 6 (*a*) when vibrated with the rear end portion fastened shows a vibration type like that shown in FIG. 6 (*c*) when vibrated with the tip portion fastened. The club shaft showing a vibration type like that shown in FIG. 6 (*c*) when vibrated with the rear end portion fastened shows a vibration type like that shown in FIG. 6 (*a*) when vibrated with the tip portion fastened.

Now, description will be made by way of example. It is assumed that there are three kinds of club shafts X, Y and Z, different in stiffness distributions but equal in lengths, masses and shapes. When these club shafts are vibrated with the rear end portions fastened, the following is assumed. That is, The club shaft X shows a vibration type like that shown in FIG. 6 (*a*); the club shaft Y a vibration type like that shown in FIG. 6 (*b*); and the club shaft Z a vibration type like that shown in FIG. 6 (*c*), and these three kinds of club shafts are equal in flexibility. A frequency is measured by fastening each of the rear end portions of the club shafts X, Y and Z. If the numerical values of the obtained frequencies are x1, y1 and z1 for the club shafts X, Y and Z respectively, then a relation x1<y1<z1 is established. As described above, this relation is a result of a change in frequencies caused by a difference in stiffness distribution.

Then, a frequency is measured by fastening each of the tip portions of the club shafts X, Y and Z. If the numerical value of the obtained frequencies are x2, y2 and z2 for the club shafts X, Y and Z respectively, then a relation x2>y2>z2 is established. Then, a relation x1+x2=y1+y2=z1+z2 is established among the sums of the numerical values of the frequencies x1+x2, y2+y2 and z1+z2 (the relation is "=" theoretically, but it may be "≦" considering slight variance in measurement or by the measuring device).

Apparently, according to the conventional evaluation method, even for the club shafts equal in flexibility, a change occurs in the numerical value of the frequency due to a difference in stiffness distribution, making it impossible to accurately show the flexibility of the club shaft. Needless to say, the numerical value of the frequency measured for the golf club based on the conventional evaluation method is also insufficient as a yardstick for a feeling of flexibility of the golf club. If the golf club is selected based on such a numerical value of the frequency, incongruity is often felt between the size of the numerical value of the frequency and the feeling of the flexibility of the shaft of the golf club. Consequently, even if the golfer as a user purchased a golf club based on the indication of frequencies as a yardstick at a golf shop, disturbance such as an incongruous feeling of flexibility often occurred.

The foregoing phenomenon was more often seen in the fiber reinforced rein club shaft than in the metallic club shaft. In the case of the fiber reinforced resin club shaft, the kind of a reinforcing fiber and the direction of orientation were freely selected, and the degree of designing freedom such as a change in the stiffness distribution of the club shaft in a longitudinal direction or the like was larger than in the case of the metallic club shaft. Such products were commercially available, and these products were evaluated by the conventional frequency measuring method in a lump.

Recently in particular, the club shaft has been made longer with the longer golf club, and a change in the stiffness distribution of the club shaft has been made larger, making the above phenomenon more conspicuous. In other words, the conventional numerical value of the frequency has become more insufficient as a yardstick for the feeling of the flexibility of the golf club.

Now, according to the present invention, by calculating the sum of the frequency measured by fastening the rear end portion of the club shaft and the frequency measured by fastening the tip portion thereof, it is possible to cancel a change in the numerical value of a frequency caused by a difference in stiffness distribution, and to indicate flexibility actually felt by the golfer based on the size of the sum of both frequencies even when a stiffness distribution varies. Specifically, if the sum of frequencies in the group of club shafts equal in length is larger, it means a stiffer club shaft. If a plurality of golf clubs are constituted by attaching the same club heads to the club shafts of such a group, the golfer receives a stiffer feeling from a golf club provided with a club shaft having a larger sum of frequencies.

In the present invention, if comparison is made for flexibility among club shafts based on the size of the sum of frequencies, the selected club shafts or the group of the selected club shafts should preferably be equal or substantially equal in length. This is because the numerical value of a frequency tends to be smaller as the club shaft becomes longer. The substantially equal length means that the length of all the club shafts or the group of club shafts should be set within the range of 1.5% or lower of the club shaft length, preferably within the range of 1.0% or lower, more preferably within the range of 0.5% or lower, yet more preferably within the range of 0.3% or lower, and further yet preferably within the range of 0.2% or lower. However, this applies only to the case of pure comparison for flexibility among the club shafts, and the evaluation method of the present invention is not limited to the use for comparison within the range of equal or substantially equal lengths. For example, assuming that there are three kinds of club shafts A, B and C, stiffness is apparently set at A>B>C if the sum of frequencies is set at A>B>C and lengths at A>B>C. Alternatively, if the sum of frequencies is set at A=B=C and lengths at A>B>C, then stiffness is apparently set at A>B>C. In such a case, whether or not the lengths of A, B and C are within the foregoing range is not a problem. In other words, even outside the above range, by properly setting the sum of frequencies and lengths, it is possible to make comparison for flexibility by the evaluation method of the present invention.

If comparison is made for flexibility among the club shafts based on the size of the sum of frequencies in the present invention, the club shafts equal or substantially equal in masses should preferably be used. This is because as the mass of the club shaft becomes larger, the club shaft itself serves as a weight, and the numerical value of a frequency tends to be smaller. The substantially equal mass means that the mass of all the club shafts or the group of club shafts is set within the range of 20% or lower, preferably within the range of 15% or lower, more preferably within the range of 10%. However, this applies only to the case of pure comparison for flexibility among the club shafts, and the evaluation method of the present invention is not limited to the use for comparison within the range of equal or substantially equal masses. For example, assuming that there are three kinds of club shafts A, B and C, stiffness is apparently set at A>B>C if the sum of frequencies is set at A>B>C and mass at A>B>C. Alternatively, if the sum of frequencies is set at A=B=C, and mass at A>B>C, then stiffness is set at A>B>C. In such a case, if the mass of A, B and C is within the above range is not a problem. In other words, even outside the above range, by properly setting the sum of frequencies and a mass, it is possible to make comparison for flexibility by the evaluation method of the present invention.

As can be understood from the foregoing, according to the evaluation method of the present invention, the flexibility of the club shaft constituting the golf club can be mainly evaluated. The flexibility in the present invention means the easiness of bending for the club shaft. The more difficult the bending is, the stiffer the club shaft is indicated. The index such as a numerical value obtained by the evaluation method of the present invention can be properly selected by those skilled in the art to indicate the hardness, flexibility, strength, bending degree, stiffness or the like of the club shaft or the golf club, and included within the present invention. The present invention has been described on the assumption that flexibility is equal among the club shafts. This is only for convenience, and a hypothetical case has been described. To determine whether or not there is equal flexibility among the club shafts, evaluation should preferably be performed by using the evaluation method of the present invention to calculate the sum of frequencies.

Now, the evaluation method of a golf club according to a third aspect of the present invention will be described. First, as shown in FIG. 8, the rear end portion (101) of the club shaft (1) is fastened to the chucking unit (12) of the frequency measuring device (11), and the tip portion (102) is picked by a hand to be displaced in a vertical direction. Then, the tip portion (102) is vibrated by releasing the hand, and a frequency per minute (f1(cpm)) of the club shaft measured by the measuring unit (14) is read from the display unit (15). Then, as shown in FIG. 9, the tip portion (102) of the club shaft (1) is fastened to the chucking unit (12) of the frequency measuring device (ii), and the rear end portion (101) is picked by a hand to be displaced in a vertical direction. Then, the rear end portion (101) is vibrated by releasing the hand, and a frequency per minute (f2(cpm)) of the club shaft measured by the measuring unit (14) is read from the display unit (15). Then, a ratio of both frequencies (f1/f2) is obtained. By obtaining the ration of the both frequencies, it is possible to quantitatively obtain a height of a hit ball presented by the golf club.

To explain briefly with reference to the drawings, the club shaft showing a vibration type like that shown in FIG. 6 (*a*) when vibrated with the rear end portion fastened shows a vibration type like that shown in FIG. 6 (*c*) when vibrated with the tip portion fastened. The club shaft showing a vibration type like that shown in FIG. 6 (*c*) when vibrated with the rear end portion fastened shows a vibration type like that shown in FIG. 6 (*a*) when vibrated with the tip portion fastened.

Next, description will be made by way of example. It is assumed that there are three kinds of club shafts X', Y' and Z' different in the size of distribution of frequencies but equal in length, mass and shape. When these are vibrated by fastening the rear end portions, the club shaft X' shows a vibration type like that shown in FIG. 6 (*a*); the club shaft Y' a vibration type like that shown in FIG. 6 (*b*); and the club shaft Z' a vibration type like that shown in FIG. 6 (*c*), and these three kinds of club shafts are equal in flexibility. A frequency of each of the club shafts X', Y' and Z' is measured with the rear end portion fastened. If the numerical value of obtained frequencies are x'1, y'1 and z'1 for the club shafts X', Y' and Z' respectively, then a relation x'1<y'1<z'1 is established. As described above, this indicates a change in the numerical values of frequencies caused by a difference in stiffness distribution.

Then, a frequency of each of the club shafts X', Y' and Z' is measured with the tip portion fastened. If the numerical values of obtained frequencies are x'2, y'2 and z'2 for the club shafts X', Y' and Z' respectively, then a relation x'2>y'2>z' is established. A ratio of the respective numerical values of the frequencies, (x'1/x'2), (y'1/y'2) and (z'1/z'2) is set at (x'1/x'2)<(y'1/y'2)<(z'1/z'2).

Then, golf clubs Cx, Cy and Cz are respectively manufactured by attaching club heads to the tip portions of the club shafts X', Y' and Z' and grips to the rear end portions thereof. The club heads and the grips to be attached should be the same among the golf clubs Cx, Cy and Cz. When these golf clubs are swung at the same head speed, the bending of each shaft near a hitting point is like that shown in FIG. 7 (*a*) in the case of the golf club Cx; like that shown in FIG. 7 (*b*) in the case of the golf club Cy; and like that shown in FIG. 7 (*c*) in the case of the golf club Cz.

The golf club has a characteristic as follows. That is, because of no presence of the center of gravity of the club head on the axis of the shaft and the bending of the club shaft, a centrifugal force during the swinging of the golfer generates a force to extend the gravity center position of the club head to the outside of a swing locus, and a phenomenon is caused that the club shaft is bent and a loft angle is changed.

Figure 7A:
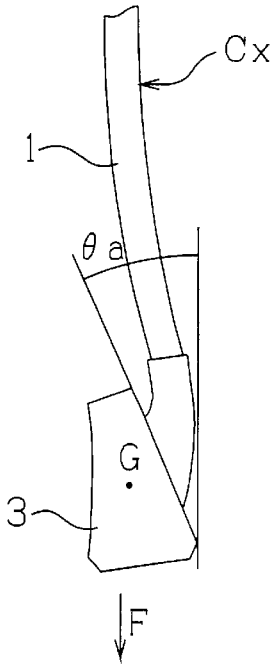
FIGS. 7 (*a*) to 7 (*c*) are schematic views, each thereof showing a change in a loft angle caused by club shaft bending.
Figure 7B:
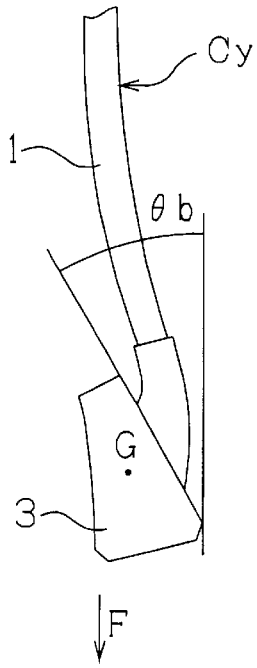
Figure 7C:
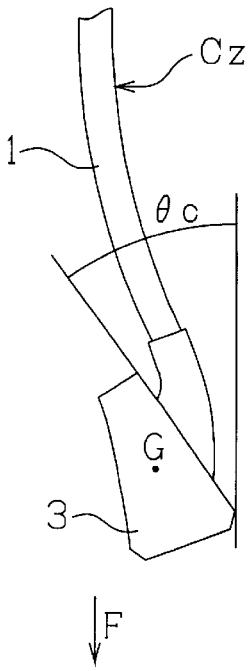

More specifically, as shown in FIGS. 7 (*a*) to 7 (*c*), a centrifugal force during swinging generates a force to move a center of gravity G to the outside of a swing locus indicated by an arrow F, causing the club shaft (1) to be bent and loft angles to be changed respectively to θa, θb and θc. θa to θc are generally called dynamic loft angles or impact loft angles, and will be referred to as dynamic loft angles, hereinafter. In the case of a normal golf club, if the flying direction of a hit ball is forward, a center of gravity G is located in the rear position. Thus, the dynamic loft angle is larger than the loft angle, i.e., the loft angle where the club shaft is not bent.

Since the same club heads are used, the golf clubs Cx, Cy and Cz are also equal in loft angles. However, the dynamic angles are respectively θa, θb and θc, thus different from one another. Further, as shown in FIGS. 7 (*a*) to 7 (*c*), it can be understood that a relation θa<θb<θc is established.

The foregoing relation is caused by a difference in characteristics among the club shafts. More specifically, if golf clubs are manufactured by using a club shaft having low stiffness (in this case, stiffness in the portion close to the rear end portion is low) in the portion close to the end portion bound like that shown in FIG. 6 (*a*) and a club shaft having low stiffness (in this case, stiffness in the portion close to the tip portion is low) in a portion close to the portion opposite to the end bound like that shown in FIG. 6 (*c*) when vibration is generated with the rear end portion fastened, and then attaching grips to the rear end portions and club heads to the tip portions, it can be understood that a change in a dynamic loft angle is larger in the club shaft like that shown in FIG. 6 (*c*) than that in the club shaft like that shown in FIG. 6 (*a*).

The dynamic loft angle is decided by the bending angle of a club shaft in the vicinity of a portion connecting the club shaft to the club head. If the club shafts are swung at the same head speed, then in the club shaft having low stiffness in the portion close to the rear end portion like that shown in FIG. 7 (*a*), the bending angle of the club shaft in the vicinity of the portion connecting the club shaft to the club head is smaller compared with that in the club shaft having low stiffness in the portion close to the tip portion like that shown in FIG. 7 (*c*).

To explain more from a feeling standpoint, the club shaft having low stiffness in portion close to the rear portion has a mode so as to bend gently as a whole, and the bending angle of the tip is not so large even when an entire bending width is large. On the other hand, the club shaft having low stiffness in the portion close to the tip portion has a mode so as to bend steeply at its tip only, and the bending angle of the tip is large even when an entire bending width is small. For contributions to the dynamic loft angle, because of the bending angle of the tip portion, the club shaft having low stiffness in the portion close to the tip portion has a factor that the dynamic loft angle becomes larger as a golf club.

To show the foregoing in a quantitative manner, a ratio of the frequencies obtained by fastening the rear end part and the frequency obtained by fastening the tip portion can be used. An example of a ratio may be (f1/f2), f1 indicating a frequency obtained by fastening the rear end portion, and f2 indicating a frequency obtained by fastening the tip portion. As the value of the ratio (f1/f2) is larger, a change in the dynamic loft angle becomes greater. In the example of the club shafts X', Y' and Z', a relation (x'1/x'2)<(y'1/y'2)<(z'1/z'2) is established, and such change in the dynamic loft angle is understood.

In addition to the ratio (f1/f2), the present invention includes, as ratios of frequencies, (f1/(f1+f2)), (f2/(f1+f2)), reciprocals thereof (f2/f1), ((f1+f2/f1), ((f1+f2)/f2), and so on. In these cases, in the example where a change in the a dynamic loft angle is greater as the value of the ratio (f1/f2) is larger, as the value of the ratio (f1/(f1+f2)) is larger, a change in a dynamic loft angle is greater, and as the value of the ratio (f2/(f1+f2)) is smaller, a change in a dynamic loft angle is greater. In the reciprocals thereof, the correlations are apparently reversed.

Thus, the factors contributing to the increase in the dynamic loft angle of the club shaft can be represented quantitatively for the first time based on the ratio of frequencies obtained by the evaluation method of the present invention. The factors for the increase in the dynamic loft angle, according to the present invention, shows the degree of easy flying of a hit ball by the club shaft, and the height of the hit ball presented by the golf club as a result of the degree. If identical club heads are attached, it is indicated that as the flying of a hit ball is easier, the factor for the increase in the dynamic loft angle is larger. The index such as a numerical value obtained by the evaluation method can be properly selected by those skilled in the art to name the kick point, the bend point or the like of the club shaft or the golf club, and included within the present invention.

Figure 10:
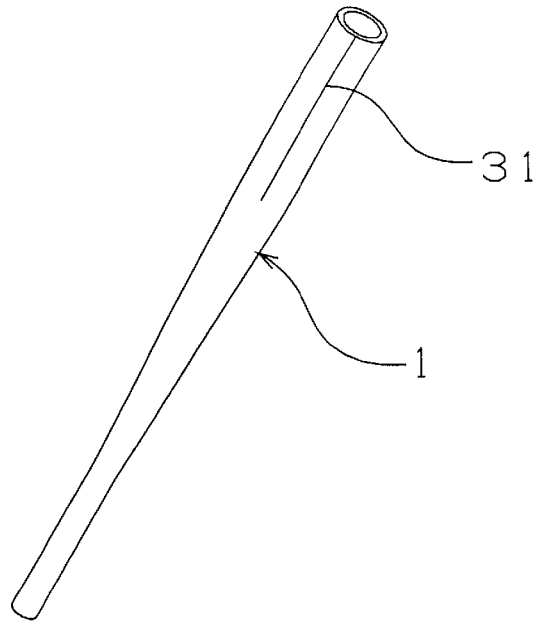
FIG. 10 is a perspective view showing a club shaft having a reference line added thereto.

In the frequency measurement of the present invention, the peripheral direction of the club shaft fastened to the frequency measuring device should preferably be maintained constant or substantially constant between the case of fastening the rear end portion and the case of fastening the tip portion. To keep such a position constant, as shown in FIG. 10, a line (31) is provided in the club shaft (1), and it may be more understandable if this line (31) is set in the same direction or substantially in the same direction with respect to the frequency measuring device (11) between the case of fastening the rear end portion (101) like that shown in FIG. 11 and the case of fastening the tip portion (102) like that shown in FIG. 12. The substantially constant position means that with respect to the line (31) shown in each of FIGS. 11 and 12 in a face-up state, shifting in a peripheral direction should be set within 20°, preferably within 10°, and more preferably within 5°. For the club shaft, because of variance among products themselves, slight variance may occur in the numerical values of frequencies depending on a peripheral direction. Thus, measurement should be carried out preferably in a constant or substantially constant peripheral direction.

Figure 11:
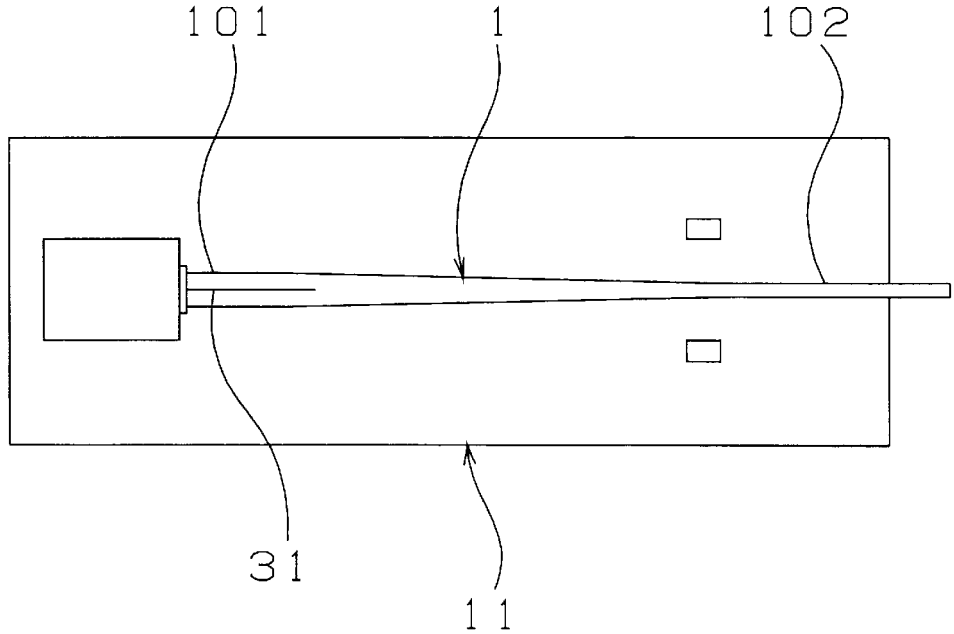
FIG. 11 is a plan view showing a state of the rear end portion of the club shaft of FIG. 10 fastened to the frequency measuring device.
Figure 12:
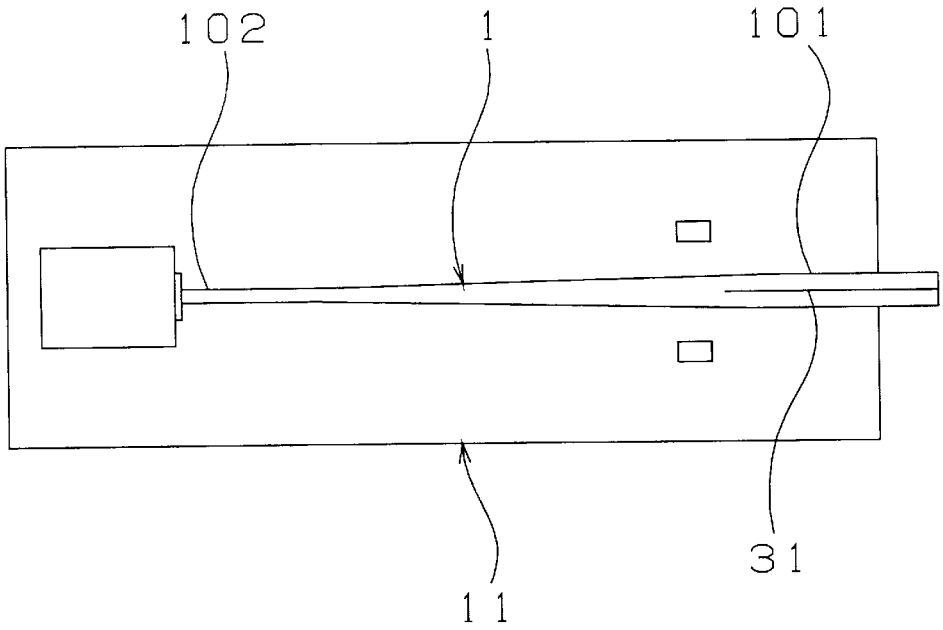
FIG. 12 is a plan view showing a state of the tip portion of the club shaft of FIG. 10 fastened to the frequency measuring device.
Figure 13:
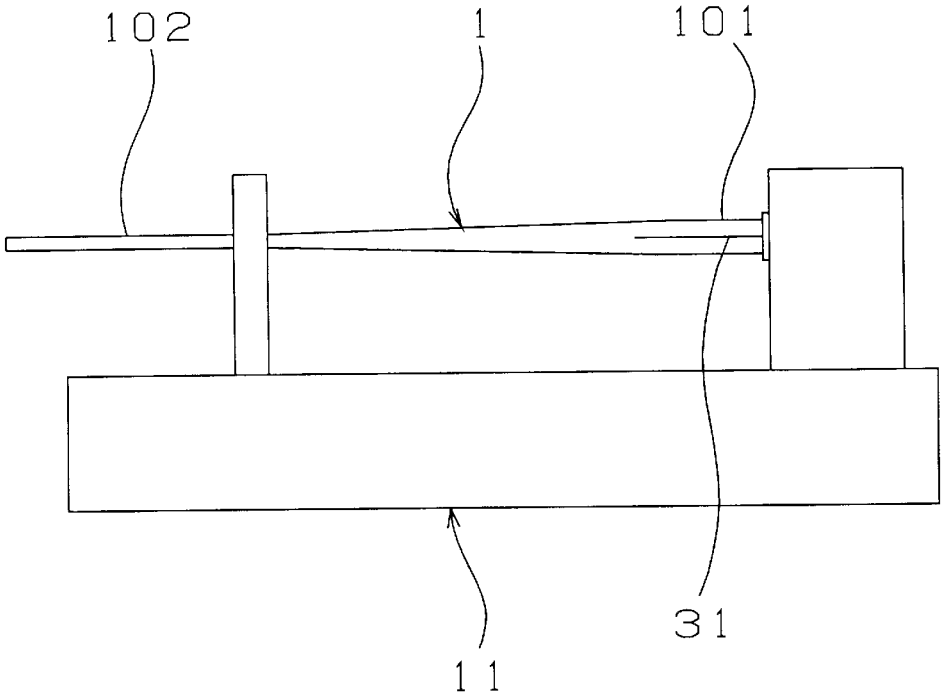
FIG. 13 is a side view showing the state of the rear end portion of the club shaft of FIG. 10 fastened to the frequency measuring device.
Figure 14:
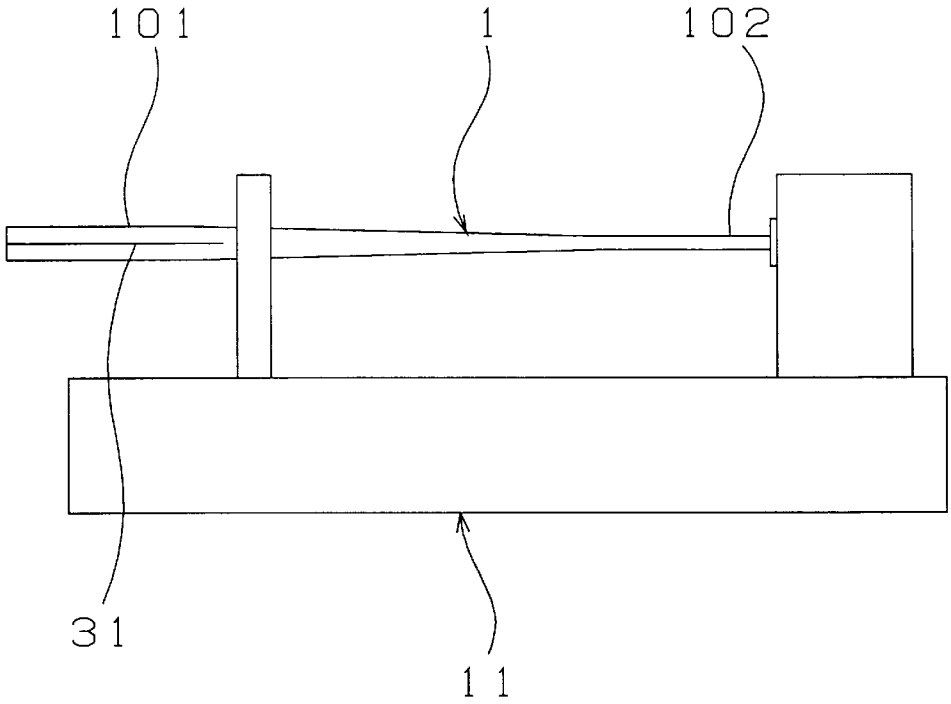
FIG. 14 is a side view showing the state of the tip portion of the club shaft of FIG. 10 fastened to the frequency measuring device.
Figure 15:
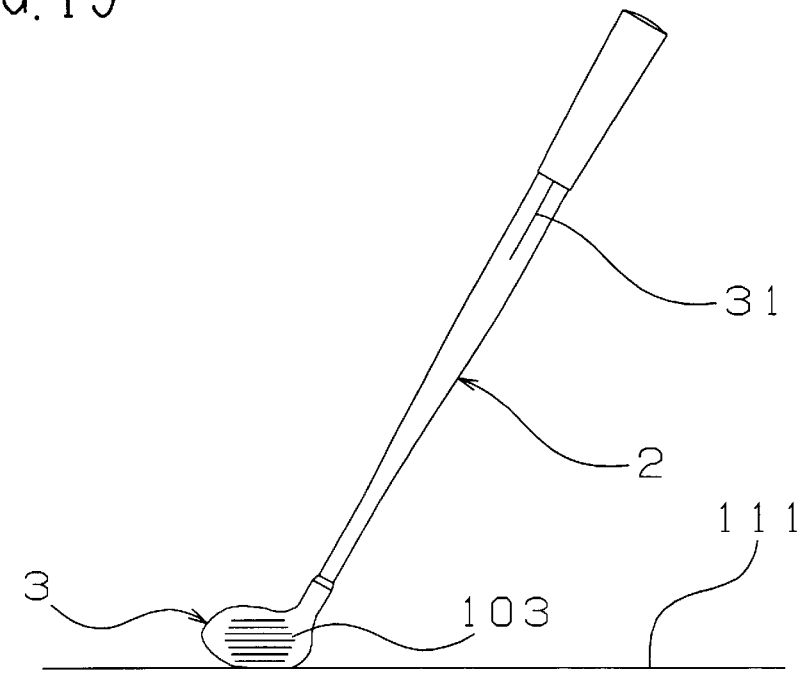
FIG. 15 is a front view showing a golf club using the club shaft of FIG. 10.

As described above, because of the possibility of slight variance in the numerical values of frequencies in the peripheral direction of the club shaft itself, changes may occur in the sum and the ratio of frequencies between the case of measuring identical club shafts in manners like those shown in FIGS. 11 and 12, and the case of measuring the club shafts by rotating these by 90° in peripheral directions and fastening them with respect to the club shafts of FIGS. 11 and 12 like those in FIGS. 13 and 14. Thus, when a golf club is assembled, the fastening position of the club shaft should preferably be maintained constant. Specifically, the club shaft of FIG. 10 measured by the measuring method shown in each of FIGS. 11 and 12 should be positioned as follows. That is, as shown in FIG. 15, in a golf club (2), the club shaft is fastened in a position for causing the line (31) to face front or substantially face front, in a front view where the face portion (103) of the club head (3) is placed front, and on a horizontal surface (111) according to a lie angle. To reflect the measured value of the club shaft on the golf club, a most preferable way is to establish coincidence between the directions of vibrating the club shaft (1) measured by the frequency measuring device (11) shown in FIG. 16 and the main bending direction of the golf club (2) shown in FIG. 17 during actual swinging. For this purpose, it is understood that the club shaft (1) measured by the fastening methods shown in FIGS. 11 and 12 should be fastened in the position shown in FIG. 15 and constructed as the golf club (2). The position substantially facing front means that with the line (31) shown in FIG. 15 placed to face right front, shifting in the peripheral direction should be within 15°, preferably within 10°, more preferably within 5°, and yet more preferably within 3°.

Figure 18:
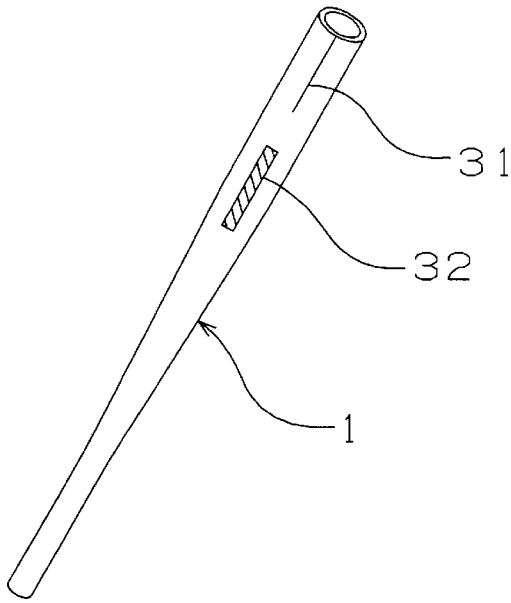
FIG. 18 is a perspective view showing a club shaft having a reference line and a logo mark added thereto in coaxial relation to each other.
Figure 19:
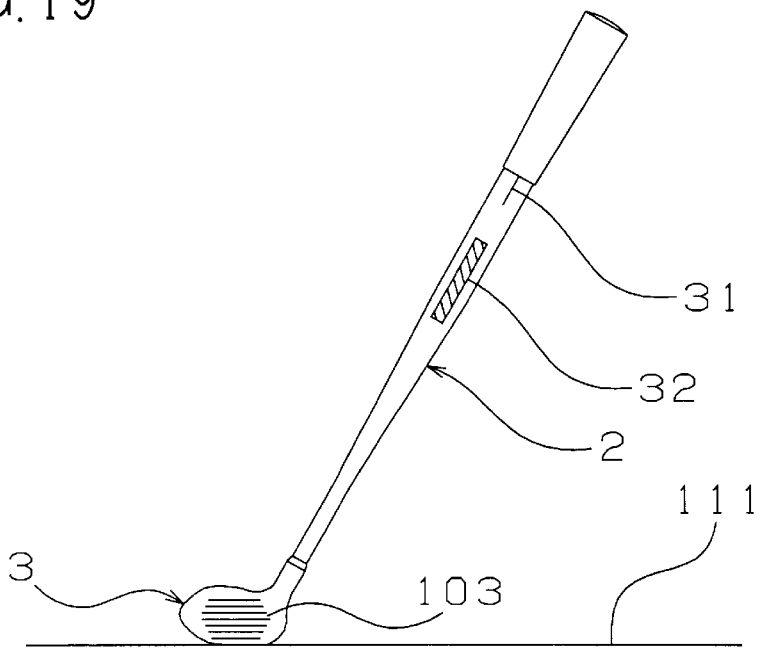
FIG. 19 is a front view showing a golf club using the club shaft of FIG. 18.
Figure 20:
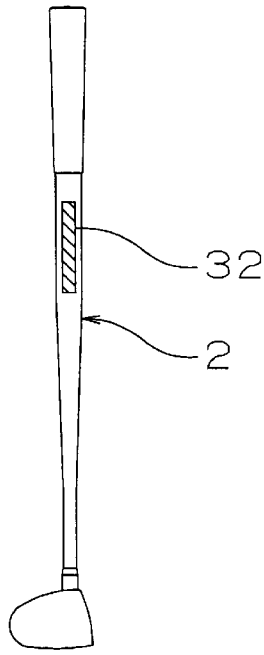
FIG. 20 is a side view showing a golf club using a club shaft of FIG. 21 from a toe side.
Figure 21:
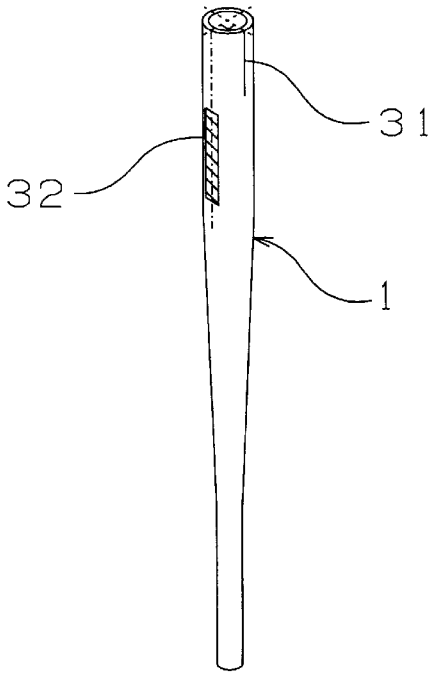
FIG. 21 is a perspective view showing the club shaft having a reference line and a logo mark added on different peripheral positions.

In addition, in the single club shaft, as shown in FIG. 18, a logo mark (32) is provided in the club shaft (1) by means such as printing or the like in coaxial relation to the line (31). Then, as shown in FIG. 19, preferably, in a front view where the face portion (3) of the golf club (2) is placed front, and on a horizontal surface according to a lie angle, the club shaft should be fastened in a position such that the line (31) and the logo mark (32) can face front or substantially face front. Also, as shown in FIG. 20, if the logo mark (32) is required to provide in a front with respect to the direction-of seeing the golf club (2) from its toe side, as shown in FIG. 21, at the stage of the club shaft, a positional relation should be set, where the line (31) and the logo mark (32) are away 90° from each other in a peripheral direction.

Figure 16:
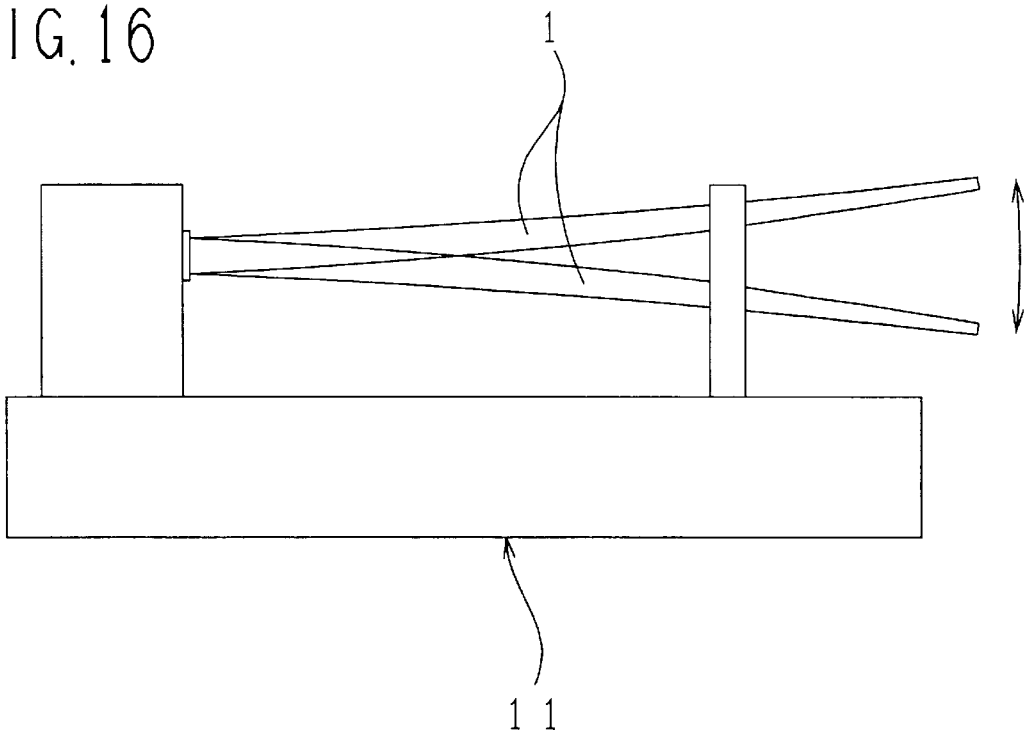
FIG. 16 is a side view showing a shaft vibration direction in the frequency measuring device.
Figure 17:
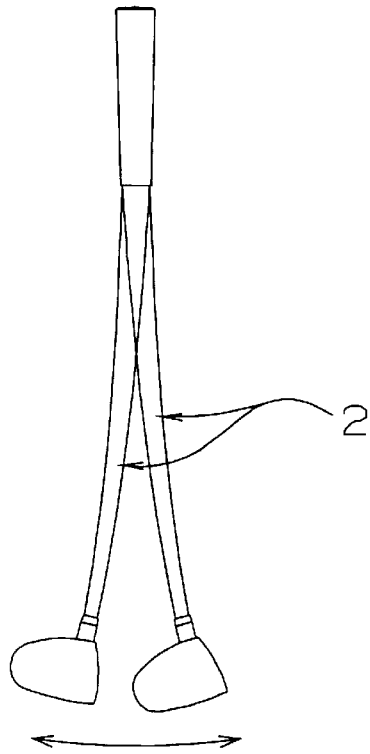
FIG. 17 is a side view showing a main direction of shaft bending during swinging of the golf club.
Figure 22:
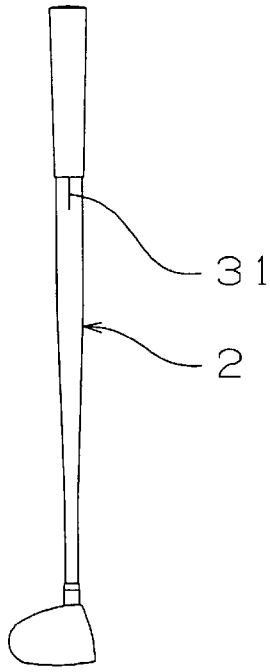
FIG. 22 is a side view showing another golf club using the club shaft of FIG. 10 from a toe side.
Figure 23:
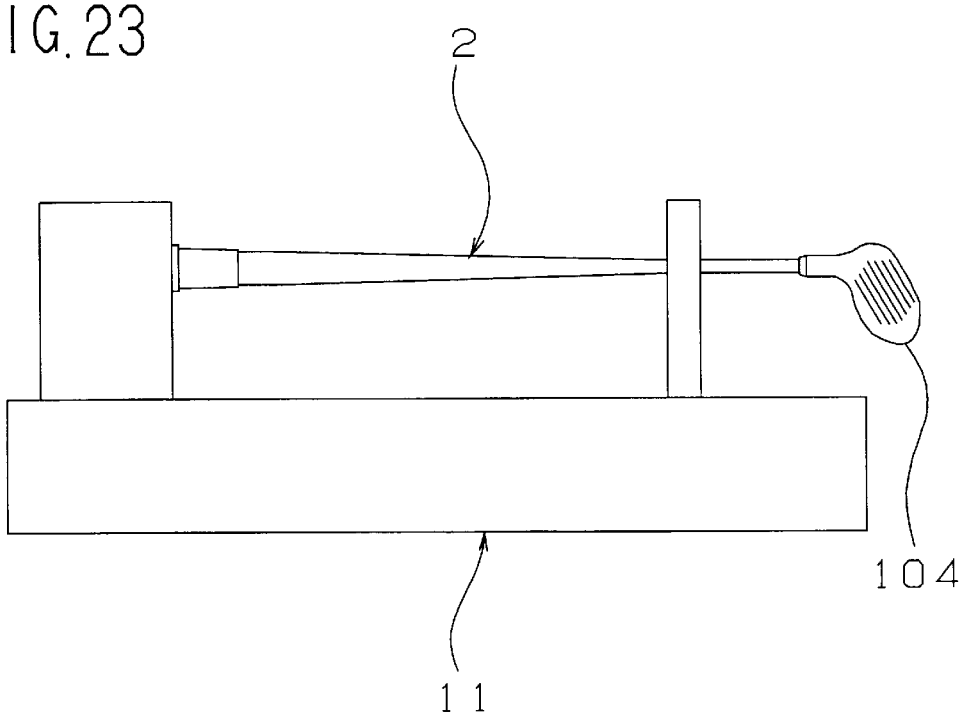
FIG. 23 is a side view showing a state of a rear end portion of a golf club fastened to a frequency measuring device used for a conventional evaluation method of a golf club.

In the foregoing, it has been described that the vibration direction of the club shaft in the frequency measurement in FIG. 16 and the main bending direction of the golf club during an actual swing in FIG. 17 coincide most preferably with each other. For example, it is thought that the club shaft shown in FIG. 10 that is measured in the fastening methods as shown in FIG. 11 and FIG. 12 is assembled as a golf club as shown in FIG. 22. In other words, the vibration direction of the club shaft and the bending direction of the golf club during the actual swing are away 90 degrees from each other. Although it is surely most preferably that the vibration direction of the club shaft and the bending direction of the golf club during the actual swing coincide with each other, setting a certain relation between the vibration direction of the club shaft and the bending direction of the golf club is more preferable than not setting the certain relation. Actually, in the conventional frequency measurement, as shown in FIG. 23, there are many cases that measurement is performed by fastening the golf club (2) with the toe portion (104) thereof facing downward. In this regard, the case of FIG. 23 is an example that the vibration direction of the club shaft and the bending direction of the golf club during the actual swing are away by 90 degrees from each other.

It is needless to say that the line (31), which is used in setting the direction of the frequency measurement as described above, may be hidden by the grip in the golf club of a completed state. It is satisfactory that the line (31) becomes a marking in the frequency measurement, and it can be appropriately selected whether the line (31) is shown or hidden according to a golf club design in a state of the golf club.

In the present invention, a preferable range of a fastening length of the end portion in the frequency measurement is 200 mm or less, more preferable 150 mm or less. The frequency measurement can be performed more accurately by setting the fastening length within the above-described range. Moreover, the shortest limit of the fastening length is not specifically limited as long as the club shaft can be fastened.

The fastening lengths may not necessarily be the same length when the rear end portion is fastened or the tip portion is fastened. But for a group of the club shafts to be measured, the fastening lengths of the rear end portion and the tip portion are preferably set at the same length or approximately the same length. For example, once the fastening length of the rear end portion is set at 178 mm and the fastening length of the tip portion is set at 127 mm, it is preferable that, for all the club shafts group to be measured, the 178 mm is fastened in the case where the rear end portion is fastened on the frequency measuring device and 127 mm is fastened in the case where the tip portion is fastened on the frequency measuring device. With regard to numerical value for the sum and the ratio of the frequency, not only an absolute value but also a relative value has effectivity, thus it is preferable that the fastening length of each end portion is unified in the case where the flexibility of the club shafts group is compared and so on. The approximate same length means that dispersion of the fastening length of the club shafts is within 2 mm, preferably within 1 mm.

Figure 24A:
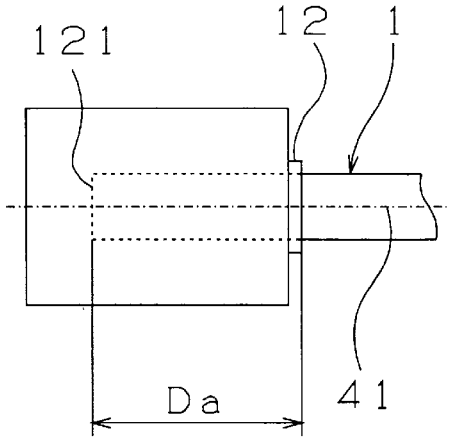
FIGS. 24 (*a*) and 24 (*b*) are plan views, each thereof showing a portion of a club shaft fastened to the frequency measuring device.
Figure 24B:
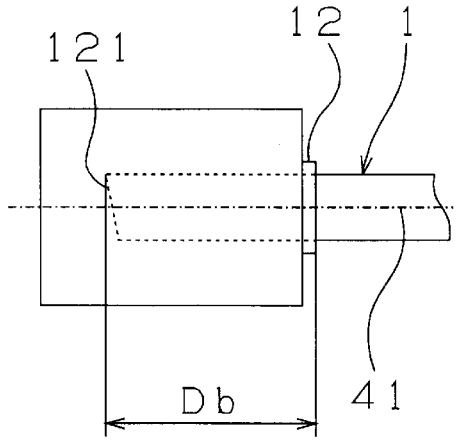

The fastening length in the present invention means a distance (Da) from the end surface (121) to the chucking unit (12) if the end surface (121) of the club shaft (1) is perpendicular to the club shaft axis (41), as shown in FIG. 24 (*a*). In addition, the fastening length means a distance (Db) from the most overhung position of the end surface (121) to the chucking unit (12) if the end surface (121) of the club shaft (1) is not perpendicular to the club shaft axis (41), as shown in FIG. 24 (*b*). A fastening means is not specifically limited as long as the shaft is firmly fastened such as fastening by holding from above and below and fastening by a drill chuck.

Figure 25:
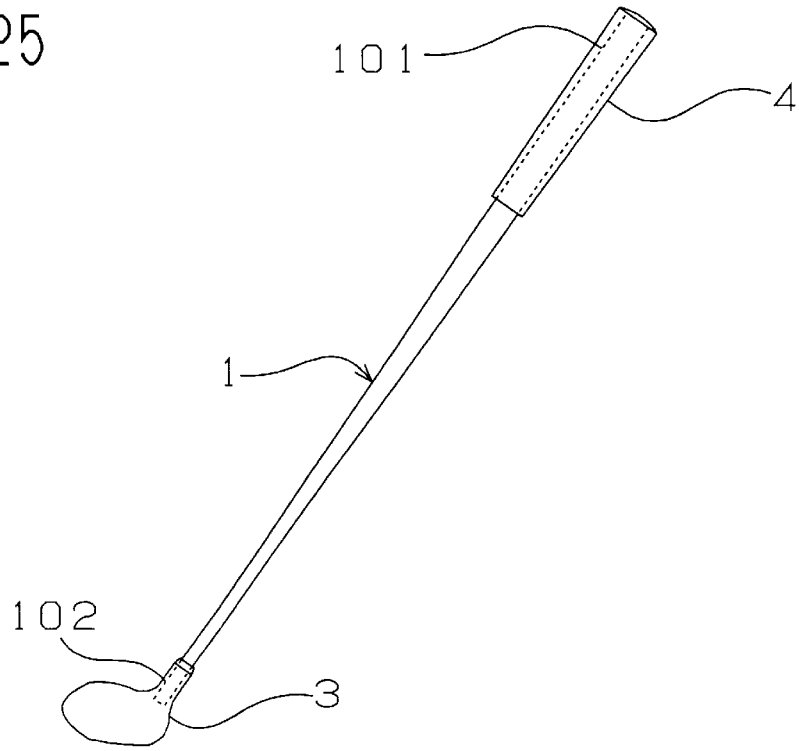
FIG. 25 is a front view showing a golf club having a grip attached to a rear end portion of a club shaft according to the present invention.
Figure 26:
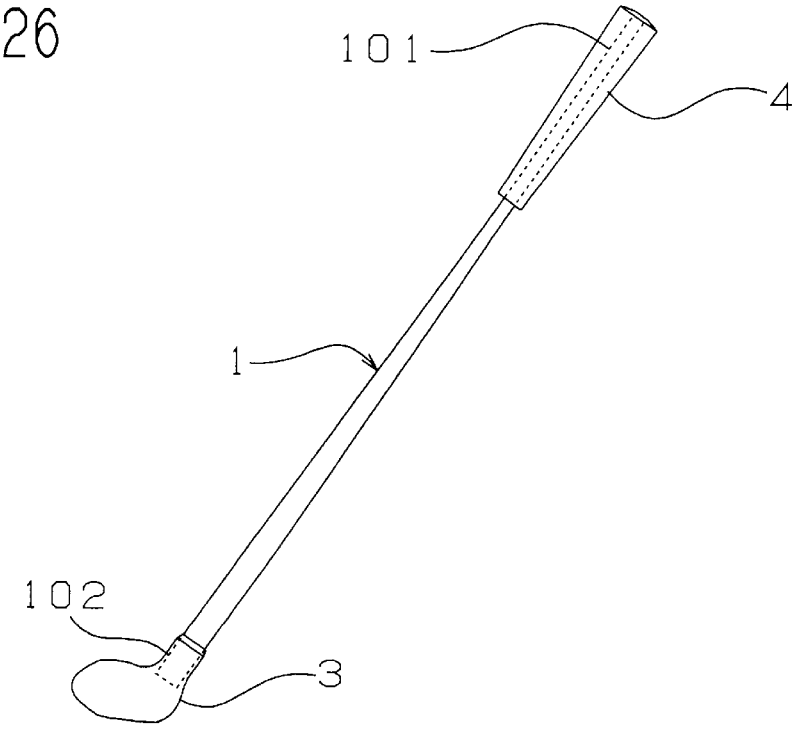
FIG. 26 is a front view showing an example of a golf club, where a tip portion of a club shaft is thicker than the rear end portion, according to the present invention.

The tip portion of the club shaft in the present invention means an end portion where the club head is attached, and the rear end portion means an end portion where a grip or a grip portion is provided. In the golf club shown in FIG. 25, the end portion where a grip (4) is attached is made to be the rear end portion (101), and the end portion where a club head (3) is attached is made to be the tip portion (102). In a general club shaft (1), the rear end portion (101) attached with the grip (4) has a larger diameter than the tip portion (102) attached with the club head (3). But, as in the golf club shown in FIG. 26, the golf club with a diameter that is larger at the tip portion (102) attached with the club head (3) than at the rear end portion (101) attached with the grip (4) can be thought.

Figure 27:
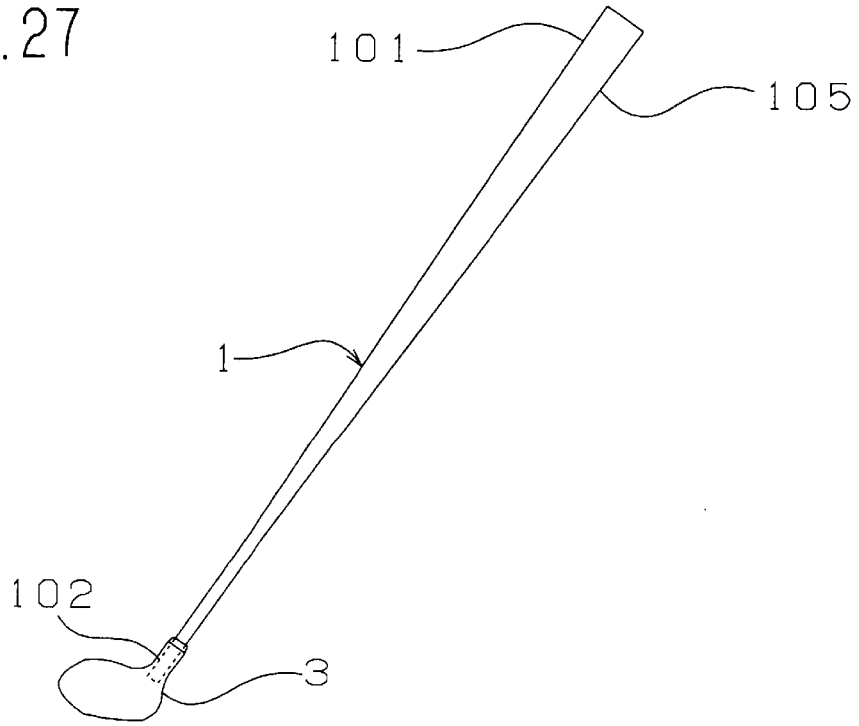
FIG. 27 is a front view showing a golf club, where a portion of a club shaft constitutes a grip portion, according to the present invention.

Moreover, as shown in FIG. 27, there are golf clubs with a portion of the club shaft (1) is made to be a grip portion (105). In this case, an end portion that becomes the grip portion (105) is made to be the rear end portion (101), and an end portion where the club head (3) is attached is made to be (102).

Figure 28:
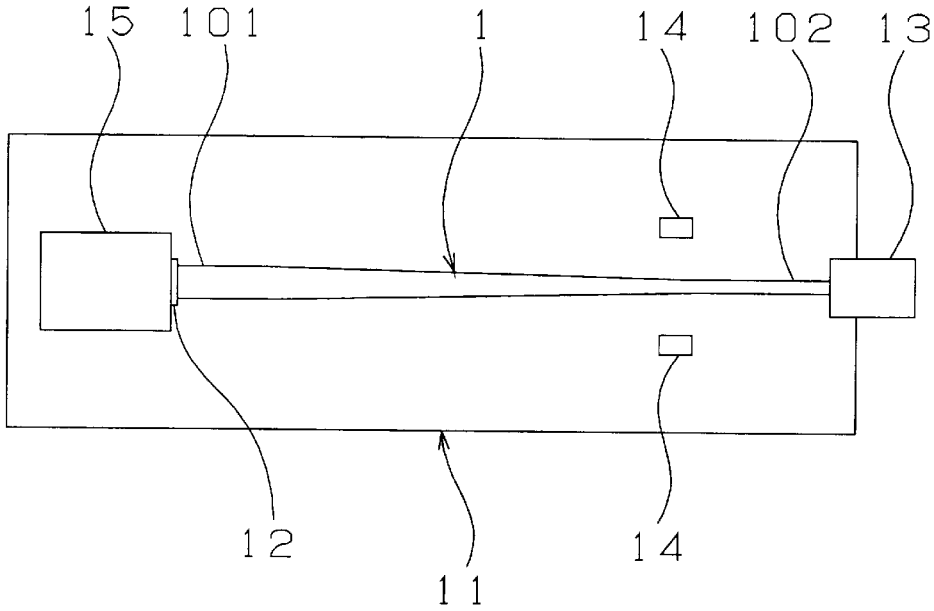
FIG. 28 is a plan view showing a state of the rear portion of the club shaft fastened to the frequency measuring device used for the evaluation method of a golf club according to the present invention.
Figure 29:
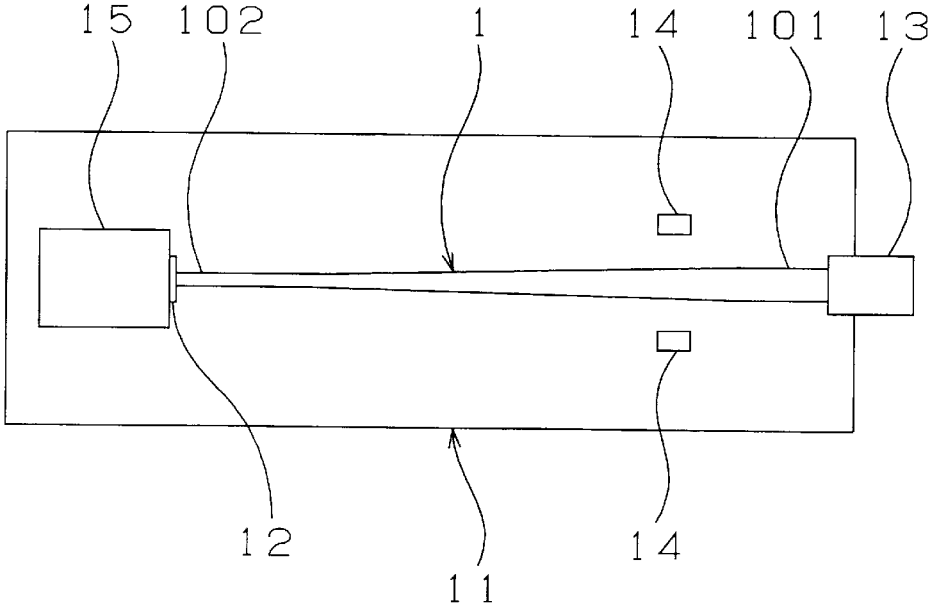
FIG. 29 is a plan view showing a state of the tip portion of the club shaft fastened to the frequency measuring device used for the evaluation method of the golf club according to the present invention.

Description will be made for an applied example of the evaluation method of the golf club according to the present invention. In the above-described second evaluation method of the golf club according to the present invention, a weight can be used as follows. Firstly, as shown in FIG. 28, the rear end portion (101) of the club shaft (1) is fastened on the chucking unit (12) of the frequency measuring device (11), and a weight (13) is attached and fastened to the unfastened tip portion (102). Sequentially, after the tip portion (102) or the weight (13) is picked by a hand to displace in the vertical direction, the hand releases it to cause vibration, and then the frequency (f1 (cpm)) per one minute of the club shaft, which is measured by a measurement section (14), is read through a display portion (15). Next, as shown in FIG. 29, the tip portion (102) of the club shaft (1) is fastened on the chucking unit (12) of the frequency measuring device (11), and the weight (13) is attached and fastened to the unfastened rear end portion (101). Sequentially, after the rear end portion (101) or the weight (13) is picked by a hand to displace in the vertical direction, the hand releases it to cause vibration, and then the frequency (f2 (cpm)) per one minute of the club shaft, which is measured by the measurement section (14), is read through the display portion (15). And then, the sum (f1+f2 (cpm)) of the both frequencies is calculated.

In the above-described evaluation method, the weight is attached to the other end of the fastened end portion in the frequency measurement. When the weight is attached, numerical value of the frequency becomes smaller than the one when the weight is not attached. However, since the numerical value becomes smaller in a certain correlation, it is useful as a relative value. The meaning to the relative value of the sum of the frequencies that is obtained by this evaluation method and an application field of the value is similar to that of the above-described second evaluation method. In addition, with regard to the third evaluation method of the golf club according to the present invention, the weight can be used similarly to the above-described evaluation method.

A preferable range of the mass of the weight in the present invention is 350 g or less, more preferably 300 g or less, and further more preferably 250 g or less. By setting the mass of the weight within the foregoing range, it is possible that the numerical value of the frequency is kept more appropriate. The lowest limit of the mass of the weight is not specifically limited. Needless to say, it is possible that the mass of the weight is made to be 0 g. It is also preferable that the mass of the weight is constant in the group of club shafts to be measured or the same weight is used.

As described above, in the present invention, although whether the weight is used or not can be appropriately selected, as one of selection criteria for deciding whether the weight is used or not, balance with a measurement range of the frequency measuring device is cited. For example, most of the current frequency measuring device cannot measure 1000 cpm or more. Specifically, the measuring device that displays the frequency (cpm) in a real number or until one decimal place is a typical one, and the upper limit of the frequency to be displayed is 999 (cpm) or 999.9 (cpm) respectively. Therefore, it is preferable that the weight is used such that a club shaft, which has the numerical value of the frequency at 1000 or more and cannot be measured, does not exist in the club shaft group to be measured, or the mass of the weight is appropriately set. For example, in the case where a club shaft that cannot be measured exists in the club shaft group when the measurement is performed without the weight, it is preferable that adjustment is made that the frequency is reduced by using the weight in order to eliminate the club shaft that cannot be measured. Alternatively, in the case where a club shaft that cannot be measured exists in the club shaft group when the measurement is similarly performed with the mass of the weight of 30 g attached, it is preferable that adjustment is made that the frequency is reduced by increasing the mass of the weight in order to eliminate the club shaft that cannot be measured. Needless to say, in the case where the measurement is performed by a frequency measuring device that has a measurement range different from the above-described measurement range, the mass of the weight may be adjusted by taking into consideration the upper limit of the measurement of the frequency measuring device.

The weight is the one that can be firmly attached to the club shaft, and the shape thereof is thought to be a cylinder, a rectangular solid, poly prism or the like but not particularly limited. In measuring a golf club, the club head is equivalent to the weight when the rear end portion is fastened, and the grip is equivalent to the weight when the tip portion is fastened, which are included in the present invention. The center of gravity of the weight is preferably in the vicinity of the club shaft axis. On the numerical value, the center of gravity is preferably within a cylinder having a radius of 5 mm from the club shaft axis in the state of the club shaft fastened.

Figure 30:
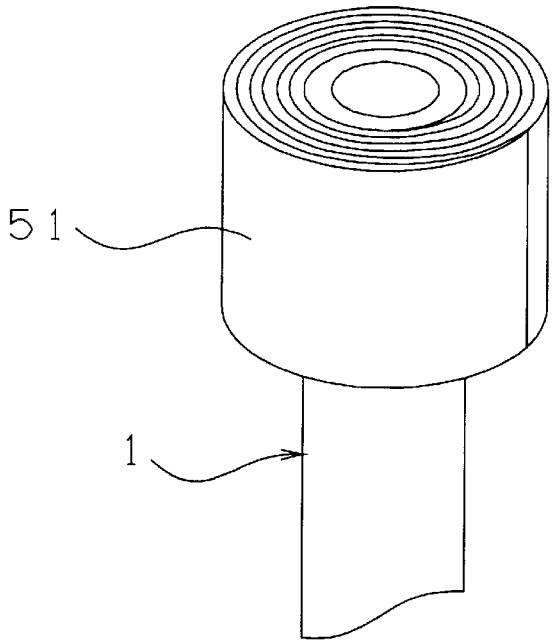
FIG. 30 is a perspective view showing an example of a weight used for the evaluation method of the golf club according to the present invention.
Figure 31A:
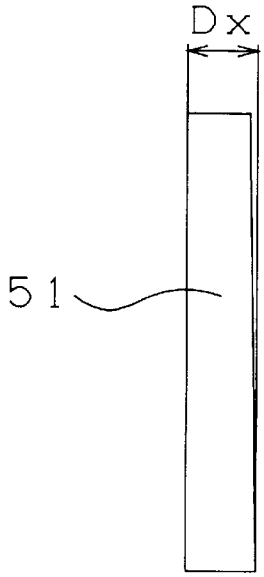
FIGS. 31 (*a*) and 31 (*b*) are respectively development and plan views, each thereof showing an example of the weight of FIG. 30.
Figure 31B:
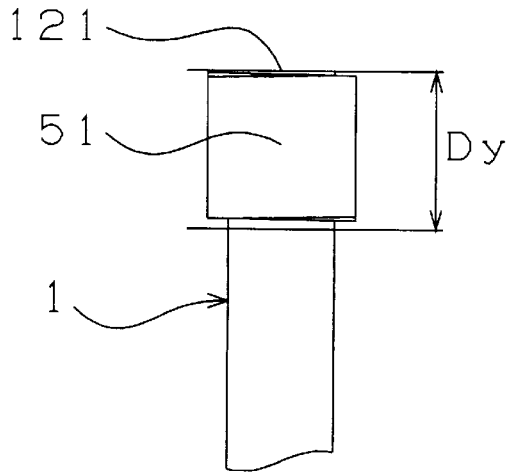

With regard to a structure of the weight, the one of a drill chuck or the like can be thought in order to firmly fasten club shafts having different diameters. As another example of the weight, as shown in FIG. 30, it is thought that a weight tape (51) made of lead or the like is wound around the periphery of the club shaft (1) to fasten. Although a material of the weight tape is not specifically limited, it is preferable that the material is the one that can be firmly wound around the club shaft to fasten. The structure of the weight tape generally is a lamination structure that consists of a weight layer and an adhesive layer such as a double-sided tape, and the shape thereof preferably be a rectangular shape with small change in width similar to a general tape. The change in width in the longitudinal direction is preferably within 1 mm. Also, assuming that the maximum width of the weight tape (51) in the longitudinal direction is Dx as shown in FIG. 31 (*a*), it is preferable that, as shown in FIG. 31 (*b*), all the lead tape is wound so as to be $Dy \leqq Dx+5$ mm, preferably $Dy \leqq Dx+3$ mm in a range of a width Dy ($Dy \geqq Dx$) from the end surface (121).

A preferable range of the weight attachment length to the club shaft is 200 mm or less, more preferably 150 mm or less, further more preferably 100 mm or less, and most preferably 50 mm or less. The measurement of the frequency can be more accurately performed by setting the attachment length in the above-described range. Moreover, the lowest limit of the attachment length is not particularly limited as long as the attachment, winding, fastening or the like is not difficult. Note that the attachment length in the present invention is defined similarly to the foregoing fastening length.

A first embodiment according to the present invention will be described by using the drawings. FIGS. 32 (*a*), (*b*) and (*c*) are the golf clubs according to the present invention. Each of these golf clubs (2) has the club head (3) attached to the tip portion of the club shaft (1), and comprises the grip (4) at the rear end portion. The grip portion that is a portion of the club shaft (1) may be provided to the rear end portion. Although FIGS. 32 (*a*), (*b*) and (*c*) are views of the golf clubs for right-handed players, the golf club in the present invention includes not only the club for a right-handed player but also the club for a left-handed player.

The golf club of FIG. 32 (*a*) indicates 'F-PLUS 1300-WHIPPY' on the club shaft. In the indication, 'F-PLUS 1300' is a value showing the sum of the frequencies (cpm) that is obtained by the second evaluation method of the golf club according to the present invention, and 'WHIPPY' is a reference information for recognizing the value indicating the sum of frequencies. Note that F-PLUS is an abbreviation of FREQUENCY PLUS (the sum of the frequencies). A golfer, based on the knowledge of golf terms that 'WHIPPY' is a flexible club shaft, recognizes that the golf club indicated with F-PLUS 1300 is the one with the club shaft having a flexible feeling.

The golf club of FIG. 32 (*b*) indicates 'F-PLUS 1500-REGULAR' on the club shaft. In the indication, 'F-PLUS 1500' is a value showing the sum of the frequencies (cpm)

that is obtained by the second evaluation method of the golf club according to the present invention, and 'REGULAR' is the reference information for recognizing the value indicating the sum of frequencies. The golfer, based on the knowledge of golf terms that 'REGULAR' is a regular flexibility of club shaft, recognizes that the golf club indicated with F-PLUS 1500 is the one with the club shaft having a regular feeling.

The golf club of FIG. 32 (*c*) indicates 'F-PLUS 1700-HARD' on the club shaft. In the indication, 'F-PLUS 1700' is a value showing the sum of the frequencies (cpm) that is obtained by the second evaluation method of the golf club according to the present invention, and 'HARD' is the reference information for recognizing the value indicating the sum of frequencies. The golfer, based on the knowledge of golf terms that 'HARD' is a stiff club shaft, recognizes that the golf club indicated with F-PLUS 1700 is the one with the club shaft having a stiff feeling. Accordingly, it becomes possible that the golfer selects the golf club by making the value indicating the sum of the frequencies and the characters or the like for recognizing the value as a yardstick.

The portions of the golf club in the present invention denote a club shaft, a club head, a grip, a socket (ferrule), a stopper at the end portion of the grip, a sticker adhered on the club shaft, a sticker adhered on the club head or the like, which are mainly recognizable visually The sum of the frequencies in the present invention means the numerical value that is obtained by the second evaluation method of the golf club according to the present invention or by the evaluation method of the golf club in the second evaluation method where the weight is attached to the end portion to be vibrated. The value indicating the sum of the frequencies in the present invention, in addition to the real number of the sum of the frequencies (cpm) that are actually measured, includes; a numerical value obtained by multiplying the real number by a certain numerical value; a numerical value obtained by dividing the real number by a certain numerical value; a reciprocal; and a numerical value indicated by combination of these numerical values. This is because the sum of the frequencies does not only have the significance in an absolute numerical value. With regard to comparison of the flexibility of club shafts, the object of the present invention can be achieved if the correlation between the flexibility of the club shaft and the value thereof is maintained, thus the numerical value obtained by multiplying the real number by a certain numerical value, the numerical value obtained by dividing the real number by a certain numerical value, the reciprocal, and the numerical value indicated by combination of these numerical values are also useful.

In addition, the value showing the sum of the frequencies, which is indicated in the present invention, includes a number that indicates the sum of the frequencies in stages as shown in Table 1, a character that indicates the sum of the frequencies in stages as shown in Table 2, and a code that indicates the sum of the frequencies in stages as shown in Table 3. The number of stages may be two stages or more, preferably three stages or more, more preferably four stages or more.

TABLE 1

| Sum of frequencies (cpm) | Value that indicates sum of frequencies |
|---|---|
| Between 1200 or more and less than 1300 | 1 |

TABLE 1-continued

| Sum of frequencies (cpm) | Value that indicates sum of frequencies |
|---|---|
| Between 1300 or more and less than 1400 | 2 |
| Between 1400 or more and less than 1600 | 3 |
| Between 1600 or more and less than 1700 | 4 |
| Between 1700 or more and 1800 or less | 5 |

In Table 1, the sum of the frequencies is the one obtained by the second evaluation method of the golf club according to the present invention.

TABLE 2

| Sum of frequencies (cpm) | Value that indicates sum of frequencies |
|---|---|
| Between 360 or more and 380 or less | Type A |
| Between 420 or more and 440 or less | Type B |
| Between 480 or more and 500 or less | Type C |

In Table 2, the sum of the frequencies is the one obtained by the evaluation method in which the weight is attached to the end portion to be vibrated in the second evaluation method of the golf club according to the present invention.

TABLE 3

| Sum of frequencies (cpm) | Value that indicates sum of frequencies |
|---|---|
| 1000 | ★ |
| 1200 | ★★ |
| 1400 | ★★★ |
| 1600 | ★★★★ |

In Table 3, the sum of the frequencies is the one obtained by the second evaluation method of the golf club according to the present invention.

The above-described indication in stages means that, as shown in Table 1, a specified range for sum of the frequencies is compared with a value that indicates the sum of the frequencies. In this case, the range for the sum of the frequencies may not necessarily be the same size of range through the stages. As shown in Table 1, the size of a range at each stage is not the same such as; the range of 100 cpm between 1200 or more and less than 1300 in the case of '1'; the range of 100 cpm between 1300 or more and less than 1400 in the case of '2'; the range of 200 cpm between 1400 or more and less than 1600 in the case of '3'; the range of 100 cpm between 1600 or more and less than 1700 in the case of '4'; and the range of 100 cpm between 1700 or more and 1800 or less in the case of '5'. With regard to the range, it is possible that a golf club manufacturer, a club shaft manufacturer or the like appropriately set the size thereof And, as a variation example, ranges regarding the number, the character, the code or the like at the both ends indicating the stiffest or the most flexible stage in the stages to be set may be the ranges that limit only one side such that less than 1300 cpm in the case of '1', 1700 cpm or more in the case of '5' or the like.

In addition, the ranges for the sum of the frequencies may be the ones that are discontinuous through the stages as shown in Table 1. It is possible that the golf club manufacturer, the club shaft manufacturer or the like exclude ranges that are not actually used and appropriately set the range for the sum of the frequencies discontinuously as an entire range.

Moreover, the sum of the frequencies may be represented by a specified and proper numerical value that does not have a range as shown in Table 3. Since an actual product generally includes a tolerance, the specified and proper numerical value may be considered to be insufficient. However, since the tolerance is originally set in a range so that the tolerance does not affect the quality of the product, the numerical value on the product needs not to be indicated taking in consideration the tolerance. It is possible that the golf club manufacturer, the club shaft manufacturer or the like appropriately set a target value or a mean value or the like of the product as a proper numerical value with regard to the sum of the frequencies.

Figure 34:
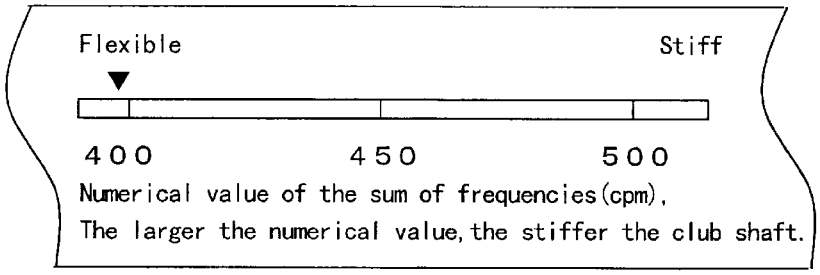
FIGS. 34 (*a*) to 34 (*c*) are partially expanded plan views, each thereof showing an application example of the golf club according to the first embodiment of the present invention.
Figure 34:
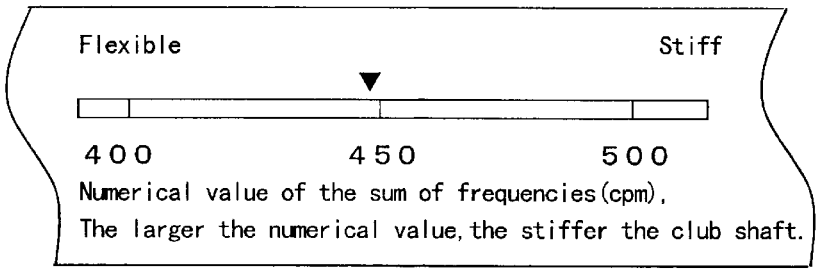
Figure 34:
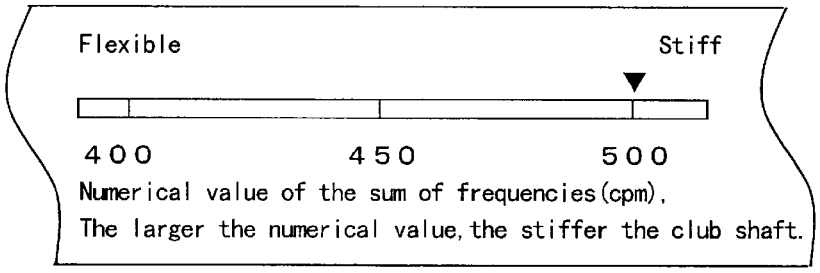

The reference information for recognizing the value indicating the sum of frequencies in the present invention denotes the character or the like so as to explain what an indicated value means. For example, it is a golf term such as 'WHIPPY', 'REGULAR', 'HARD' or 'L (Ladies)', 'A (Average)', 'R (Regular)', 'S (Stiff)', 'X (Extra Stiff)' as shown in FIGS. 32 (*a*), (*b*) and (*c*), indicating the flexibility of the club shaft by the word itself. Other than the information that directly expresses the flexibility of the club shaft such as 'flexible', 'regular' and 'stiff', the following information is cited: the information that shows a proper image of a golfer who uses the golf club by indicating a H/S (head speed) or a carry such as 'H/S 37m/s', 'H/S 40m/s', 'H/S 43m/s' or '200YARD', '220YARD', '240YARD'; and combination of such information such as 'A:180YARD', 'R:210YARD', 'S:240YARD' and 'X:270YARD'. Alternatively, as shown in FIGS. 33 (*a*), (*b*) and (*c*), the information may be described in a sentence. (The sum of the frequencies is the one obtained by the second evaluation method of the golf club according to the present invention.) As another alternative, as shown in FIGS. 34 (*a*), (*b*) and (*c*), the information may be described by using a drawing. (The sum of the frequencies is the one obtained by the evaluation method such that the weight is attached to the end portion to be vibrated in the second evaluation method of the golf club according to the present invention.)

Figure 37:
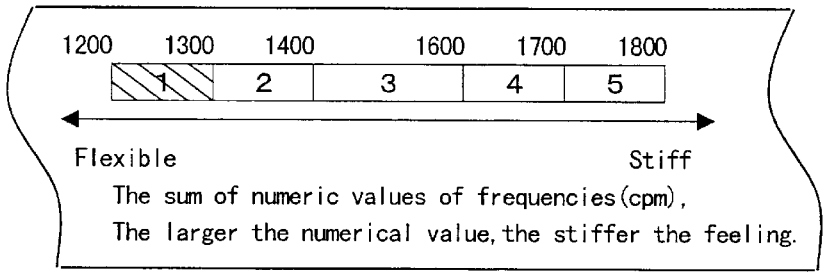
FIGS. 37 (*a*) to 37 (*e*) are partially expanded plan views, each thereof showing an application example of the golf club according to the first embodiment of the present invention.
Figure 37:
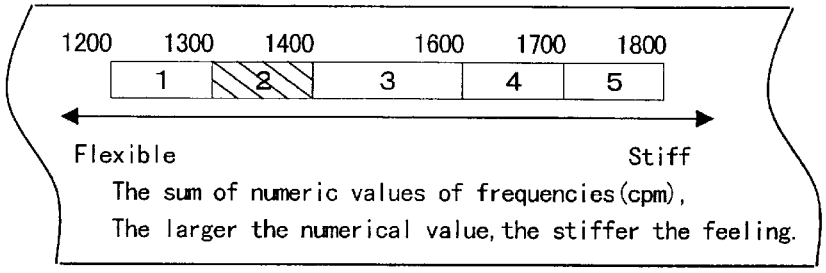
Figure 37:
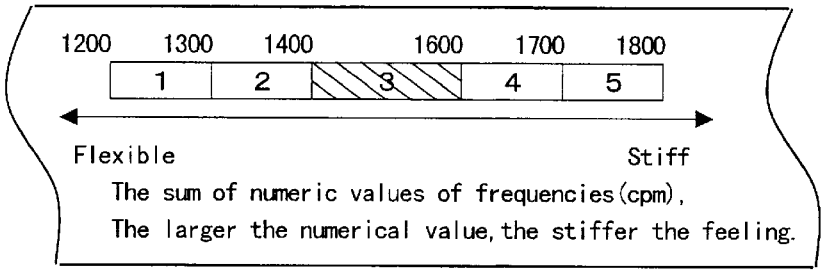
Figure 37:
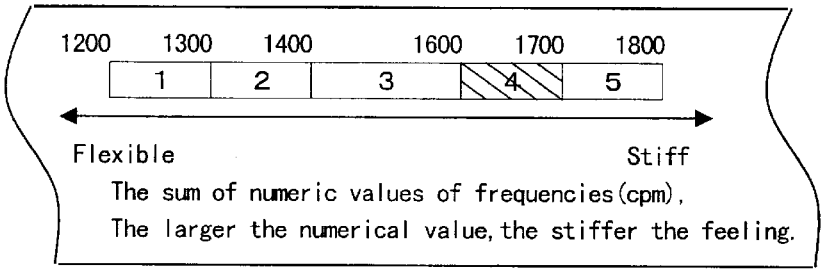
Figure 37:
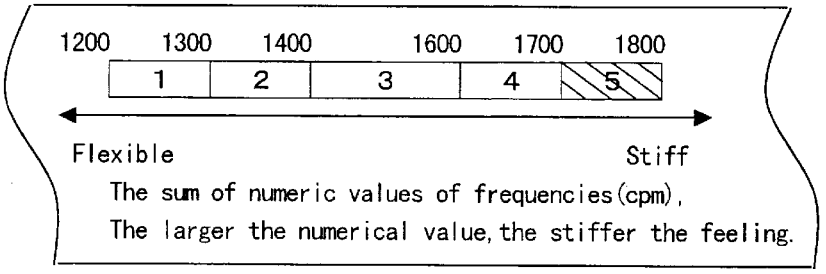

Moreover, with regard to the reference information that indicates the above-described sum of the frequencies by the number, the character, the code or the like in stages, the followings may be taken: the information described by a sentence as shown in FIGS. 35 (*a*), (*b*), (*c*), (*d*) and (*e*) (The sum of the frequencies is the one obtained by the evaluation method such that the weight is attached to the end portion to be vibrated in the second evaluation method of the golf club according to the present invention.); the information described by using a table as shown in FIGS. 36 (*a*), (*b*), (*c*), (*d*) and (*e*) (The sum of the frequencies is the one obtained by the second evaluation method of the golf club according to the present invention.); the information described by using a drawing as shown in FIGS. 37 (*a*), (*b*), (*c*), (*d*) and (*e*) (The sum of the frequencies is the one obtained by the second evaluation method of the golf club according to the present invention.); and the combination of these information.

Figure 38:
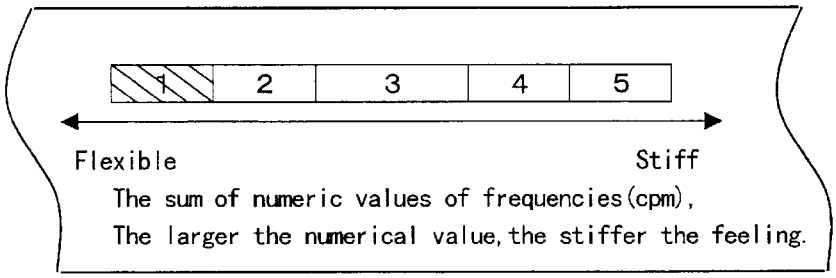
FIGS. 38 (*a*) to 38 (*e*) are partially expanded plan views, each thereof showing an application example of the golf club according to the first embodiment of the present invention.
Figure 38:
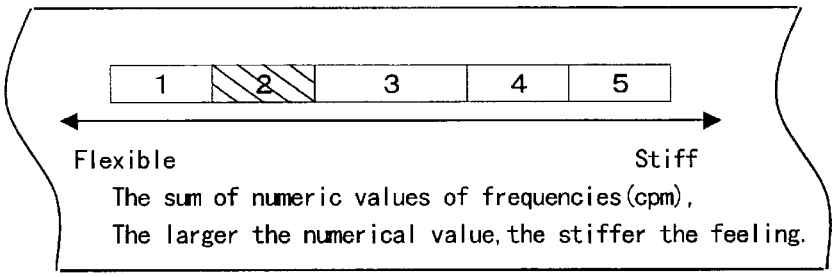
Figure 38:
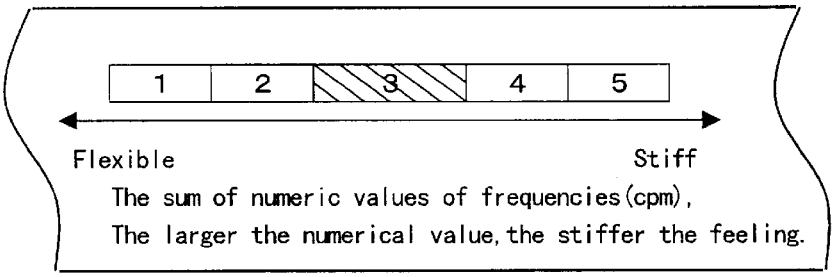
Figure 38:
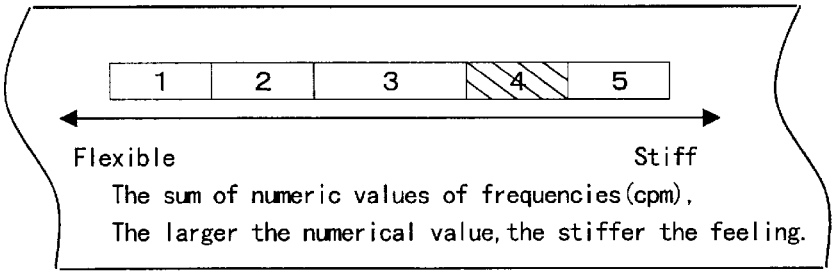
Figure 38:
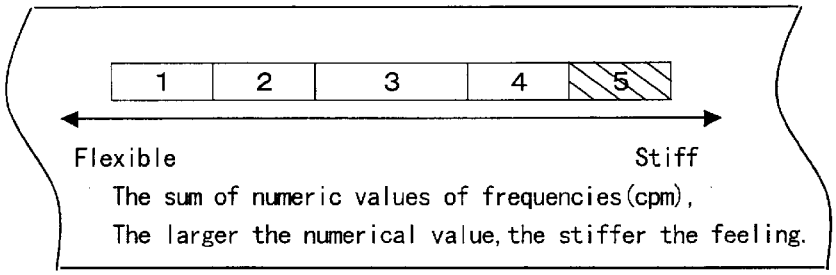

In FIGS. 33, 34, 35, 36 and 37, the sum of the frequencies (cpm) is directly indicated, which is obtained by the second evaluation method of the golf club according to the present invention or by the evaluation method in the second evaluation method of the golf club where the weight is attached to the end portion to be vibrated. But, as shown in FIGS. 38 (*a*), (*b*), (*c*), (*d*) and (*e*), although they does not directly indicates the sum of the frequencies (cpm), the information indicating that the flexibility of the club shaft is evaluated and set by using the sum of the frequencies is also included in the present invention.

In other words, if the sum of the frequencies is not generally known, the indication to which description is given as in FIGS. 33, 34, 35, 36 and 37 is needed in order for the golfer to recognize the present invention. But once the sum of the frequencies is generally known, it is possible that the golfer recognizes the present invention even if the reference information is indicated after appropriately performing abbreviation, omission of unit, or making numerical values to put into stages and omitting the numerical values, or the like as shown in FIGS. 32 or 38, without mentioning the indication to which description is given as in FIGS. 33, 34, 35, 36 and 37.

Further, once the sum of the frequencies is extremely generally known, it is possible that the golfer recognizes the present invention by indicating only the values that indicate the sum of the frequencies such as 'F-PLUS 1300', 'F-PLUS 1500' and 'F-PLUS 1700' in FIG. 32 (*a*), (*b*) and (*c*). Still further, once the sum of the frequencies is maximumly generally known, it is possible that the golfer recognizes the present invention by indicating only the numerical values out of the values that indicate the sum of the frequencies such as '1300', '1500' and '1700' in FIG. 32 (*a*), (*b*) and (*c*).

In order to explain the value that indicates the sum of the frequencies according to the present invention to the golfer, it is understandable and preferable that the explanation is given by omitting detail technical items. Specifically, the content such as '178 mm of the rear end portion or 127 mm of the front portion is fastened, and the weight of 200 g is attached to the other end of the fastened portion.' is not particularly necessary as explanation content. It is preferable that such measurement conditions are standardized among the golf club manufacturer, the club shaft manufacturer or the like, and explanation is given to the golfer that the contents can be recognized such that the larger the sum of the frequencies is, the stiffer the feeling of the club shaft becomes, or the golf club assembled with the club shaft becomes a stiff feeling. In particular, it is preferable that the value is a recognizable word or number, or a short sentence in which the word and number, a code, a drawing and the like are appropriately combined.

As described above, the golfer obtains the value that indicates the sum of the frequencies indicated on the golf club and, if necessary, the reference information for recognizing the value that indicates the sum of the frequencies as information, and then it is possible that the golfer selects a golf club that fits his/her feeling of flexibility among the golf clubs on which the information is indicated.

Note that, in the above-described first embodiment according to the golf club of the present invention, the value that indicates the sum of the frequencies and the reference information are integrally indicated on a portion of the golf club. However, in the present invention, the value that indicates the sum of the frequencies and the reference information may be independently indicated on a portion of the golf club. For example, the value that indicates the sum of frequencies may be indicated on the club head and the reference information may be indicated on the club shaft. At least, it is satisfactory that the reference information for recognizing the value that indicates the sum of the frequencies is indicated on a place which is easy to find, by making the value that indicates the sum of the frequencies as a guide.

Figure 39A:
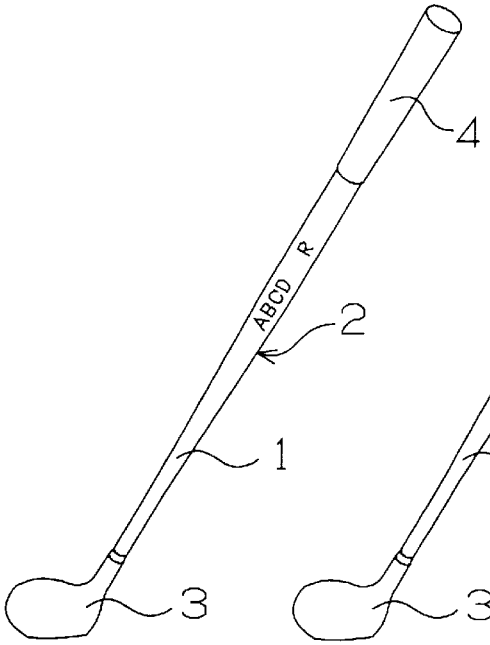
FIGS. 39 (*a*) to 39 (*c*) are front views, each thereof showing a golf club according to a second embodiment of the present invention.
Figure 39B:
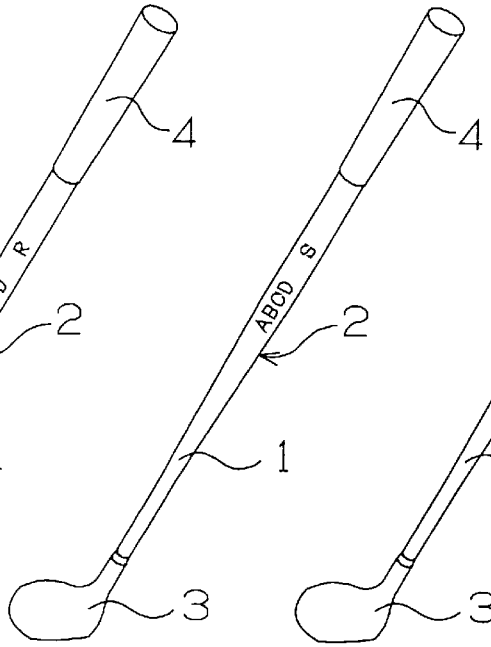
Figure 39C:
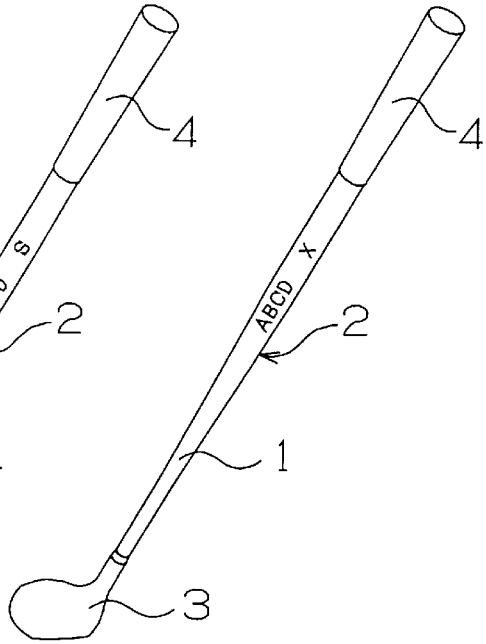

A second embodiment according to the golf club of the present invention will be described by using drawings. FIGS. 39 (*a*), (*b*) and (*c*) are the golf clubs according to the present invention. On the golf club of FIG. 39 (*a*), 'R' is indicated on its club shaft along with a brand name 'ABCD' of the golf club. On the golf club of FIG. 39 (*b*), 'S' is indicated on its club shaft along with a brand name 'ABCD' of the golf club. On the golf club of FIG. 39 (*c*), 'X' is indicated on its club shaft along with a brand name 'ABCD' of the golf club.

FIG. 40 shows a medium (m) on which a description is printed regarding the golf club of a brand name 'ABCD' as shown in FIGS. 39 (*a*), (*b*) and (*c*). On the medium (m), along with the indication specifying the golf club such as the brand name 'ABCD series' of the golf club or the like, the reference information is also indicated which enables the golfers to recognize that the values 'R,S,X' indicated on the golf clubs are the information with regard to the value indicating the sum of the frequencies and that the values represent the flexibility of the golf club. (The sum of the frequencies is the one obtained by the second evaluation method of the golf club according to the present invention.) The golfer understands the meaning of the value that indicates the sum of the frequencies by the description shown on the medium (m), thus it is possible that he/she selects the golf club shown on the medium (m) by using the indicated values as a yardstick, in more detail, the golf club of the same model as shown in the medium (m) (because there is no more than one or one set of the exact golf club shown on the medium in the world.). In addition, 'Total frequency system' shown on the medium (m) of FIG. 40 is an example of a sales talk regarding the sum of the frequencies, and the name thereof is appropriately created by a golf club manufacturer, a club shaft manufacturer, a sales company or the like.

The medium in the present invention is thought to be the one such as an instruction book on a golf club, a catalog, a poster, a panel or the like to be displayed at a store, a commercial film on a television, a video tape for sales promotion, indication through an electric communication line or the like that is published or manufactured by the golf club manufacturer, the club shaft manufacturer, the sales company or the like. In other words, the medium according to the present invention is the one that is mainly recognizable visually, describes regarding the value of the sum of the frequencies, and specifies the golf club on which the value is indicated.

In order to actually explain the value that indicates the sum of the frequencies according to the present invention to the golfer, it is understandable and preferable that the explanation is given by omitting detail technical items. Specifically, the content such as '178 mm of the rear end portion or 127 mm of the front portion is fastened, and the weight of 200 g is attached to the other end of the fastened portion.' is not particularly necessary as explanation content. It is preferable that such measurement conditions are standardized among the golf club manufacturer, the club shaft manufacturer or the like, and explanation is given to the golfer that the contents can be recognized such that the larger the sum of the frequencies is, the stiffer the feeling of the club shaft becomes, or the golf club assembled with the club shaft becomes a stiff feeling. In particular, for explaining the value that indicates the sum of the frequencies indicated on the golf club by the medium, it is preferable that the explanation is given by using an understandable sentence, a drawing, a photograph of the related golf club or the like.

The above-described second embodiment according to the golf club of the present invention is an example in which the value that indicates the sum of the frequencies is indicated on the golf club and the reference information is indicated on the medium. The golfer obtains the value that indicates the sum of the frequencies indicated on the golf club and the reference information for recognizing the value that indicates the sum of the frequencies as information, and then it is possible that the golfer selects a golf club that fits his/her feeling of flexibility among the golf clubs on which the values that indicate the sum of the frequencies are indicated.

Figures 41A, 41B, 41C, 41D:
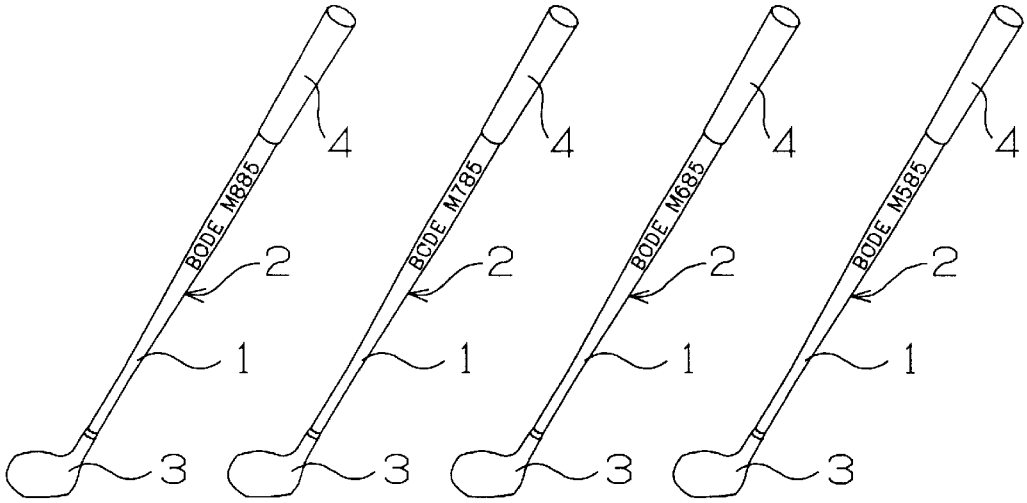
FIGS. 41 (*a*) to 41 (*d*) are front views, each thereof showing a golf club according to a third embodiment of the present invention.

A third embodiment according to the golf club of the present invention will be described by using drawings. FIGS. 41 (*a*), (*b*), (*c*) and (*d*) are the golf clubs according to the present invention. On the golf club of FIG. 41 (*a*), a model name of the golf club 'BCDE M885' is indicated. On the golf club of FIG. 41 (*b*), a model name of the golf club 'BCDE M785' is indicated. On the golf club of FIG. 41 (*c*), a model name of the golf club 'BCDE M685' is indicated. On the golf club of FIG. 41 (*d*), a model name of the golf club 'BCDE M585' is indicated.

FIG. 42 shows a medium (m') on which an explanation is given with regard to the golf clubs of the model names 'M885, M785, M685, M585' under the brand name 'BCDE' shown in FIGS. 41 (*a*), (*b*), (*c*) and (*d*). On the medium (m'), along with the indication specifying the golf club such as the brand name, the model name or the like such as 'Club BCDE' and 'BCDE M885, BCDE M785, BCDE M685, BCDE M585', the reference information is also indicated by which the models of the golf clubs 'M885, M785, M685, M585'enables the golfer to recognize that the flexibility of the golf club is designed based on the value indicating the sum of the frequencies. The golfer understands the meaning of the value that indicates the sum of the frequencies by the description shown on the medium (m'), thus it is possible that he/she selects the golf club of the model which is specified based on the value of the sum of the frequencies, in more detail, the golf club of the same model as shown in the medium (m') (because there is no more than one or one set of the exact golf club shown on the medium in the world.). In addition, 'Sum of the frequency theory' shown on the medium (m') of FIG. 42 is an example of a sales talk regarding the sum of the frequencies, and the name thereof is appropriately created by a golf club manufacturer, a club shaft manufacturer, a sales company or the like.

The medium in the present invention is thought to be the one such as an instruction book on a golf club, a catalog, a poster, a panel or the like to be displayed at a store, a commercial film on a television, a video tape for sales promotion, indication through an electric communication line or the like that is published or manufactured by the golf club manufacturer, the club shaft manufacturer, the sales company or the like. In other words, the medium according to the present invention is the one that is mainly recognizable visually, describes regarding the value of the sum of the frequencies, and shows the golf club which is set based on the value. Although the numerical value of the frequency is not directly indicated on the medium of FIG. 42, the golfer can understand that the sum of the frequencies quantitatively expresses the flexibility of the golf club and that the flexibility of the golf club shown on the medium is set based on the sum of the frequencies, thus this medium is included in the present invention.

In order to actually explain the value that indicates the sum of the frequencies according to the present invention to the golfer, it is understandable and preferable that the explanation is given by omitting detail technical items. Specifically, the content such as '178 mm of the rear end portion or 127 mm of the front portion is fastened, and the weight of 200 g is attached to the other end of the fastened portion.' is not particularly necessary as explanation content. It is preferable that such measurement conditions are standardized among the golf club manufacturer, the club shaft manufacturer or the like, and explanation is given to the golfer that the contents can be recognized such that the larger the sum of the frequencies is, the stiffer the feeling of the club shaft becomes, or the golf club assembled with the club shaft becomes a stiff feeling. In particular, for explaining the value that indicates the sum of the frequencies by the medium, it is preferable that the explanation is given by using an understandable sentence, a drawing, a photograph of the related golf club or the like.

The above-described third embodiment according to the golf club of the present invention is an example in which the value that indicates the sum of the frequencies is specified corresponding to the model of the golf club and the reference information is indicated on the medium. The golfer obtains the value that indicates the sum of the frequencies indicated on the medium corresponding to the model of the golf club and the reference information for recognizing the value as information, and then it is possible that the golfer selects a golf club that fits his/her feeling of flexibility among the golf clubs on which the values that indicate the sum of the frequencies are indicated.

A fourth embodiment according to the golf club of the present invention will be described by using drawings. FIGS. 43 (*a*), (*b*) and (*c*) are the golf clubs according to the present invention. Each of these golf clubs (2) has the club head (3) attached to the tip portion of the club shaft (1), and comprises the grip (4) at the rear end portion. The grip portion that is a portion of the club shaft (1) may be provided to the rear end portion. Although FIGS. 43 (*a*), (*b*) and (*c*) are views of the golf clubs for right-handed players, the golf club in the present invention includes not only the club for the right-handed player but also the club for the left-handed player.

The golf club of FIG. 43 (a) indicates 'F-RATIO 2.0-HT' on the club shaft. In the indication, 'F-RATIO 2.0' is a value equivalent to (f1/f2) in the case where the frequency obtained by fastening the rear end portion is made to be f1 and the frequency obtained by fastening the tip portion is made to be f2 as a value showing ratio of the frequencies (cpm) that is obtained by the third evaluation method of the golf club according to the present invention. 'HT' is a reference information for recognizing the value indicating the ratio of frequencies. Note that 'F-RATIO' is an abbreviation of FREQUENCY RATIO (ratio of the frequencies), and HT is an abbreviation of HIGH TRAJECTORY. A golfer, based on the knowledge of golf terms that 'HT' means to present a high trajectory, recognizes that the golf club indicated with F-RATIO 2.0 is the golf club that presents the high trajectory.

The golf club of FIG. 43 (*b*) indicates 'F-RATIO 1.7-MT' on the club shaft. In the indication, 'F-RATIO 1.7' is a value equivalent to (f1/f2) in the case where the frequency obtained by fastening the rear end portion is made to be f1 and the frequency obtained by fastening the tip portion is made to be f2 as a value showing ratio of the frequencies (cpm) that is obtained by the third evaluation method of the golf club according to the present invention. 'MT' is a reference information for recognizing the value indicating the ratio of frequencies. Note that 'F-RATIO' is an abbreviation of FREQUENCY RATIO (ratio of the frequencies), and MT is an abbreviation of MIDDLE TRAJECTORY. A golfer, based on the knowledge of golf terms that 'MT' means to present a middle trajectory, recognizes that the golf club indicated with F-RATIO 1.7 is the golf club that presents the middle trajectory.

The golf club of FIG. 43 (*c*) indicates 'F-RATIO 1.4-LT' on the club shaft. In the indication, 'F-RATIO 1.4' is a value equivalent to (f1/f2) in the case where the frequency obtained by fastening the rear end portion is made to be f1 and the frequency obtained by fastening the frond end portion is made to be f2 as a value showing ratio of the frequencies (cpm) that is obtained by the third evaluation method of the golf club according to the present invention. 'LT' is a reference information for recognizing the value indicating the ratio of frequencies. Note that 'F-RATIO' is an abbreviation of FREQUENCY RATIO (ratio of the frequencies), and LT is an abbreviation of LOW TRAJECTORY. A golfer, based on the knowledge of golf terms that 'LT' means to present a low trajectory, recognizes that the golf club indicated with F-RATIO 1.4 is the golf club that presents the low trajectory. Accordingly, it becomes possible that the golfer selects the golf club by making the value indicating the ratio of the frequencies and the characters or the like for recognizing the value as a yardstick.

The portions of the golf club in the present invention denote the club shaft, the club head, the grip, the socket (ferrule), the stopper at the end portion of the grip, the sticker adhered on the club shaft, the sticker adhered on the club head or the like, which are mainly recognizable visually.

The ratio of the frequencies in the present invention means the numerical value that is obtained by the third evaluation method of the golf club according to the present invention or by the evaluation method in the third evaluation method of the golf club where the weight is attached to the end portion to be vibrated. The value indicating the ratio of the frequencies in the present invention, in addition to the real number of the ratio of the frequencies that is actually measured, includes: a numerical value obtained by multiplying the real number by a certain numerical value; a numerical value obtained by dividing the real number by a certain numerical value; a reciprocal; and a numerical value indicated by combination of these numerical values. This is because the ratio of the frequencies does not only have the meaning in an absolute numerical value. With regard to comparison of the factors contributing to the increase in a dynamic loft angle of club shafts, the object of the present invention can be achieved if the correlation between the factors contributing to the increase in the dynamic loft angle of the club shaft and the value thereof is maintained, thus the numerical value obtained by multiplying the real number by a certain numerical value, the numerical value obtained by dividing the real number by a certain numerical value, the reciprocal, and the numerical value indicated by combination of these numerical values are also useful.

In addition, the value showing the ratio of the frequencies, which is indicated in the present invention, includes a number that indicates the ratio of the frequencies in stages as shown in Table 4, a character that indicates the ratio of the frequencies in stages as shown in Table 5, and a code that indicates the ratio of the frequencies in stages as shown in Table 6. The number of stages may be two stages or more, preferably three stages or more, more preferably four stages or more.

TABLE 4

| Ratio of frequencies | Value that indicate s ratio of frequencies |
|---|---|
| Between 1.2 or more and less than 1.5 | 1 |
| Between 1.5 or more and less than 1.7 | 2 |
| Between 1.7 or more and less than 1.9 | 3 |
| Between 1.9 or more and less than 2.1 | 4 |
| Between 2.1 or more and 2.4 or less | 5 |

In Table 4, the ratio of the frequencies is the one obtained by the third evaluation method of the golf club according to the present invention.

TABLE 5

| Ratio of frequencies | Value that indicates ratio of frequencies |
|---|---|
| Between 1.3 or more and 1.5 or less | A Type |
| Between 1.6 or more and 1.8 or less | B Type |
| Between 1.9 or more and 2.1 or less | C Type |

In Table 5, the ratio of the frequencies is the one obtained by the evaluation method in the third evaluation method of the golf club according to the present invention where the weight is attached to the end portion to be vibrated.

TABLE 6

| Ratio of frequencies | Value that indicates ratio of frequencies |
|---|---|
| 1.3 | # |
| 1.5 | # # |
| 1.7 | # # # |
| 1.9 | # # # # |

In Table 6, the ratio of the frequencies is the one obtained by the third evaluation method of the golf club according to the present invention.

The above-described indication in stages means that, as shown in Table 4, a specified range for ratio of the frequencies is compared with a value that indicates ratio of the frequencies. In this case, the range for ratio of the frequencies may not necessarily be the same size of range through the stages. As shown in Table 4, the size of a range at each stage is not the same such as: the range of approximately 0.3 between 1.2 or more and less than 1.5 in the case of '1'; the range of approximately 0.2 between 1.5 or more and less than 1.7 in the case of '2'; the range of approximately 0.2 between 1.7 or more and less than 1.9 in the case of '3'; the range of approximately 0.2 between 1.9 or more and less than 2.1 in the case of '4'; and the range of approximately 0.3 between 2.1 or more and less than 2.4 in the case of '5';. With regard to the range, it is possible that the golf club manufacturer, the club shaft manufacturer or the like appropriately set the size thereof. And, as a variation example, ranges regarding the number, the character, the code or the like at the both ends indicating the stiffest or the most flexible stage in the stages to be set may be the ranges that limit only one side such that less than 1.5 in the case of '1', 2.1 or more in the case of '5' or the like.

In addition, the ranges for ratio of the frequencies may be the ones that are discontinuous through the stages as shown in Table 5. It is possible that the golf club manufacturer, the club shaft manufacturer or the like exclude ranges that are not actually used and appropriately set the range for ratio of the frequencies discontinuously as an entire range.

Moreover, the ratio of the frequencies may be represented by a specified and proper numerical value that does not have a range as shown in Table 6. Since an actual product generally includes a tolerance, the specified and proper numerical value may be considered to be insufficient. However, since the tolerance is originally set in a range so that the tolerance does not affect the quality of the product, the numerical value on the product needs not to be indicated taking in consideration the tolerance. It is possible that the golf club manufacturer, the club shaft manufacturer or the like appropriately set a target value or a mean value or the like of the product as a proper numerical value with regard to the ratio of the frequencies.

Figure 45:
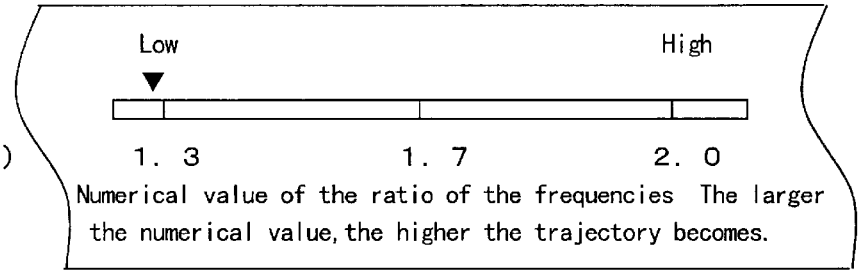
FIGS. 45 (*a*) to 45 (*c*) are partially expanded plan views, each thereof showing an application example of the golf club according to the fourth embodiment of the present invention.
Figure 45:
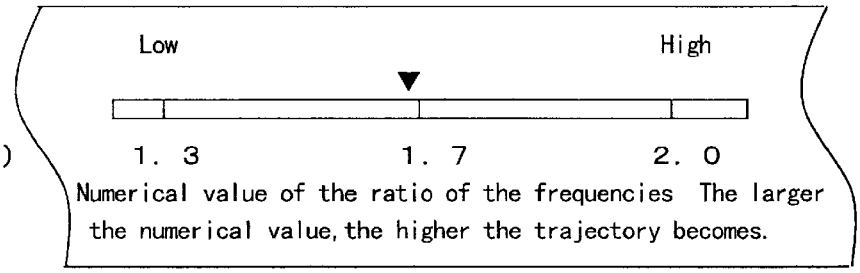
Figure 45:
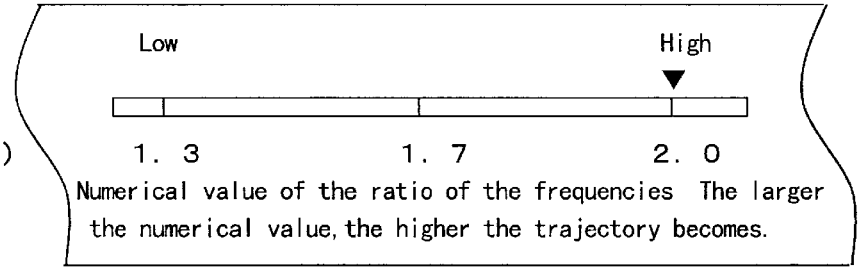

The reference information for recognizing the value indicating the ratio of frequencies in the present invention denotes the character or the like so as to explain what an indicated value means. For example, it is a golf term such as 'HT', 'MT', 'LT' or 'HIGH', 'MIDDLE', 'LOW' as shown in FIGS. 43 (*a*), (*b*) and (*c*), indicating the height of the hit ball by the word itself. In addition to the information that directly expresses the height of the ball such as 'high trajectory', 'middle trajectory' and 'low trajectory', the following information is cited: the information that shows a proper image of a golfer who uses the golf club by indicating a H/S (head speed) or a carry such as 'H/S 37m/s', 'H/S 40m/s', 'H/S 43m/s' or '200YARD', '220YARD', '240YARD' on the assumption that the club shaft that presents the high trajectory is suitable for a golfer who has a low H/S (head speed) and a short carry and is apt to hit the ball low, and the club shaft that presents the low trajectory is suitable for a golfer who has a high H/S (head speed) and a short carry and is apt to hit the ball high; and combination of such information such as 'HT:200YARD', 'MT:240YARD' and 'LT:280YARD'. Alternatively, as shown in FIGS. 44 (*a*), (*b*) and (*c*), the information may be described in a sentence. (The ratio of the frequencies is the one obtained by the third evaluation method of the golf club according to the present invention.) As another alternative, as shown in FIGS. 45 (*a*), (*b*) and (*c*), the information may be described by using a drawing. (The ratio of the frequencies is the one obtained by the evaluation method such that the weight is attached to the end portion to be vibrated in the third evaluation method of the golf club according to the present invention.)

Figure 48:
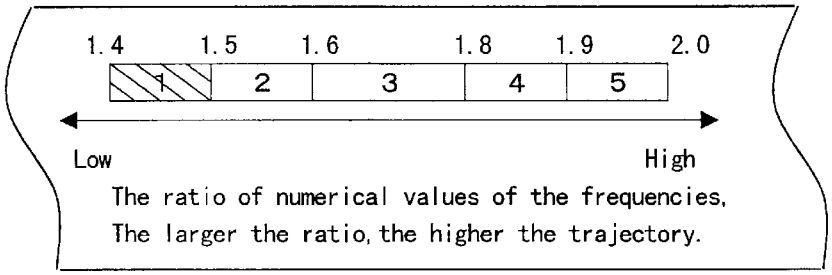
FIGS. 48 (*a*) to 48 (*e*) are partially expanded plan views, each thereof showing an application example of the golf club according to the fourth embodiment of the present invention.
Figure 48:
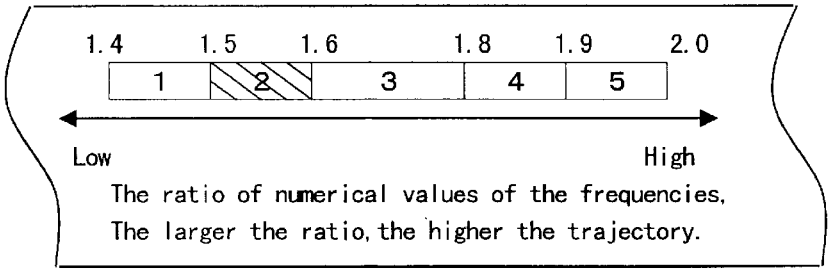
Figure 48:
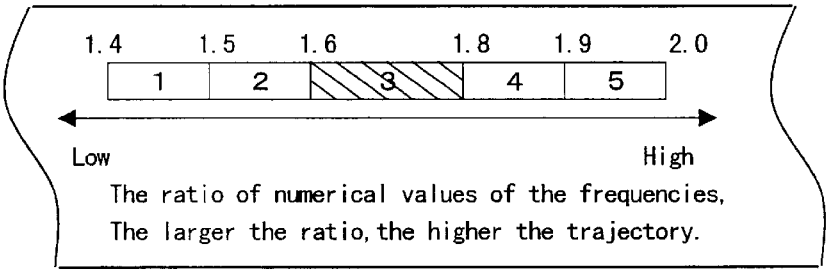
Figure 48:
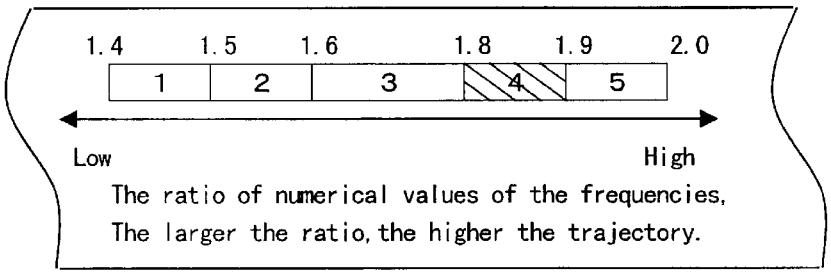
Figure 48:
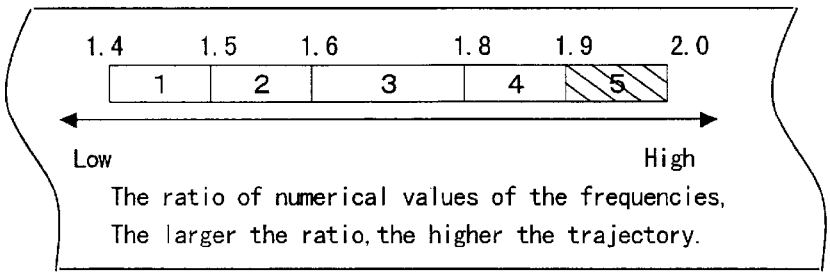

Moreover, with regard to the reference information that indicates the above-described ratio of the frequencies by the number, the character, the code or the like in stages, the followings may be taken: the information described by a sentence as shown in FIGS. 46 (*a*), (*b*), (*c*), (*d*) and (*e*) (The ratio of the frequencies is the one obtained by the evaluation method such that the weight is attached to the end portion to be vibrated in the third evaluation method of the golf club according to the present invention.); the information described by using a table as shown in FIGS. 47 (*a*), (*b*), (*c*), (*d*) and (*e*) (The ratio of the frequencies is the one obtained by the third evaluation method of the golf club according to the present invention.); the information described by using a drawing as shown in FIGS. 48 (*a*), (*b*), (*c*), (*d*) and (*e*) (The ratio of the frequencies is the one obtained by the third evaluation method of the golf club according to the present invention.); and the combination of these information.

Figure 49:
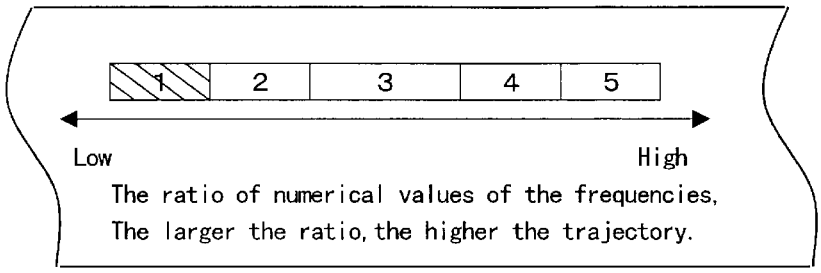
FIGS. 49 (*a*) to 49 (*e*) are partially expanded plan views, each thereof showing an application example of the golf club according to the fourth embodiment of the present invention.
Figure 49:
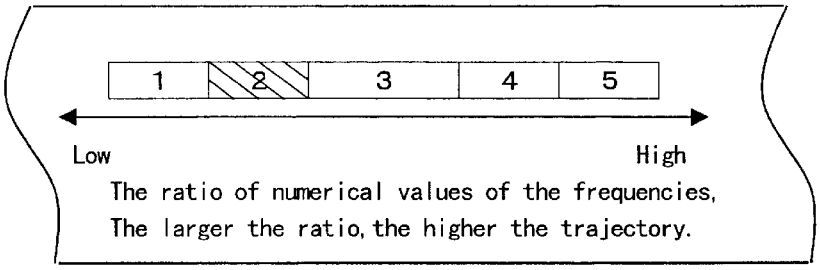
Figure 49:
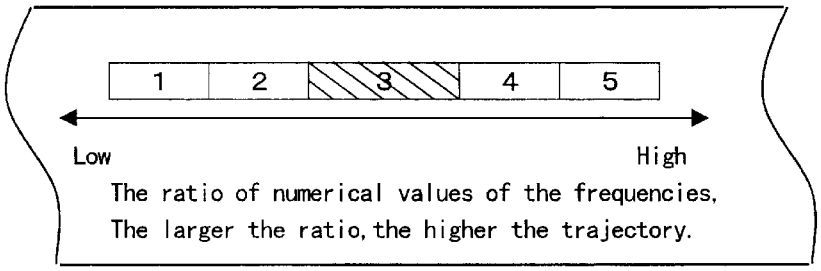
Figure 49:
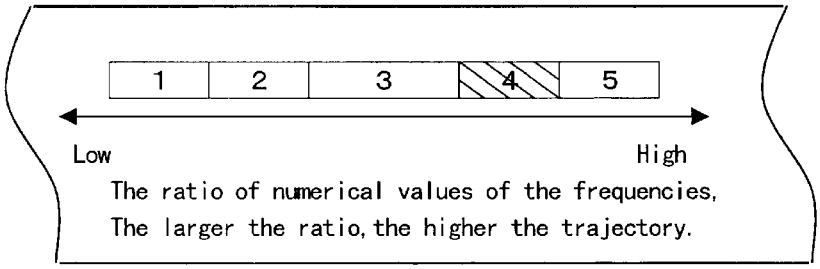
Figure 49:
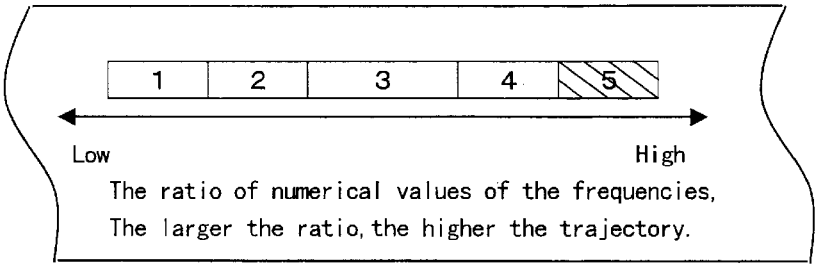

In FIGS. 44, 45, 46, 47 and 48, the ratio of the frequencies is directly indicated, which is obtained by the third evaluation method of the golf club according to the present invention or by the evaluation method in the third evaluation method where the weight is attached to the end portion to be vibrated. But, as shown in FIGS. 49 (*a*), (*b*), (*c*), (*d*) and (*e*), although they do not directly indicate the ratio of the frequencies, the information indicating that the height of the stricken ball presented by the club shaft is evaluated and set by using the ratio of the frequencies is also included in the present invention.

In other words, if the ratio of the frequencies is not generally known, the indication to which description is given as in FIGS. 44, 45, 46, 47 and 48 is needed in order for the golfer to recognize the present invention. But once the ratio of the frequencies is generally known, it is possible that the golfer recognizes the present invention even if the reference information is indicated after appropriately performing abbreviation, omission of unit, or making numerical values to be stages and omitting the numerical values, or the like as shown in FIGS. 43 or 49, without mentioning the indication to which description is given as in FIGS. 44, 45, 46, 47 and 48.

Further, once the ratio of the frequencies is extremely generally known, it is possible that the golfer recognizes the present invention by indicating only the values that indicate the ratio of the frequencies such as 'F-RATIO 2.0', 'F-RATIO 1.7' and 'F-RATIO 1.4' in FIGS. 43 (*a*), (*b*) and (*c*). Still further, once the ratio of the frequencies is maximumly generally known, it is possible that the golfer recognizes the present invention by indicating only the numerical values out of the values that indicate the ratio of the frequencies such as '2.0', '1.7' and '1.4' in FIGS. 43 (*a*), (*b*) and (*c*).

In order to explain the value that indicates the ratio of the frequencies according to the present invention to the golfer, it is understandable and preferable that the explanation is given by omitting detail technical items. Specifically, the content such as '178 mm of the rear end portion or 127 mm of the tip portion is fastened, and the weight of 200 g is attached to the other end of the fastened portion.' is not particularly necessary as explanation content. It is preferable that such measurement conditions are standardized among the golf club manufacturer, the club shaft manufacturer or the like, and explanation is given to the golfer that the contents can be recognized such that the larger the ratio of the frequencies is, the larger the factors contributing to the increase in the dynamic loft becomes, and the club shaft that presents the high trajectory or the golf club assembled with the club shaft presents the high trajectory. In particular, it is preferable that the value is a recognizable word or number, or a short sentence in which the word and number, a code, a drawing and the like are appropriately combined.

As described above, the golfer obtains the value that indicates the ratio of the frequencies indicated on the golf club and, if necessary, the reference information for recognizing the value that indicates the ratio of the frequencies as information, and then it is possible that the golfer selects a golf club that presents the most suitable trajectory for him/her among the golf clubs on which the information is indicated.

Note that, in the above-described fourth embodiment according to the golf club of the present invention, the value that indicates the ratio of the frequencies and the reference information are integrally indicated on a portion of the golf club. However, in the present invention, the value that indicates the ratio of the frequencies and the reference information may be independently indicated on a portion of the golf club. For example, the value that indicates the ratio of frequencies may be indicated on the club head and the reference information may be indicated on the club shaft. At least, it is satisfactory that the reference information for recognizing the value that indicates the ratio of the frequencies is indicated on a place which is easy to find, by making the value that indicates the ratio of the frequencies as a guide.

Figure 50A:
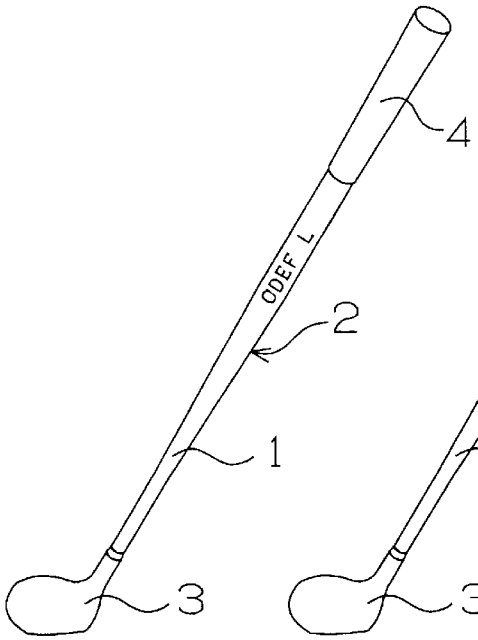
FIGS. 50 (*a*) to 50 (*c*) are front views, each thereof showing a golf club according to a fifth embodiment of the present invention.
Figure 50B:
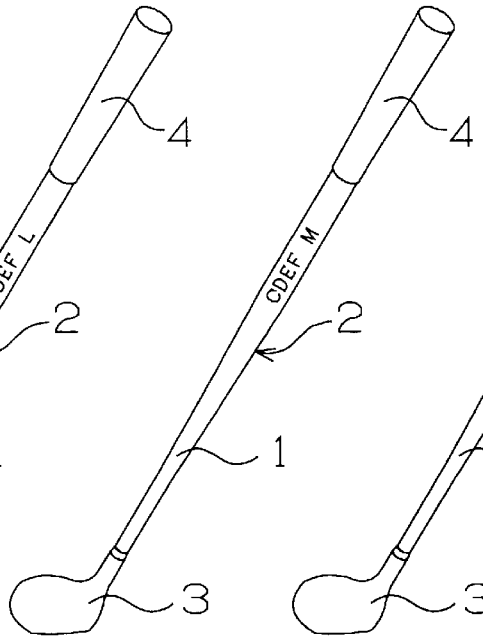
Figure 50C:
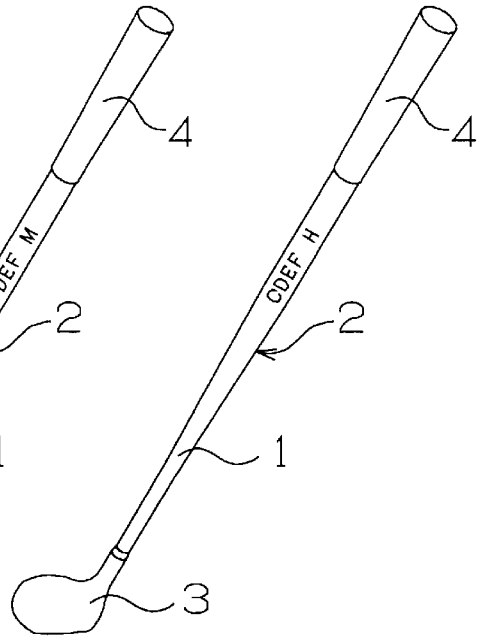

A fifth embodiment according to the golf club of the present invention will be described by using drawings. FIGS. 50 (*a*), (*b*) and (*c*) are the golf clubs according to the present invention. The golf club of FIG. 50 (*a*) indicates 'L' on the club shaft along with the brand name 'CDEF' of the golf club. The golf club of FIG. 50 (*b*) indicates 'M' on the club shaft along with the brand name 'CDEF' of the golf club. The golf club of FIG. 50 (*c*) indicates 'H' on the club shaft along with the brand name 'CDEF' of the golf club.

FIG. 51 shows a medium (M) on which a description is printed regarding the golf club of a brand name 'CDEF' as shown in FIGS. 50 (*a*), (*b*) and (*c*). On the medium (M), along with the indication specifying the golf club such as the brand name 'CDEF series' of the golf club or the like, the reference information is also indicated which enables the golfers to recognize that the values 'L, M, H' indicated on the golf clubs are the information with regard to the value indicating the ratio of the frequencies, and that the values represent the trajectory presented by the golf club. (The ratio of the frequencies is the one obtained by the third evaluation method of the golf club according to the present invention.) The golfer understands the meaning of the value that indicates the ratio of the frequencies by the description shown on the medium (M), thus it is possible that he/she selects the golf club shown on the medium (M) by using the indicated values as a yardstick, in more detail, the golf club of the same model as shown in the medium (M) (because there is no more than one or one set of the exact golf club shown on the medium in the world.). In addition, 'Frequency ratio system' shown on the medium (M) of FIG. 51 is an example of a sales talk regarding the ratio of the frequencies, and the name thereof is appropriately created by a golf club manufacturer, a club shaft manufacturer, a sales company or the like.

The medium in the present invention is thought to be the one such as an instruction book on a golf club, a catalog, a poster, a panel or the like to be displayed at a store, a commercial film on a television, a video tape for sales promotion, indication through an electric communication line or the like that is published or manufactured by the golf club manufacturer, the club shaft manufacturer, the sales company or the like. In other words, the medium according to the present invention is the one that is mainly recognizable visually, describes regarding the value of the ratio of the frequencies, and specifies the golf club on which the value is indicated.

In order to actually explain the value that indicates the ratio of the frequencies according to the present invention to the golfer, it is understandable and preferable that the explanation is given by omitting detail technical items. Specifically, the content such as '178 mm of the rear end portion or 127 mm of the front portion is fastened, and the weight of 200 g is attached to the other end of the fastened portion.' is not particularly necessary as explanation content. It is preferable that such measurement conditions are standardized among the golf club manufacturer, the club shaft manufacturer or the like, and explanation is given to the golfer that the contents can be recognized such that the larger the ratio of the frequencies is, the larger the factors contributing to the increase in the dynamic loft becomes, and the club shaft that presents the high trajectory or the golf club assembled with the club shaft presents the high trajectory. In particular, for explaining the value that indicates the ratio of the frequencies indicated on the golf club by the medium, it is preferable that the explanation is given by using an understandable sentence, a drawing, a photograph of the related golf club or the like.

The above-described fifth embodiment according to the golf club of the present invention is an example in which the value that indicates the ratio of the frequencies is indicated on the golf club and the reference information is indicated on the medium. The golfer obtains the value that indicates the ratio of the frequencies indicated on the golf club and the reference information for recognizing the value as information, and then it becomes possible that the golfer selects a golf club that presents the most suitable trajectory for him/her among the golf clubs on which the values that indicate the ratio of the frequencies are indicated.

Figures 52A, 52B, 52C, 52D:
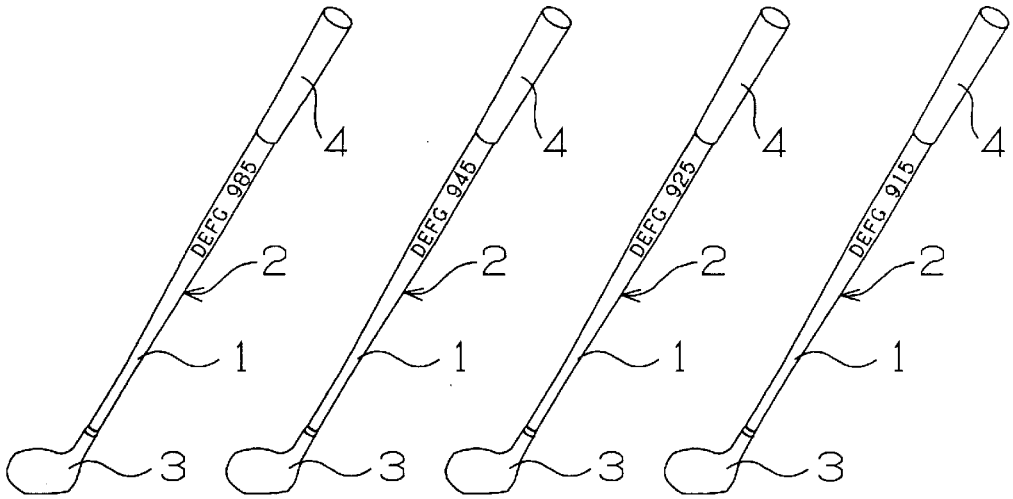
FIGS. 52 (*a*) to 52 (*d*) are front views, each thereof showing a golf club according to a sixth embodiment of the present invention.

A sixth embodiment according to the golf club of the present invention will be described by using drawings. FIGS. 52 (*a*), (*b*), (*c*) and (*d*) are the golf clubs according to the present invention. The golf club of FIG. 52 (*a*) indicates the model name 'DEFG 985' of the golf club. The golf club of FIG. 52 (*b*) indicates the model name 'DEFG 945' of the golf club. The golf club of FIG. 52 (*c*) indicates the model name 'DEFG 925' of the golf club. The golf club of FIG. 52 (*d*) indicates the model name 'DEFG 915' of the golf club.

FIG. 53 shows a medium (M') on which an explanation is given with regard to the golf clubs of the model names '985, 945, 925, 915' under the brand name 'DEFG' shown in FIGS. 52 (*a*), (*b*), (*c*) and (*d*). On the medium (M'), along with the indication specifying the golf club such as the brand name, the model name or the like such as 'Club DEFG' and 'DEFG 985, DEFG 945, DEFG 925, DEFG 915', the reference information is also indicated by which the models of the golf clubs '985, 945, 925, 915' enables the golfer to recognize that the trajectory presented by the golf club is designed based on the value indicating the ratio of the frequencies. The golfer understands the meaning of the value that indicates the ratio of the frequencies by the description shown on the medium (M'), thus it is possible that he/she selects the golf club of the model which is specified based on the value of the ratio of the frequencies, in more detail, the golf club of the same model as shown in the medium (M') (because there is no more than one or one set of the exact golf club shown on the medium in the world.). In addition, 'Ratio of the frequency theory' shown on the medium (M') of FIG. 53 is an example of a sales talk regarding the ratio of the frequencies, and the name thereof is appropriately created by a golf club manufacturer, a club shaft manufacturer, a sales company or the like.

The medium in the present invention is thought to be the one such as an instruction book on a golf club, a catalog, a poster, a panel or the like to be displayed at a store, a commercial film on a television, a video tape for sales promotion, indication through an electric communication line or the like that is published or manufactured by the golf club manufacturer, the club shaft manufacturer, the sales company or the like. In other words, the medium according to the present invention is the one that is mainly recognizable visually, describes regarding the value of the ratio of the frequencies, and shows the golf club which is set based on the value. Although the numerical value of the frequency is not directly indicated on the medium of FIG. 53, the golfer can understand that the ratio of the frequencies quantitatively expresses the trajectory presented by the club shaft and that the golf club shown on the medium is set by the trajectory based on the ratio of the frequencies, thus this medium is included in the present invention.

In order to actually explain the value that indicates the ratio of the frequencies according to the present invention to the golfer, it is understandable and preferable that the explanation is given by omitting detail technical items. Specifically, the content such as '178 mm of the rear end portion or 127 mm of the tip portion is fastened, and the weight of 200 g is attached to the other end of the fastened portion.' is not particularly necessary as explanation content. It is preferable that such measurement conditions are standardized among the golf club manufacturer, the club shaft manufacturer or the like, and explanation is given to the golfer that the contents can be recognized such that the larger the ratio of the frequencies is, the larger the factors contributing to the increase in the dynamic loft becomes, and the club shaft that presents the high trajectory or the golf club assembled with the club shaft presents the high trajectory. In particular, for explaining the value that indicates the ratio of the frequencies by the medium, it is preferable that the explanation is given by using an understandable sentence, a drawing, a photograph of the related golf club or the like.

The above-described sixth embodiment according to the golf club of the present invention is an example in which the value that indicates the ratio of the frequencies is specified corresponding to the model of the golf club and the reference information is indicated on the medium. The golfer obtains the value that indicates the ratio of the frequencies indicated on the golf club by making the value correspond to the model of the golf club and the reference information for recognizing the value as information, and then it becomes possible that the golfer selects a golf club that presents the most suitable trajectory for him/her among the golf clubs on which the values that indicate the ratio of the frequencies are indicated.

EXAMPLE

The ball-hitting test 1 was performed in order to confirm that the flexibility of the golf club is accurately shown by the evaluation method of the golf club of the present invention.

Method for the ball-hitting test 1

The ball-hitting test 1 was performed according to the following procedures.

(1) Manufacturing the golf club (2) The ball-hitting test and scoring by 200 golfers (3) Totalization of the scores and evaluation of the numerical values The details of each procedure (1), (2) and (3) are shown as follows.

(1) Manufacturing the golf club

With regard to the golf club, the golf clubs (C1) to (C10) as shown in Table 8 by using the metallic club shafts (S1) to (S10) having the basic characteristics as shown in Table 7, and the golf clubs (C11) to (C20) as shown in Table 10 by using the club shafts (S11) to (S20) made of fiber reinforced resin having the basic characteristics as shown in Table 9 were manufactured. Note that steel was used as a material of the metallic club shaft, and carbon fiber reinforced resin (CFRP) was used as a material of the club shaft made of fiber reinforced resin.

TABLE 7

| Club shaft | S1 | S2 | S3 | S4 | S5 | S6 | S7 | S8 | S9 | S10 |
|---|---|---|---|---|---|---|---|---|---|---|
| Material | Steel | Steel | Steel | Steel | Steel | Steel | Steel | Steel | Steel | Steel |
| Frequency 1 (cpm) * 1 | 906 | 863 | 877 | 852 | 900 | 857 | 762 | 954 | 887 | 949 |
| Frequency 2 (cpm) * 2 | 493 | 476 | 473 | 490 | 498 | 548 | 462 | 552 | 502 | 429 |
| Frequency 3 (cpm) * 3 | 840 | 813 | 819 | 783 | 837 | 781 | 705 | 887 | 824 | 875 |
| Frequency 4 (cpm) * 4 | 437 | 426 | 423 | 435 | 445 | 482 | 414 | 485 | 445 | 339 |
| Sum of frequencies 1 (cpm) * 5 | 1399 | 1339 | 1350 | 1342 | 1398 | 1405 | 1224 | 1506 | 1389 | 1378 |
| Sum of frequencies 2 (cpm) * 6 | 1277 | 1239 | 1242 | 1218 | 1282 | 1263 | 1119 | 1372 | 1269 | 1214 |

However, with regard to the physical properties other than the physical properties relative to the frequencies shown in Table 7, they were all adjusted constantly for the club shafts (S1) to (S10). Principal physical properties are shown as follows.

Length: 1122 mm

Mass: 115 g

Diameter of rear end portion: 15.2 mm

Diameter of tip portion: 8.5 mm

TABLE 8

| Golf club | C1 | C2 | C3 | C4 | C5 | C6 | C7 | C8 | C9 | C10 |
|---|---|---|---|---|---|---|---|---|---|---|
| Club shaft | S1 | S2 | S3 | S4 | S5 | S6 | S7 | S8 | S9 | S10 |
| Frequency 5 (cpm) * 7 | 263 | 250 | 255 | 247 | 261 | 248 | 221 | 277 | 256 | 275 |

However, with regard to the physical properties other than the physical properties relative to the frequencies shown in Table 8, they were all adjusted constantly for the club shafts (C1) to (C10). Principal physical properties are shown as follows.

Club head: Head made of titanium alloy having the mass of 180 g was used.

Grip: Swing Rite M60 manufactured by Eaton Corporation (Golf Pride) was used.

Club length: 45 inches

Description will be made for *1 to *7 in the Tables.

* 1: The frequency 1 is the numerical value (cpm) that is obtained by measuring the frequency as follows. Club timing harmonizer manufactured by Fujikura Rubber was used. The rear end portion of the club shaft was fastened on the frequency measuring device by 178 mm, the tip portion was picked by a hand to displace in the vertical direction, and the hand released it to cause vibration. The basic operational procedure followed the operational procedure of the golf club bending vibrograph defined by Japan Golf Gear Association.

* 2: The frequency 2 is the numerical value (cpm) that is obtained by measuring the frequency as follows. Club timing harmonizer manufactured by Fujikura Rubber was used. The tip portion of the club shaft was fastened on the frequency measuring device by 178 mm, the rear end portion was picked by a hand to displace in the vertical direction, and the hand released it to cause vibration. The basic operational procedure followed the operational procedure of the golf club bending vibrograph defined by Japan Golf Gear Association.

* 3: The frequency 3 is the numerical value (cpm) that is obtained by measuring the frequency as follows. Club timing harmonizer manufactured by Fujikura Rubber was used. The rear end portion of the club shaft was fastened on the frequency measuring device by 127 mm, the tip portion was picked by a hand to displace in the vertical direction, and the hand released it to cause vibration. The basic operational procedure followed the operational procedure of the golf club bending vibrograph defined by Japan Golf Gear Association.

* 4: The frequency 4 is the numerical value (cpm) that is obtained by measuring the frequency as follows. Club timing harmonizer manufactured by Fujikura Rubber was used. The tip portion of the club shaft was fastened on the frequency measuring device by 127 mm, the rear end portion was picked by a hand to displace in the vertical direction, and the hand released it to cause vibration. The basic operational procedure followed the operational procedure of the golf club bending vibrograph defined by Japan Golf Gear Association.

* 5: The sum of the frequencies 1 is the sum of the numerical values of the frequency 1 and the frequency 2.

* 6: The sum of the frequencies 2 is the sum of the numerical values of the frequency 3 and the frequency 4.

* 7: The frequency 5 is the numerical value (cpm) that is obtained by measuring the frequency as follows. Club timing harmonizer manufactured by Fujikura Rubber was used. The rear end portion of the club shaft was fastened on the frequency measuring device by 178 mm, the club head was picked by a hand to displace in the vertical direction, and the hand released it to cause vibration. The basic operational procedure followed the operational procedure of the golf club bending vibrograph defined by Japan Golf Gear Association.

TABLE 9

| Club shaft | S11 | S12 | S13 | S14 | S15 | S16 | S17 | S18 | S19 | S20 |
|---|---|---|---|---|---|---|---|---|---|---|
| Material | CFRP | CFRP | CFRP | CFRP | CFRP | CFRP | CFRP | CFRP | CFRP | CFRP |
| Frequency 1 (cpm) * 1 | 991 | 956 | 995 | 847 | 821 | 890 | 799 | 846 | 821 | 617 |
| Frequency 2 (cpm) * 2 | 393 | 461 | 459 | 475 | 488 | 523 | 423 | 494 | 495 | 504 |
| Frequency 3 (cpm) * 3 | 919 | 902 | 944 | 799 | 781 | 840 | 769 | 800 | 778 | 572 |
| Frequency 4 (cpm) * 4 | 373 | 407 | 407 | 439 | 449 | 458 | 370 | 438 | 443 | 460 |
| Sum of frequencies 1 (cpm) * 5 | 1384 | 1417 | 1454 | 1322 | 1309 | 1413 | 1222 | 1340 | 1316 | 1121 |
| Sum of frequencies 2 (cpm) * 6 | 1292 | 1309 | 1351 | 1238 | 1230 | 1298 | 1139 | 1238 | 1221 | 1032 |

However, with regard to the physical properties other than the physical properties relative to the frequencies shown in Table 9, they were all adjusted constantly for the club shafts (S11) to (S20). Principal physical properties are shown as follows.

Length: 1122 mm

Mass: 60 g

Diameter of rear end portion: 15.2 mm

Diameter of tip portion: 8.5 mm

TABLE 10

| Golf club | C11 | C12 | C13 | C14 | C15 | C16 | C17 | C18 | C19 | C20 |
|---|---|---|---|---|---|---|---|---|---|---|
| Club shaft | S11 | S12 | S13 | S14 | S15 | S16 | S17 | S18 | S19 | S20 |
| Frequency 5 (cpm) * 7 | 260 | 251 | 262 | 222 | 216 | 233 | 210 | 222 | 215 | 162 |

However, with regard to the physical properties other than the physical properties relative to the frequencies shown in Table 10, they were all adjusted constantly for the club shafts (C11) to (C20). Principal physical properties are shown as follows.

Club head: Head made of titanium alloy having the mass of 195 g was used.

Grip: Swing Rite M60 manufactured by Eaton Corporation (Golf Pride) was used.

Club length: 45 inches (2) Ball-hitting test and scoring by 200 golfers

The ball-hitting test by golfers was performed with regard to the ten kinds each of the golf clubs (C1) to (C10) and (C11) to (C20) that were manufactured in (1). One golfer hit 5 balls with each of the golf clubs (C1) to (C10) and (C11) to (C20), and scored feelings of the flexibility of the club shafts. The scores were made based on: 1 point for flexible; 2 points for slightly flexible; 3 points for regular; 4 points for slightly stiff; and 5 points for stiff. Although one golfer hit 5 balls per one golf club, the scoring was made once. In other words, the feeling of the flexibility was evaluated by hitting 5 balls per one golf club. The above-described evaluation was performed by the 200 golfers.

(3) Totalization of the score and Evaluation of the numerical value

The scores of the 200 golfers per one golf club were totalized with regard to the scores obtained from the evaluation in (2), thus making a totalized point. Incidentally, the full score is: 5 (the highest point in the scoring)×200 (the number of the golfers)=1000 points. The totalized points for (C1) to (C10) and numerical values of the frequencies 1, 3, 5 and the sum of frequencies 1,2, which correspond to (C1) to (C10) are shown in Table 11. The totalized points for (C11) to (C20) and numerical values of the frequencies 1, 3, 5 and the sum of frequencies 1,2, which correspond to (C11) to (C20) are shown in Table 12.

TABLE 11

| Golf club | C1 | C2 | C3 | C4 | C5 | C6 | C7 | C8 | C9 | C10 |
|---|---|---|---|---|---|---|---|---|---|---|
| a.Totalized points | 675 | 572 | 620 | 528 | 845 | 626 | 340 | 938 | 684 | 638 |
| b.Frequency 1 (cpm) * 1 | 906 | 863 | 877 | 852 | 900 | 857 | 762 | 954 | 887 | 949 |
| c.Frequency 3 (cpm) * 3 | 840 | 813 | 819 | 783 | 837 | 781 | 705 | 887 | 824 | 875 |
| d.Frequency 5 (cpm) * 7 | 263 | 250 | 255 | 247 | 261 | 248 | 221 | 277 | 256 | 275 |
| e.Sum of frequencies 1 (cpm) * 5 | 1399 | 1339 | 1350 | 1342 | 1398 | 1405 | 1224 | 1506 | 1389 | 1378 |
| f.Sum of frequencies 2 (cpm) * 6 | 1277 | 1239 | 1242 | 1218 | 1282 | 1263 | 1119 | 1372 | 1269 | 1214 |

TABLE 12

| Golf club | C11 | C12 | C13 | C14 | C15 | C16 | C17 | C18 | C19 | C20 |
|---|---|---|---|---|---|---|---|---|---|---|
| a.Totalized points | 576 | 677 | 807 | 678 | 622 | 672 | 341 | 664 | 568 | 253 |
| b. Frequency 1 (cpm) * 1 | 991 | 956 | 995 | 847 | 821 | 890 | 799 | 846 | 821 | 617 |
| c. Frequency 3 (cpm) * 3 | 919 | 902 | 944 | 799 | 781 | 840 | 769 | 800 | 778 | 572 |
| d.Frequency 5 (cpm) * 7 | 260 | 251 | 262 | 222 | 216 | 233 | 210 | 222 | 215 | 162 |
| e.Sum of frequencies 1 (cpm) * 5 | 1384 | 1417 | 1454 | 1322 | 1309 | 1413 | 1222 | 1340 | 1316 | 1121 |
| f.Sum of frequencies 2 (cpm) * 6 | 1292 | 1309 | 1351 | 1238 | 1230 | 1298 | 1139 | 1238 | 1221 | 1032 |

In Table 11 and Table 12, the numerical value a of the totalized points is based on the above-described scores of the flexibility of the club shafts, which were obtained from 200 golfers, and it can be said that the numerical value is the one that quantitatively indicates the flexibility of the club shafts. The numerical value b of the frequency 1 and the numerical value 3 of the frequency 3 are the frequencies of the club shaft by the conventional evaluation method. The numerical value d of the frequency 5 is the frequency of the golf club by the conventional evaluation method. On the other hand, the numerical value e of the sum of the frequencies 1 and the numerical value f of the sum of the frequencies 2 are the sums of the frequencies by the evaluation method of the present invention. The numerical values b, c, d, e and f regarding these frequencies show that the larger the values are, the stiffer the club shafts become.

In order to determine that the numerical values b, c, d, e and f quantitatively show the flexibility of the club shafts, the correlation of the numerical values b, c, d, e and f to the numerical value a that is a quantitative numerical value by using Pearson's moment correlation coefficient. It can be said that the higher the correlation with the numerical value a is, the more quantitatively the numerical values b, c, d, e and f show the flexibility of the club shafts. In other words, it can be said that the higher the correlation with the numerical value a is, the more accurately the numerical values b, c, d, e and f show the flexibility of the club shafts on the numerical value. The correlation coefficient between the numerical value a and the numerical value b was made to be r1, the correlation coefficient between the numerical value a and the numerical value c was made to be r2, the correlation coefficient between the numerical value a and the numerical value d was made to be r3, the correlation coefficient between the numerical value a and the numerical value e was made to be r4, and the correlation coefficient between the numerical value a and the numerical value f was made to be r5. The correlation coefficients r1 to r5 were calculated for the group of golf clubs (C1) to (C10) made of metallic club shaft and the group of golf clubs (C11) to (C20) made of fiber reinforced resin. The correlation coefficients r1 to r5 for each group are shown in Table 13.

TABLE 13

| | r1 | r2 | r3 | r4 | r5 |
|---|---|---|---|---|---|
| Group of C1 to C10 | 0.835 | 0.838 | 0.835 | 0.928 | 0.938 |

TABLE 13-continued

| | r1 | r2 | r3 | r4 | r5 |
|---|---|---|---|---|---|
| Group of C10 to C20 | 0.792 | 0.799 | 0.791 | 0.919 | 0.927 |

According to the ball-hitting test 1, in both of the group of golf clubs (C1) to (C10) made of metallic club shaft and the group of golf clubs (C11) to (C20) made of fiber reinforced resin, r4 and r5, which are the correlation coefficients between the numerical value a and the sum of frequencies by the evaluation method of the present invention, is larger than r1, r2 and r3, which are the correlation coefficients between the numerical value a and the sum of frequencies by the conventional evaluation method. The correlation coefficients r4 and r5 have higher correlation with the numerical value a, thus it can be seen that the evaluation method of the present invention accurately shows the flexibility of the club shaft on numerical value.

Moreover, the ball-hitting test 2 was performed in order to confirm that the launching angle of a hit ball presented is accurately shown by the evaluation method of the golf club of the present invention.

Method for the ball-hitting test 2

The ball-hitting test 2 was performed according to the following procedures.

(1) Manufacturing the golf club (2) The ball-hitting test by a swinging robot The details of each procedure (1) and (2) are shown as follows.

(1) Manufacturing the golf club

With regard to the golf club, the golf clubs (C1) to (C10) as shown in Table 15 by using the metallic club shafts (S1) to (S10) having the basic characteristics as shown in Table 14, and the golf clubs (C11) to (C20) as shown in Table 17 by using the club shafts (S11) to (S20) made of fiber reinforced resin having the basic characteristics as shown in Table 16 were manufactured. Note that steel was used as a material of the metallic club shaft, and carbon fiber reinforced resin (CFRP) was used as a material of the club shaft made of fiber reinforced resin.

TABLE 14

| Club shaft | S1 | S2 | S3 | S4 | S5 | S6 | S7 | S8 | S9 | S10 |
|---|---|---|---|---|---|---|---|---|---|---|
| Material | Steel | Steel | Steel | Steel | Steel | Steel | Steel | Steel | Steel | Steel |
| Frequency 1 (cpm) * 1 | 906 | 863 | 877 | 852 | 900 | 857 | 762 | 954 | 887 | 949 |
| Frequency 2 (cpm) * 2 | 493 | 476 | 473 | 490 | 498 | 548 | 462 | 552 | 502 | 429 |
| Frequency 3 (cpm) * 3 | 840 | 813 | 819 | 783 | 837 | 781 | 705 | 887 | 824 | 875 |
| Frequency 4(cpm) * 4 | 437 | 426 | 423 | 435 | 445 | 482 | 414 | 485 | 445 | 339 |
| Ratio of frequencies 1(cpm) * 8 | 1.84 | 1.81 | 1.85 | 1.74 | 1.81 | 1.56 | 1.65 | 1.73 | 1.77 | 2.21 |
| Ratio of frequencies 2 (cpm) * 9 | 0.648 | 0.645 | 0.650 | 0.635 | 0.644 | 0.610 | 0.623 | 0.633 | 0.639 | 0.689 |
| Ratio of frequencies 3 (cpm) * 10 | 1.92 | 1.91 | 1.94 | 1.80 | 1.88 | 1.62 | 1.70 | 1.83 | 1.85 | 2.58 |
| Ratio of frequencies 4 (cpm) * 11 | 0.658 | 0.656 | 0.659 | 0.643 | 0.653 | 0.618 | 0.630 | 0.647 | 0.649 | 0.721 |

However, with regard to the physical properties other than the physical properties relative to the frequencies shown in Table 14, they were all adjusted constantly for the club shafts (S1) to (S10). Principal properties are shown as follows.

Length: 1122 mm

Mass: 115 g

Diameter of rear end portion: 15.2 mm

Diameter of tip portion: 8.5 mm

Club length: 45 inches

Description will be made with regard to *8 to * 11.

* 8: Ratio of the frequencies 1 is (frequency 1/frequency 2).

* 9: Ratio of the frequencies 2 is (frequency 1/(frequency 1+frequency 2)).

* 10: Ratio of the frequencies 3 is (frequency 3/frequency 4).

TABLE 15

| Golf club | C1 | C2 | C3 | C4 | C5 | C6 | C7 | C8 | C9 | C10 |
|---|---|---|---|---|---|---|---|---|---|---|
| Club shaft | S1 | S2 | S3 | S4 | S5 | S6 | S7 | S8 | S9 | S10 |
| Frequency 5 (cpm) * 7 | 263 | 250 | 255 | 247 | 261 | 248 | 221 | 277 | 256 | 275 |

However, with regard to the physical properties other than the physical properties relative to the frequencies shown in Table 15, they were all adjusted constantly for the golf clubs (C1) to (C10). Principal properties are shown as follows.

Club head: Head made of titanium alloy having the mass of 180 g was used.

Grip: Swing Rite M60 manufactured by Eaton Corporation (Golf Pride) was used.

* 11: Ratio of the frequencies 4 is (frequency 3/(frequency 3+frequency 4)).

TABLE 16

| Club shaft | S11 | S12 | S13 | S14 | S15 | S16 | S17 | S18 | S19 | S20 |
|---|---|---|---|---|---|---|---|---|---|---|
| Material | CFRP | CFRP | CFRP | CFRP | CFRP | CFRP | CFRP | CFRP | CFRP | CFRP |
| Frequency 1 (cpm) * 1 | 991 | 956 | 995 | 847 | 821 | 890 | 799 | 846 | 821 | 617 |
| Frequency 2 (cpm) * 2 | 393 | 461 | 459 | 475 | 488 | 523 | 423 | 494 | 495 | 504 |
| Frequency 3 (cpm) * 3 | 919 | 902 | 944 | 799 | 781 | 840 | 769 | 800 | 778 | 572 |
| Frequency 4 (cpm) * 4 | 373 | 407 | 407 | 439 | 449 | 458 | 370 | 438 | 443 | 460 |
| Ratio of frequencies 1 * 8 | 2.52 | 2.07 | 2.17 | 1.78 | 1.68 | 1.70 | 1.89 | 1.71 | 1.66 | 1.22 |
| Ratio of frequencies 2 * 9 | 0.716 | 0.675 | 0.684 | 0.641 | 0.627 | 0.630 | 0.654 | 0.631 | 0.624 | 0.550 |
| Ratio of frequencies 3 * 10 | 2.46 | 2.22 | 2.32 | 1.82 | 1.74 | 1.83 | 2.08 | 1.83 | 1.76 | 1.24 |
| Ratio of frequencies 4 * 11 | 0.711 | 0.689 | 0.699 | 0.645 | 0.635 | 0.647 | 0.675 | 0.646 | 0.637 | 0.554 |

However, with regard to the physical properties other than the physical properties relative to the frequencies shown in Table 16, they were all adjusted constantly for the club shafts (S11) to (S20). Principal properties are shown as follows.

Length: 1122 mm

Mass: 60 g

Diameter of rear end portion: 15.2 mm

Diameter of tip portion: 8.5 mm

TABLE 17

| Golf club | C11 | C12 | C13 | C14 | C15 | C16 | C17 | C18 | C19 | C20 |
|---|---|---|---|---|---|---|---|---|---|---|
| Club shaft | S11 | S12 | S13 | S14 | S15 | S16 | S17 | S18 | S19 | S20 |
| Frequency 5 (cpm) * 7 | 260 | 251 | 262 | 222 | 216 | 233 | 210 | 222 | 215 | 162 |

However, with regard to the physical properties other than the physical properties relative to the frequencies shown in Table 17, they were all adjusted constantly for the golf clubs (C11) to (C20). Principal properties are shown as follows.

Club head: Head made of titanium alloy having the mass of 195 g was used.

Grip: Swing Rite M60 manufactured by Eaton Corporation (Golf Pride) was used.

Club length: 45 inches (2) Ball-hitting test by a swinging robot

The ball-hitting test by the swinging robot was performed with regard to the ten kinds each of the golf clubs (C1) to (C10) and (C11) to (C20) that were manufactured in (1), and the launching angles were measured. Shotrobo 4 manufactured by Miyamae Co., Ltd. was used as the swinging robot and an H/S golf ball manufactured by The Yokohama Rubber Co., Ltd. was used as the golf ball, then the ball was hit with the head speed setting at 40 m/s and the launching angles were measured to obtain a mean value for 10 times of ball hitting. The launching angles of (C1) to (C10) and the numerical values of the ratio of the frequencies 1, 2, 3 and 4 that correspond to (C1) to (C10) are shown in Table 18, and the launching angles of (C11) to (C20) and the numerical values of the ratio of the frequencies 1, 2, 3 and 4 that correspond to (C11) to (C20) are shown in Table 19.

In order to determine that the numerical values b', c', d' and e' quantitatively show the height of trajectory presented by the club shafts, the correlation of the numerical values b', c', d' and e' to the quantitative numerical value a' by using Pearson's moment correlation coefficient. It can be said that the higher the correlation with the numerical value a' is, the more quantitatively the numerical values b', c', d' and e' show the height of trajectory presented by the club shafts. In other words, it can be said that the higher the correlation with the numerical value a' is, the more accurately the numerical values b', c', d' and e' show the height of trajectory presented by the club shafts on the numerical value. The correlation coefficient between the numerical value a' and the numerical value b' was made to be r'1, the correlation coefficient between the numerical value a' and the numerical value c' was made to be r'2, the correlation coefficient between the numerical value a' and the numerical value d' was made to be r'3, and the correlation coefficient between the numerical value a' and the numerical value e' was made to be r'4. The correlation coefficients r'1 to r'4 were calculated for the group of golf clubs (C1) to (C10) made of metallic club shaft and for the group of golf clubs (C11) to (C20) made of fiber reinforced resin. The correlation coefficients r'1 to r'4 for each group are shown in Table 20.

TABLE 18

| Golf club | C1 | C2 | C3 | C4 | C5 | C6 | C7 | C8 | C9 | C10 |
|---|---|---|---|---|---|---|---|---|---|---|
| a'. Launching angle (°) | 10.56 | 10.61 | 10.80 | 10.52 | 10.66 | 9.56 | 10.65 | 9.93 | 10.42 | 11.87 |
| b'. Ratio of frequencies 1 *8 | 1.84 | 1.81 | 1.85 | 1.74 | 1.81 | 1.56 | 1.65 | 1.73 | 1.77 | 2.21 |
| c'. Ratio of frequencies 2 *9 | 0.648 | 0.645 | 0.650 | 0.635 | 0.644 | 0.610 | 0.623 | 0.633 | 0.639 | 0.689 |
| d'. Ratio of frequencies 3 *10 | 1.92 | 1.91 | 1.94 | 1.80 | 1.88 | 1.62 | 1.70 | 1.83 | 1.85 | 2.58 |
| e'. Ratio of frequencies 4 *11 | 0.658 | 0.656 | 0.659 | 0.643 | 0.653 | 0.618 | 0.630 | 0.647 | 0.649 | 0.721 |

TABLE 19

| Golf club | C11 | C12 | C13 | C14 | C15 | C16 | C17 | C18 | C19 | C20 |
|---|---|---|---|---|---|---|---|---|---|---|
| a'. Launching angle (°) | 12.67 | 11.33 | 10.97 | 10.46 | 10.82 | 10.11 | 11.78 | 10.70 | 10.50 | 9.19 |
| b'. Ratio of frequencies 1 *8 | 2.52 | 2.07 | 2.17 | 1.78 | 1.68 | 1.70 | 1.89 | 1.71 | 1.66 | 1.22 |
| c'. Ratio of frequencies 2 *9 | 0.716 | 0.675 | 0.684 | 0.641 | 0.627 | 0.630 | 0.654 | 0.631 | 0.624 | 0.550 |
| d'. Ratio of frequencies 3 *10 | 2.46 | 2.22 | 2.32 | 1.82 | 1.74 | 1.83 | 2.08 | 1.83 | 1.76 | 1.24 |
| e'. Ratio of frequencies 4 *11 | 0.711 | 0.689 | 0.699 | 0.645 | 0.635 | 0.647 | 0.675 | 0.646 | 0.637 | 0.554 |

In Table 18 and Table 19, the numerical value a' is based on the score of the height of the hit ball, and it can be said that the numerical value a' is the one that quantitatively shows the height of the hit ball. On the other hand, the numerical value b' of the ratio of the frequencies 1, the numerical value c' of the ratio of the frequencies 2, the numerical value d' of the ratio of the frequencies 3 and the numerical value e' of the ratio of the frequencies 4 are the ratio of the frequencies by the evaluation method of the present invention. The numerical values b', c', d' and e' regarding these frequencies show that the larger the values are, the higher the trajectory is presented.

TABLE 20

| | r'1 | r'2 | r'3 | r'4 |
|---|---|---|---|---|
| Group of C1 to C10 | 0.902 | 0.901 | 0.876 | 0.883 |
| Group of C11 to C20 | 0.897 | 0.894 | 0.881 | 0.869 |

According to the ball-hitting test 2, in both of the group of golf clubs (C1) to (C10) made of metallic club shaft and the group of golf clubs (C11) to (C20) made of fiber reinforced resin, r'1 to r'4 are large, which are the correlation coefficients between the numerical value a' and the ratio of frequencies b' to e' by the evaluation method of the present invention. The correlation coefficients r'1 to r'4 have higher correlation with the numerical value a', thus it can be seen that the height of trajectory presented by the club shaft is accurately shown in numerical value.

According to the evaluation method of the golf club of the present invention, it becomes possible the flexibility of the club shaft more accurately in the numerical value. Moreover, according to the golf club of the present invention, the value showing more accurately the flexibility of the club shaft is made to be recognizable by an indication or a medium, thus the golfer uses the value as a guide when he/she purchases the golf club. In addition, according to the evaluation method of the present invention, it becomes possible to show the height of trajectory presented by the club shaft more accurately in the numerical value. Further, according to the golf club of the present invention, the value showing more accurately the height of trajectory presented by the golf club is made to be recognizable by an indication or a medium, thus the golfer uses the value as a guide when he/she purchases the golf club, which is extremely useful.

Although the preferred embodiments of the present invention have been described in detail, it should be understood that various changes, substitutions and alternations can be made therein without departing from spirit and scope of the inventions as defined by the appended claims.

What is claimed is:

1. A method for evaluating performance characteristics of a golf club having a club shaft and a club head, comprising the steps of:

fixing a rear end portion of the club shaft;

vibrating a tip portion of the club shaft while the rear end portion of the club shaft is fixed;

measuring frequency per unit time of the vibrating shaft to obtain a first frequency;

fixing the tip portion of the club shaft;

vibrating the rear end portion of the club shaft while the tip portion is fixed;

measuring frequency per unit time of the vibrating shaft to obtain a second frequency;

applying the club head to the club shaft; and rating the golf club based on a calculated value of the first and second measured frequencies.

2. A method for evaluating performance characteristics of a golf club having a club shaft and a club head, comprising the steps of:

fixing a tip portion of the club shaft;

vibrating a rear end portion of the club shaft while the tip portion of the club shaft is fixed;

measuring frequency per unit time of the vibrating shaft;

applying the club head to the club shaft; and rating the golf club based on the measured frequency.

3. A method for evaluating performance characteristics of a golf club having a club shaft and a club head, comprising the steps of:

fixing a rear end portion of the club shaft;

vibrating a tip portion of the club shaft while the rear end portion of the club shaft is fixed;

measuring frequency per unit time of the vibrating shaft to obtain a first frequency;

fixing the tip portion of the club shaft;

vibrating the rear end portion of the club shaft while the tip portion is fixed;

measuring frequency per unit time of the vibrating shaft to obtain a second frequency;

applying the club head to the club shaft; and rating the golf club based on a sum of the first and second measured frequencies.

4. A method for evaluating performance characteristics of a golf club having a club shaft and a club head, comprising the steps of:

fixing a rear end portion of the club shaft;

vibrating a tip portion of the club shaft while the rear end portion of the club shaft is fixed;

measuring frequency per unit time of the vibrating shaft to obtain a first frequency;

fixing the tip portion of the club shaft;

vibrating the rear end portion of the club shaft while the tip portion is fixed;

measuring frequency per unit time of the vibrating shaft to obtain a second frequency;

applying the club head to the club shaft; and rating the golf club based on a ratio of the first and second measured frequencies.

5. The evaluation method for a golf club according to any one of claims 2 to 4, including a step of attaching a weight to the tip and rear end portions before vibration thereof, respectively.

6. The evaluation method for a golf club according to any one of claims 2 to 4, wherein said club shaft is made of fiber reinforced resin.

* * * * *

UNITED STATES PATENT AND TRADEMARK OFFICE

CERTIFICATE OF CORRECTION

PATENT NO. : 6,546,802 B2
DATED : April 15, 2003
INVENTOR(S) : Takayuki Shiraishi et al.

It is certified that error appears in the above-identified patent and that said Letters Patent is hereby corrected as shown below:

Title page,
Following Item [65], insert item -- (30) Foreign Application Priority Data:
Dec. 9, 1999 (JP) …… 11-349650 --.

Column 44,
Line 43, "claims 2 to 4" should read -- claims 1 to 4 --.
Line 47, "claims 2 to 4" should read -- claims 1 to 4 --.

Signed and Sealed this

Sixteenth Day of September, 2003

JAMES E. ROGAN
*Director of the United States Patent and Trademark Office*